US011225854B2

(12) United States Patent
Helms et al.

(10) Patent No.: US 11,225,854 B2
(45) Date of Patent: Jan. 18, 2022

(54) MODULAR TOP DRIVE SYSTEM

(71) Applicant: Weatherford Technology Holdings, LLC, Houston, TX (US)

(72) Inventors: Martin Helms, Burgdorf (DE); Martin Liess, Seelze (DE)

(73) Assignee: Weatherford Technology Holdings, LLC, Houston, TX (US)

( * ) Notice: Subject to any disclaimer, the term of this patent is extended or adjusted under 35 U.S.C. 154(b) by 749 days.

(21) Appl. No.: 15/006,562

(22) Filed: Jan. 26, 2016

(65) Prior Publication Data

US 2016/0215592 A1 Jul. 28, 2016

Related U.S. Application Data

(60) Provisional application No. 62/107,599, filed on Jan. 26, 2015.

(51) Int. Cl.

| | |
|---|---|
| ***E21B 41/00*** | (2006.01) |
| ***E21B 3/02*** | (2006.01) |
| ***E21B 19/16*** | (2006.01) |
| ***E21B 19/00*** | (2006.01) |
| ***E21B 19/07*** | (2006.01) |
| ***E21B 19/06*** | (2006.01) |

(52) U.S. Cl.

CPC ..... *E21B 41/00* (2013.01); *E21B 3/02* (2013.01); *E21B 19/16* (2013.01)

(58) Field of Classification Search

None

See application file for complete search history.

(56) References Cited

U.S. PATENT DOCUMENTS

| | | | | |
|---|---|---|---|---|
| 3,913,687 | A | 10/1975 | Gyongyosi et al. | |
| 4,593,773 | A | 6/1986 | Skeie | |
| 4,791,997 | A | 12/1988 | Krasnov | |
| 5,950,724 | A | 9/1999 | Giebeler | |
| 6,161,617 | A | 12/2000 | Gjedebo | |
| 6,527,047 | B1 | 3/2003 | Pietras | |
| 7,320,374 | B2 * | 1/2008 | Folk | E21B 19/02 175/220 |
| 7,509,722 | B2 | 3/2009 | Shahin et al. | |
| 7,665,530 | B2 | 2/2010 | Wells et al. | |
| 7,779,922 | B1 | 8/2010 | Harris et al. | |

(Continued)

FOREIGN PATENT DOCUMENTS

| | | | |
|---|---|---|---|
| AU | 2014215938 | A1 | 9/2014 |
| WO | 2007076403 | A2 | 7/2007 |

OTHER PUBLICATIONS

EPO Office Action dated Jun. 6, 2018, for European Application No. 16703221.8.

(Continued)

*Primary Examiner* — Matthew Troutman
*Assistant Examiner* — Douglas S Wood
(74) *Attorney, Agent, or Firm* — Patterson + Sheridan, LLP

(57) ABSTRACT

A modular top drive system for construction of a wellbore includes a motor unit. The motor unit includes: a drive body; a drive motor having a stator connected to the drive body; a trolley for connecting the drive body to a rail of a drilling rig; and a drive ring torsionally connected to a rotor of the drive motor and having a latch profile for selectively connecting one of: a drilling unit, a casing unit, and a cementing unit to the motor unit.

22 Claims, 31 Drawing Sheets

(56) References Cited

U.S. PATENT DOCUMENTS

| | | | | |
|---|---|---|---|---|
| 7,874,352 | B2 | 1/2011 | Odell, II et al. | |
| 7,896,111 | B2 * | 3/2011 | Slack | E21B 19/06 175/423 |
| 8,210,268 | B2 | 7/2012 | Heidecke et al. | |
| 8,365,834 | B2 * | 2/2013 | Liess | E21B 19/06 166/382 |
| 2004/0216924 | A1 * | 11/2004 | Pietras | E21B 19/07 175/57 |
| 2007/0140801 | A1 | 6/2007 | Kuttel et al. | |
| 2009/0274544 | A1 | 11/2009 | Liess | |
| 2012/0152530 | A1 | 6/2012 | Wiedecke et al. | |
| 2013/0055858 | A1 * | 3/2013 | Richardson | E21B 19/164 81/57.11 |
| 2013/0269926 | A1 | 10/2013 | Liess et al. | |
| 2013/0275100 | A1 * | 10/2013 | Ellis | B25J 19/023 703/2 |
| 2013/0299247 | A1 * | 11/2013 | Kuttel | E21B 3/02 175/170 |
| 2014/0090856 | A1 | 4/2014 | Pratt et al. | |
| 2014/0202767 | A1 | 7/2014 | Feasey | |

OTHER PUBLICATIONS

PCT International Search Report and Written Opinion dated Jun. 1, 2016, for International Application No. PCT/US2016/014854.
Australian Examination Report in related application AU 2016211732 dated May 27, 2020.
Brazil Office Action dated Jul. 7, 2020, for Brazil Patent Application No. BR112017015292-4.
Mexican Office Action in related application MX/a/2017/00956 dated Aug. 24, 2020.
Canadian Office Action in related application CA 2,92,992 dated Oct. 8, 2020.
Australian Office Action in related Australian Patent Application No. 2016211732 dated Nov. 11, 2020.
Mexican Office Action in related application MX/a/2017/009656 dated Mar. 10, 2021.
Australian Examination Report in related application AU 2016211732 dated Apr. 20, 2021.
European Office Action in related appliction EP 16703221.8 dated Apr. 9, 2021.
Canadian Office Action in related application CA 2,972,992 dated Apr. 12, 2021.
Canadian Office Action in related matter CA2972992 dated Oct. 29, 2021.
Mexican Office Action in related application MX/a/2017/009656 dated Sep. 9, 2021.

* cited by examiner

MODULAR TOP DRIVE SYSTEM

BACKGROUND OF THE DISCLOSURE

Field of the Disclosure

The present disclosure generally relates to a modular top drive system.

Description of the Related Art

A wellbore is formed to access hydrocarbon-bearing formations (e.g., crude oil and/or natural gas) or for geothermal power generation by the use of drilling. Drilling is accomplished by utilizing a drill bit that is mounted on the end of a drill string. To drill within the wellbore to a predetermined depth, the drill string is often rotated by a top drive on a surface rig. After drilling to a predetermined depth, the drill string and drill bit are removed and a section of casing is lowered into the wellbore. An annulus is thus formed between the string of casing and the formation. The casing string is hung from the wellhead. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Top drives are equipped with a motor for rotating the drill string. The quill of the top drive is typically threaded for connection to an upper end of the drill pipe in order to transmit torque to the drill string. The top drive may also have various accessories to facilitate drilling. For adapting to the larger casing string, the drilling accessories are removed from the top drive and a gripping head is added to the top drive. The gripping head has a threaded adapter for connection to the quill and grippers for engaging an upper end of the casing string. This shifting of the top drive between drilling and casing modes is time consuming and dangerous requiring rig personnel to work at heights. The threaded connection between the quill and the gripping head also unduly limits the load capacity of the top drive in the casing mode.

SUMMARY OF THE DISCLOSURE

The present disclosure generally relates to a modular top drive system. One embodiment provides a top drive comprising a drive body, a drive motor, wherein a stator of the drive motor is connected to the drive body, and a drive ring torsionally coupled to a rotor of the drive motor, wherein the drive ring has an internal latch profile for selectively receiving a tool.

Another embodiment provides a modular top drive system comprising a motor unit, a rack and a unit handler. The motor unit includes a drive body, a drive motor, wherein a stator of the drive motor is connected to the drive body, and a drive ring torsionally coupled to a rotor of the drive motor, wherein the drive ring has an internal latch profile for selectively receiving a tool. The rack includes a parking spot for receiving the tool. The unit handler retrieves the tool from the rack and delivers the tool to the drive unit.

Another embodiment provides a method of operating a modular top drive system. The method includes aligning a latch profile of a tool with an internal latch profile formed on a drive ring of a motor unit, inserting the tool into the motor unit, and engaging the latch profiles to connect the tool to the motor unit.

In one embodiment, a modular top drive system for construction of a wellbore includes a motor unit. The motor unit includes: a drive body; a drive motor having a stator connected to the drive body; a trolley for connecting the drive body to a rail of a drilling rig; and a drive ring torsionally connected to a rotor of the drive motor and having a latch profile for selectively connecting one of: a drilling unit, a casing unit, and a cementing unit to the motor unit.

In another embodiment, a method of operating a modular top drive system includes: retrieving a drilling unit from a unit rack; raising the retrieved drilling unit to or above the rig floor; delivering the retrieved drilling unit to a motor unit connected to a rail of the drilling rig; aligning a latch profile of the motor unit with a latch profile of the drilling unit; inserting the drilling unit into the motor unit; and engaging the latch profiles, thereby connecting the drilling unit to the motor unit.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
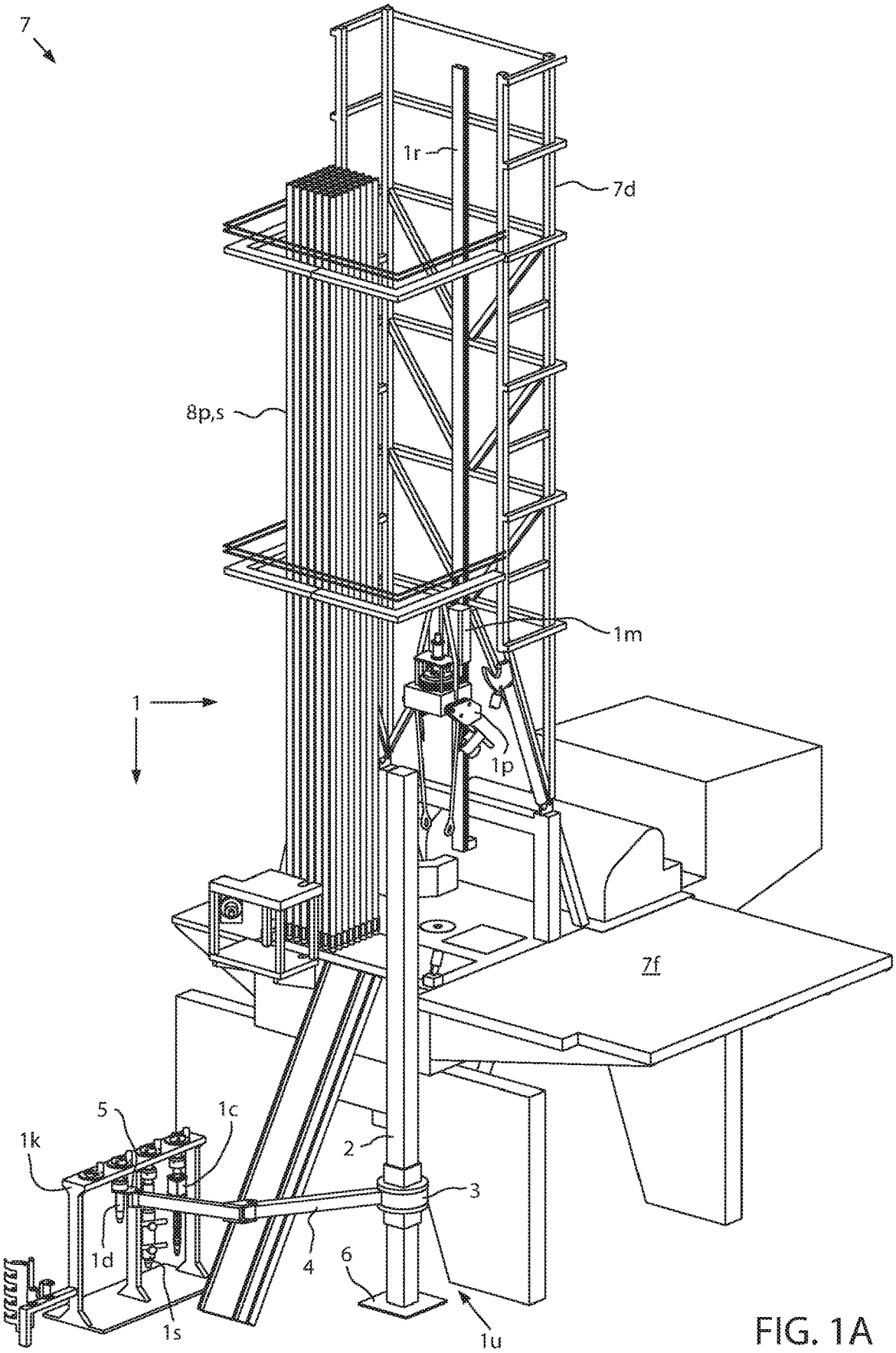
FIG. 1A illustrates a modular top drive system, according to one embodiment of the present disclosure.

FIG. 1A illustrates a modular top drive system 1, according to one embodiment of the present disclosure. The modular top drive system 1 may include a linear actuator 1*a* (FIG. 4L), a casing unit 1*c*, a drilling unit 1*d*, a pipe handler 1*p*, a unit rack 1*k*, a motor unit 1*m*, a rail 1*r*, a cementing unit 1*s*, and a unit handler 1*u*. The unit handler 1*u* may include a post 2, a slide hinge 3, an arm 4, a holder 5, a base 6, and one or more actuators (not shown).

The modular top drive system 1 may be assembled as part of a drilling rig 7 by connecting a lower end of the rail 1*r* to a floor 7*f* of the rig and an upper end of the rail to a derrick 7*d* of the rig such that a front of the rail is adjacent to a drill string opening in the rig floor. The rail 1*r* may have a length sufficient for the top drive system 1 to handle stands 8*s* of two to four joints of drill pipe 8*p*. It should be noted that the rail 1*r* may have a length for the top drive system 1 to hand more joints of drill pipe 8*p*. The rail length may be greater than or equal to twenty-five meters and less than or equal to one hundred meters.

Alternatively, the modular top drive system 1 may include twin rails instead of the monorail 1*r*. Alternatively, the lower end of the rail 1*r* may be connected to the derrick 7*d* instead of the floor 7*f*.

The base 6 may mount the post 2 on or adjacent to a structure of the drilling rig 7, such as a subfloor structure, such as a catwalk (not shown) or pad. Alternatively, the base 6 may a standalone structure. The unit rack 1*k* may also be located on or adjacent to the rig structure. The post 2 may extend vertically from the base 6 to a height above the rig floor 7*f* such that the unit handler 1*u* may retrieve any of the units 1*c,d,s* from the rack 1*k* and deliver the retrieved unit to the motor unit 1*m*.

The arm 4 may be connected to the slide hinge 3, such as by fastening. The slide hinge 3 may be transversely connected to the post 2, such as by a slide joint, while being free to move longitudinally along the post. Alternatively, the slide hinge 3 may be connected to the post 2 by any suitable structures, for example, by a friction bearing or a roller/ball bearing. The slide hinge 3 may also be pivotally connected to a linear actuator (not shown), such as by fastening. The slide hinge 3 may longitudinally support the arm 4 from the linear actuator while allowing pivoting of the arm relative to the post 2. The unit handler 1*u* may further include an electric, pneumatic, or hydraulic slew motor (not shown) for pivoting the arm 4 about the slide hinge 3.

The linear actuator may have a lower end pivotally connected to the base 6 and an upper end pivotally connected to the slide hinge 3. The linear actuator may include a cylinder and a piston disposed in a bore of the cylinder. The piston may divide the cylinder bore into a raising chamber and a lowering chamber and the cylinder may have ports formed through a wall thereof and each port may be in fluid communication with a respective chamber. Each port may be in fluid communication with a manifold 60*m* of a hydraulic power unit (HPU) 60 (both in FIG. 3) via a control line (not shown). Supply of hydraulic fluid to the raising port may move the slide hinge 3 and arm 4 upward to the rig floor 7*f*. Supply of hydraulic fluid to the lowering port may move the slide hinge 3 and arm 4 downward toward the base 6.

Alternatively, the linear actuator may include an electromechanical linear actuator, such as a motor and lead screw or pinion and gear rod, instead of the piston and cylinder assembly. For example, a gear rod connected to the post 2 may be meshed with a motor with gears at the location of the slide hinge 3. Alternatively, a rope may be used to move the slide hinge 3 up and down along the post 2

The arm 4 may include a forearm, an aft-arm, and an actuated joint, such as an elbow, connecting the arm segments. The holder 5 may be releasably connected to the forearm, such as by fastening. The arm 4 may further include an actuator (not shown) for selectively curling and extending the forearm and relative to the aft-arm. The arm actuator may have an end pivotally connected to the forearm and another end pivotally connected to the aft-arm. The arm actuator may include a cylinder and a piston disposed in a bore of the cylinder. The piston may divide the cylinder bore into an extension chamber and a curling chamber and the cylinder may have ports formed through a wall thereof and each port may be in fluid communication with a respective chamber. Each port may be in fluid communication with the HPU manifold 60*m* via a control line (not shown). Supply of hydraulic fluid to the respective ports may articulate the forearm and holder 5 relative to the aft-arm toward the respective positions.

Alternatively, the arm actuator may include an electromechanical linear actuator, such as a motor and lead screw or pinion and gear rod, instead of the piston and cylinder assembly. Alternatively, the actuated joint may be a telescopic joint instead of an elbow. Alternatively, the arm 4 may include more than two arm segments, joined together by linear joints, telescopic joints, or a combination of telescopic and linear joints. Additionally, the holder 5 may include a safety latch for retaining any of the units 1*c,d,s* thereto after engagement of the holder therewith to prevent unintentional release of the units during handling thereof. Additionally, the holder 5 may include a brake for torsionally connecting any of the units 1*c,d,s* thereto after engagement of the holder therewith to facilitate connection to the motor unit 1*m*.

Figure 4A:
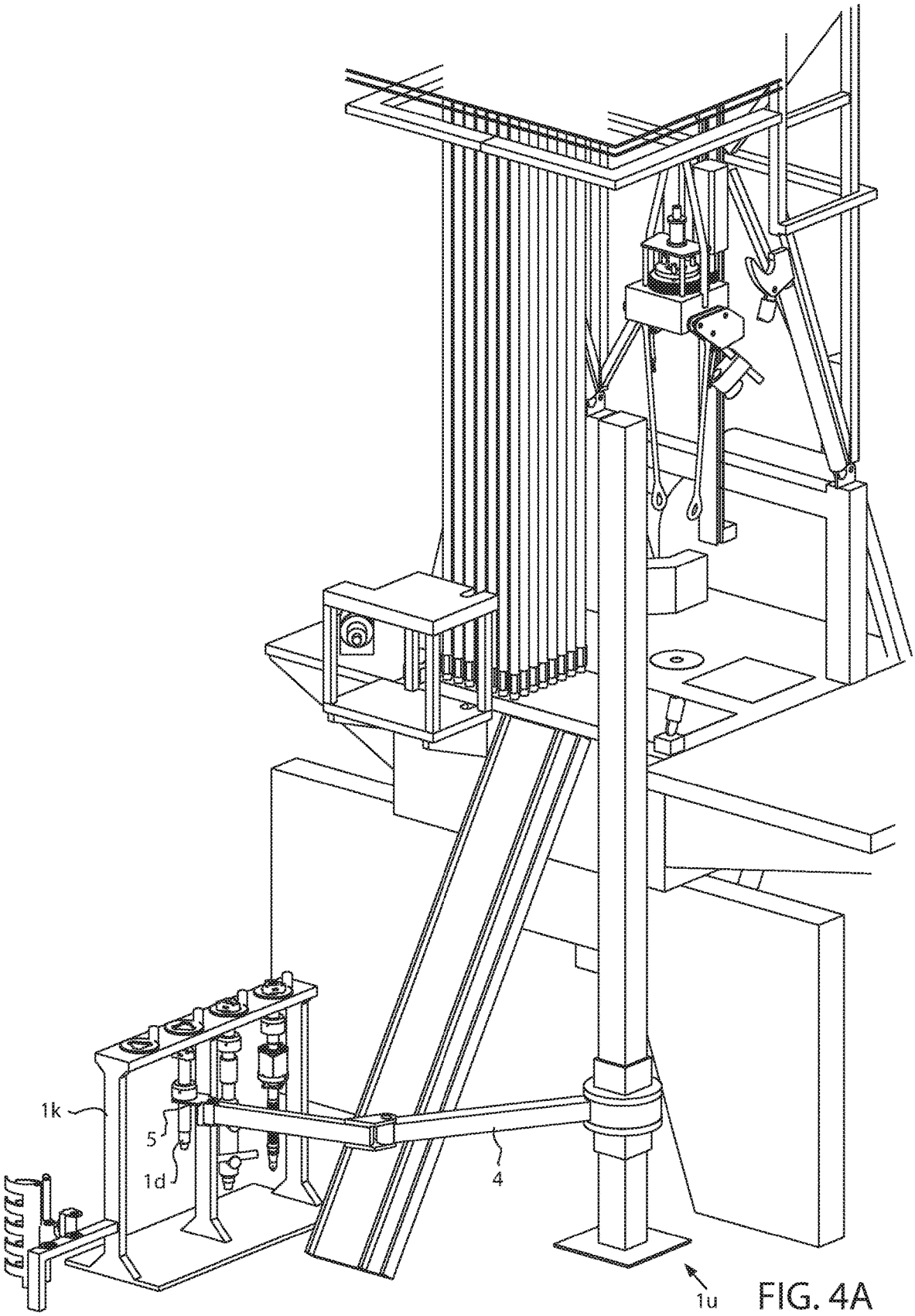
FIGS. 4A-4M illustrate shifting of the modular top drive system from a standby mode to the drilling mode.
Figure 4B:
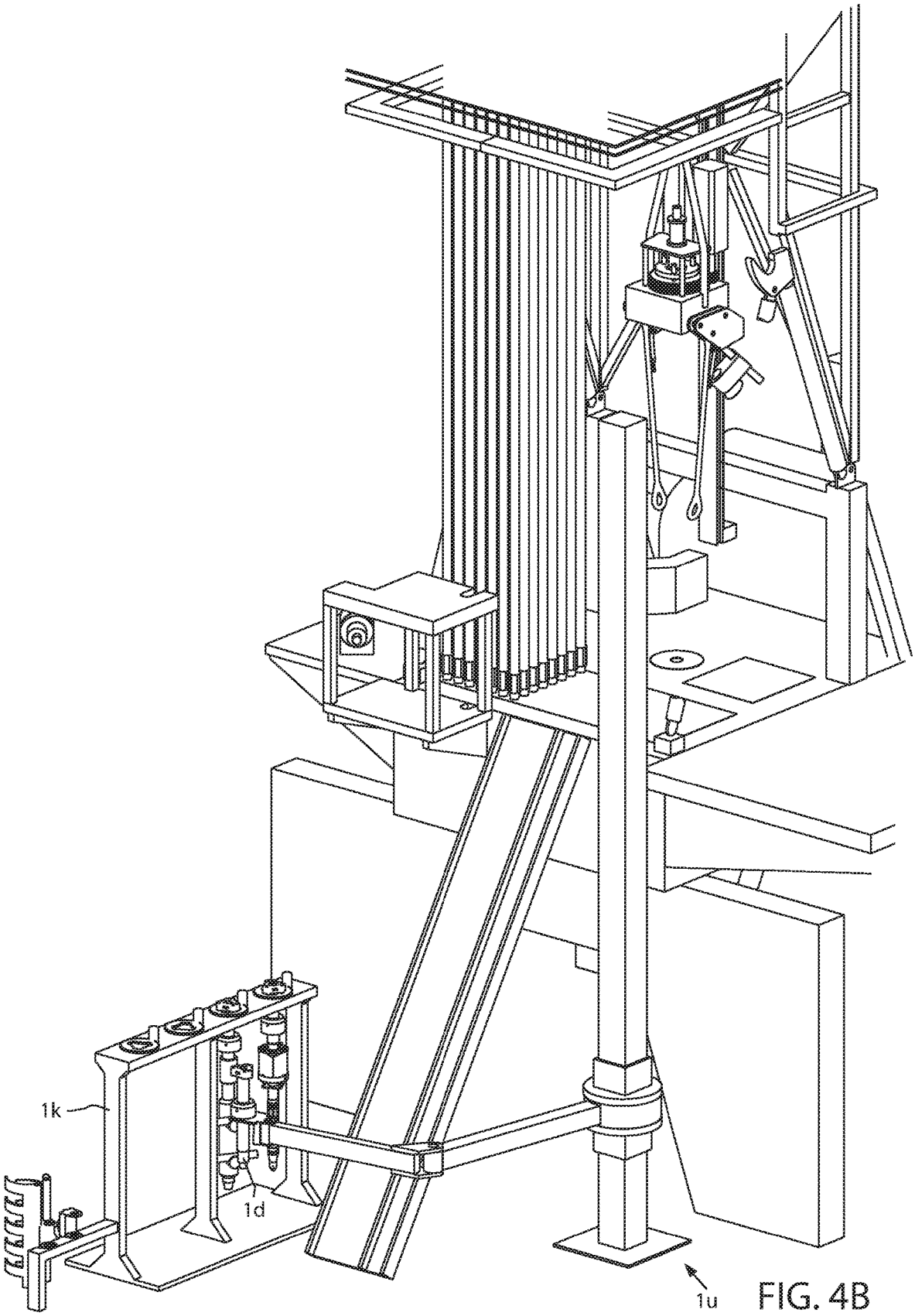
Figure 4C:
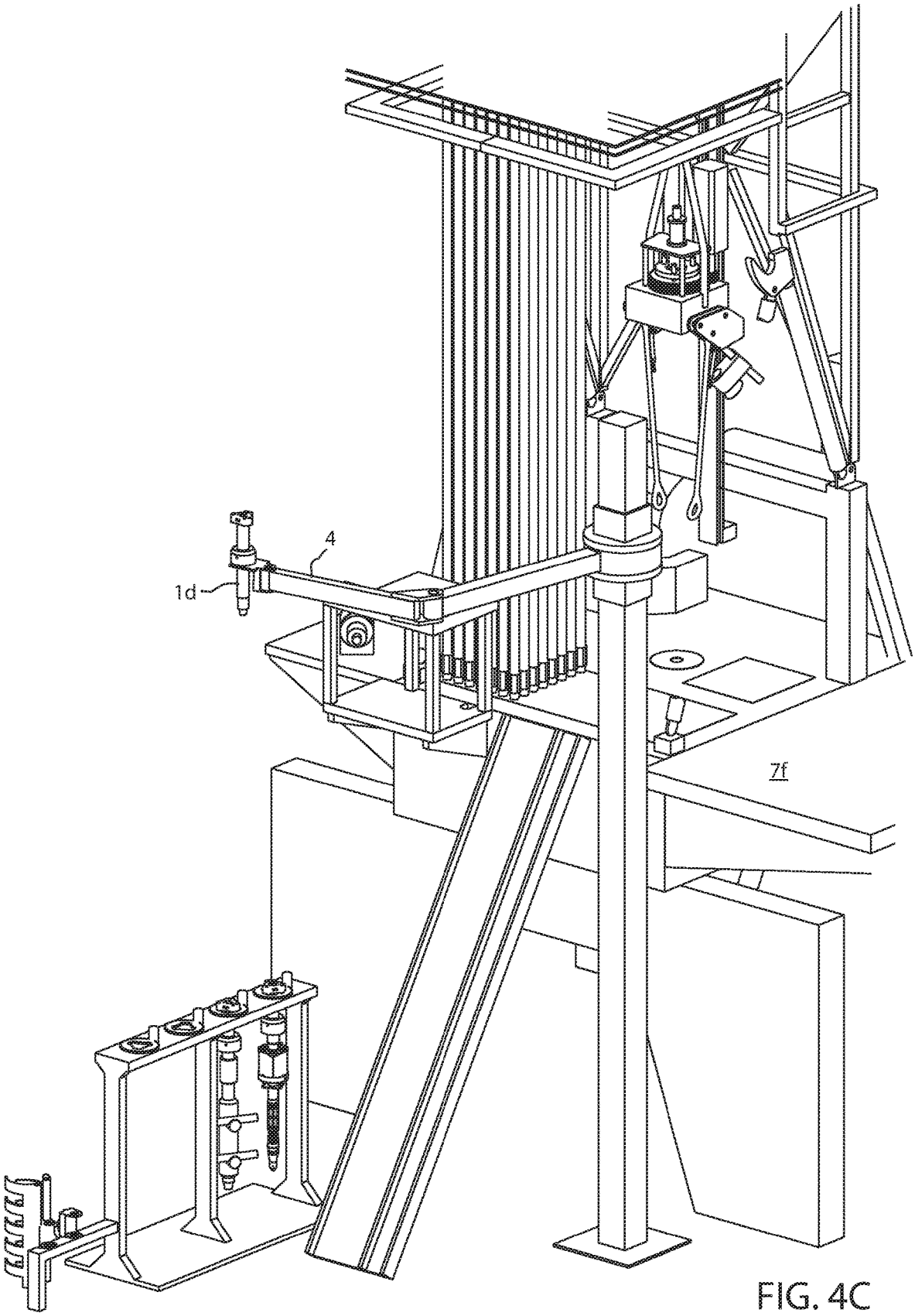
Figure 4D:
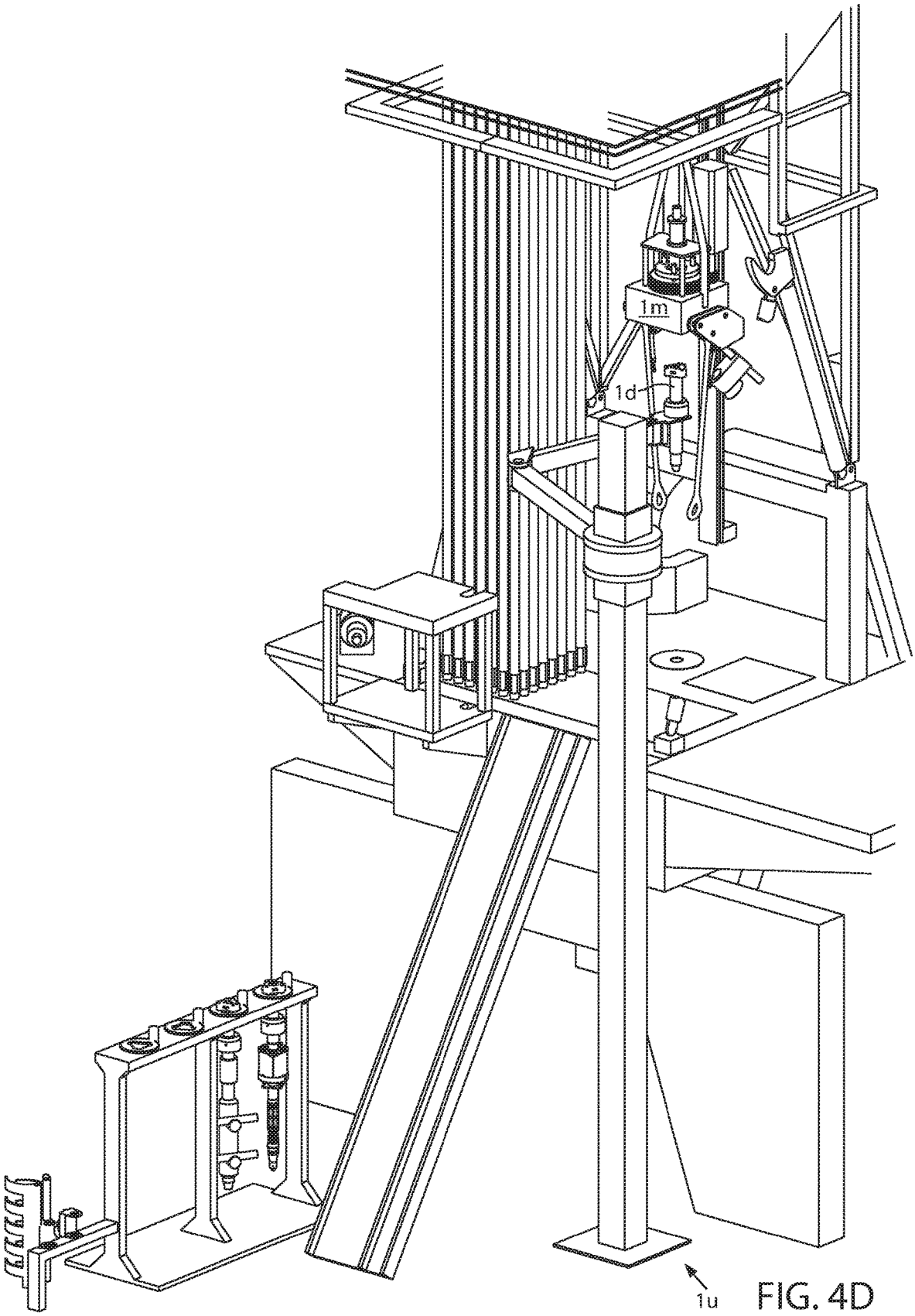
Figure 4E:
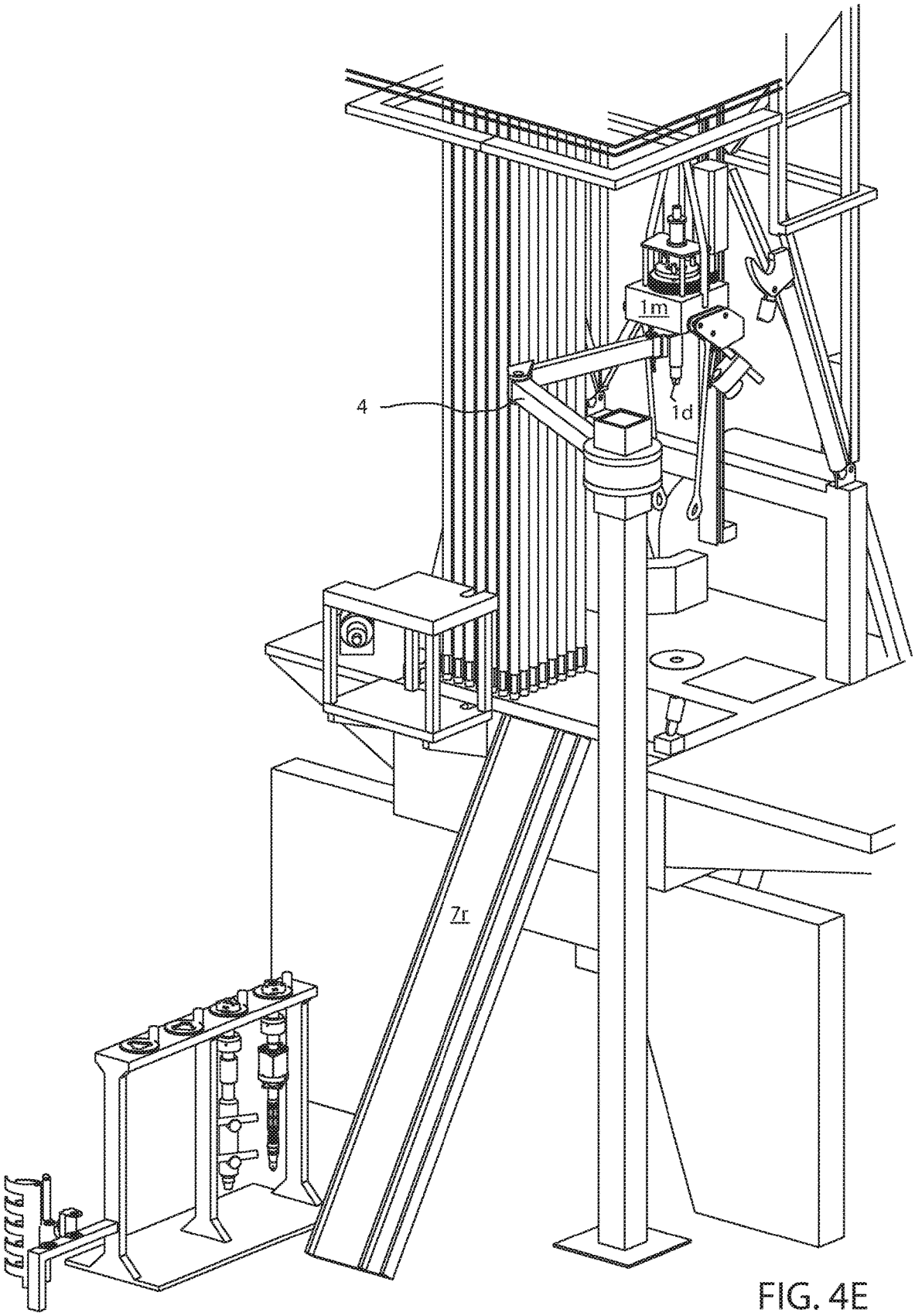
Figure 4F:
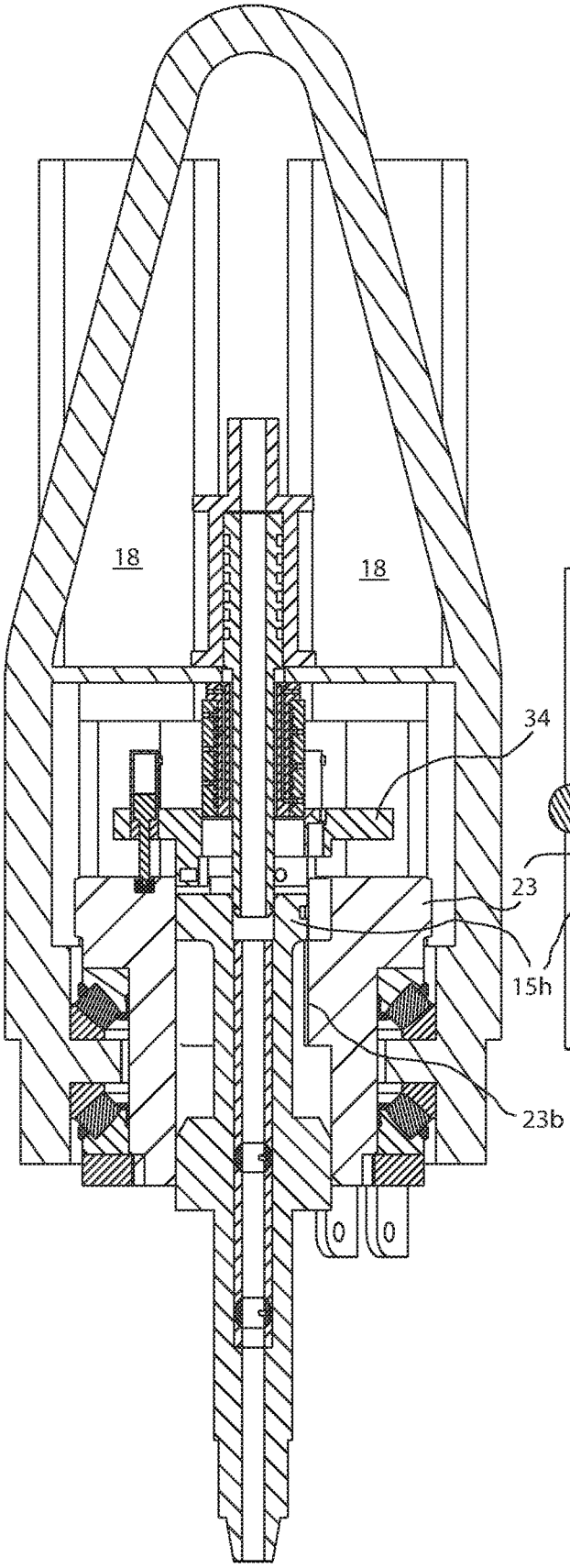
Figure 4G:
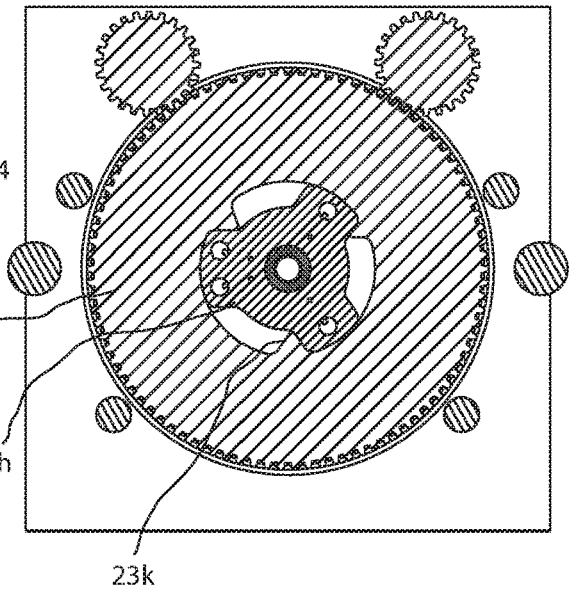
Figure 4H:
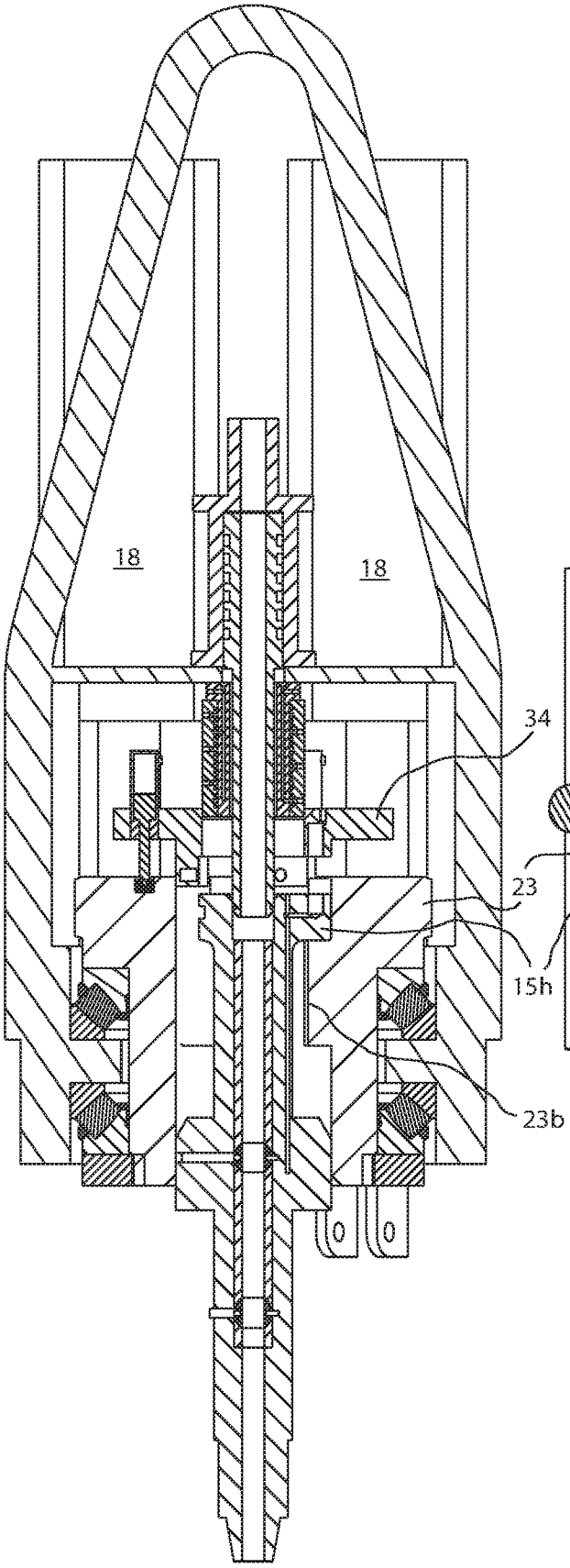
Figure 4I:
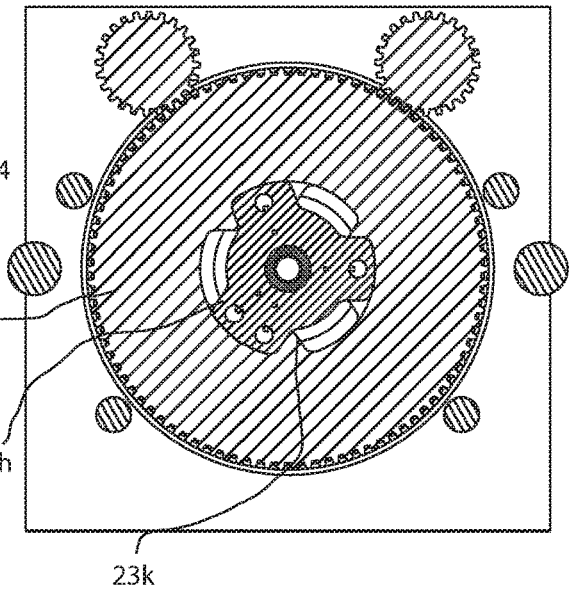
Figure 4J:
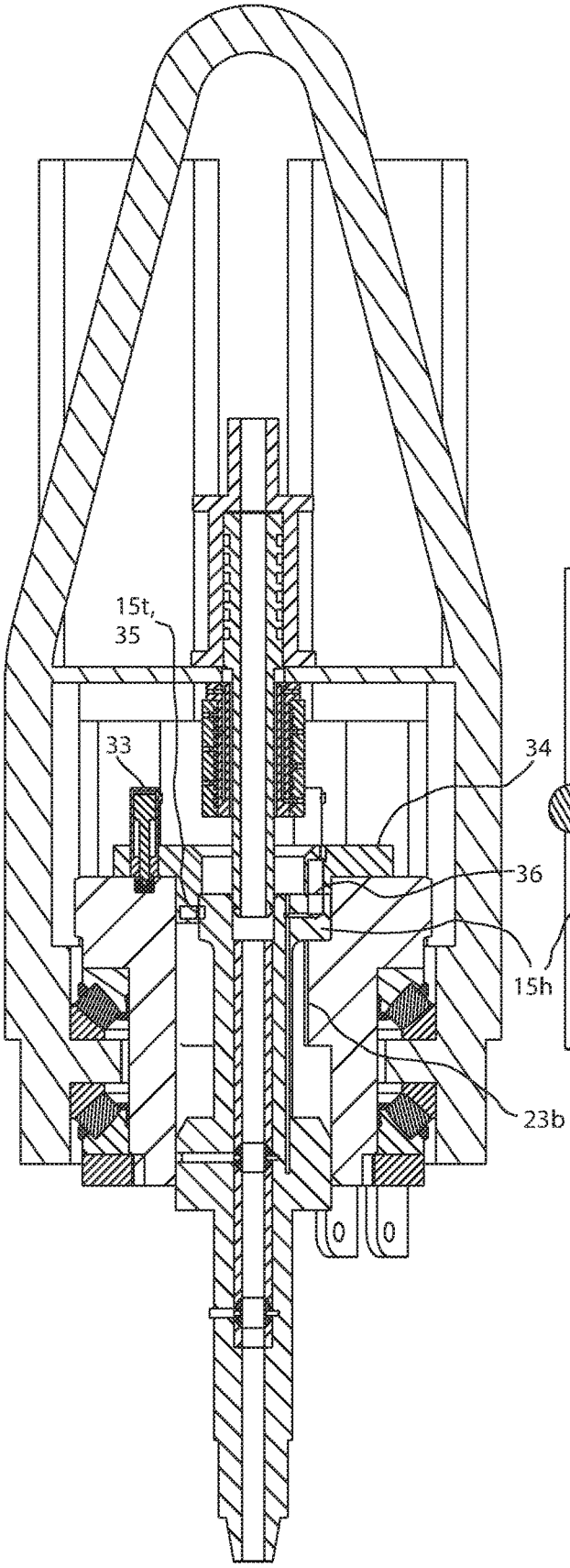
Figure 4K:
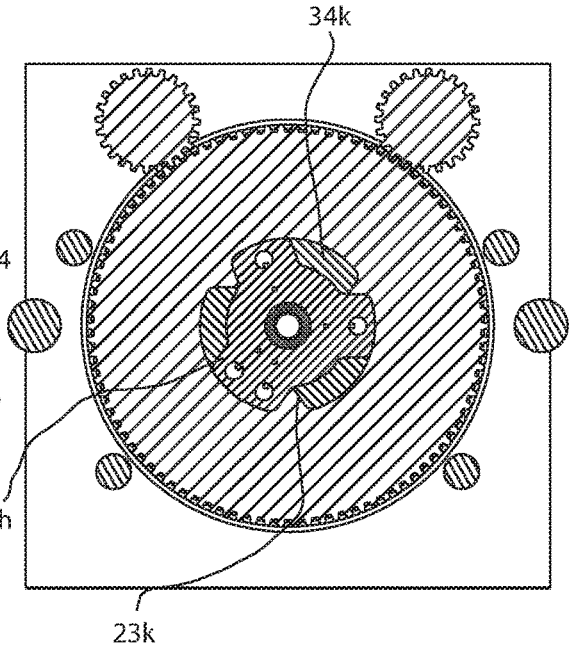
Figure 4L:
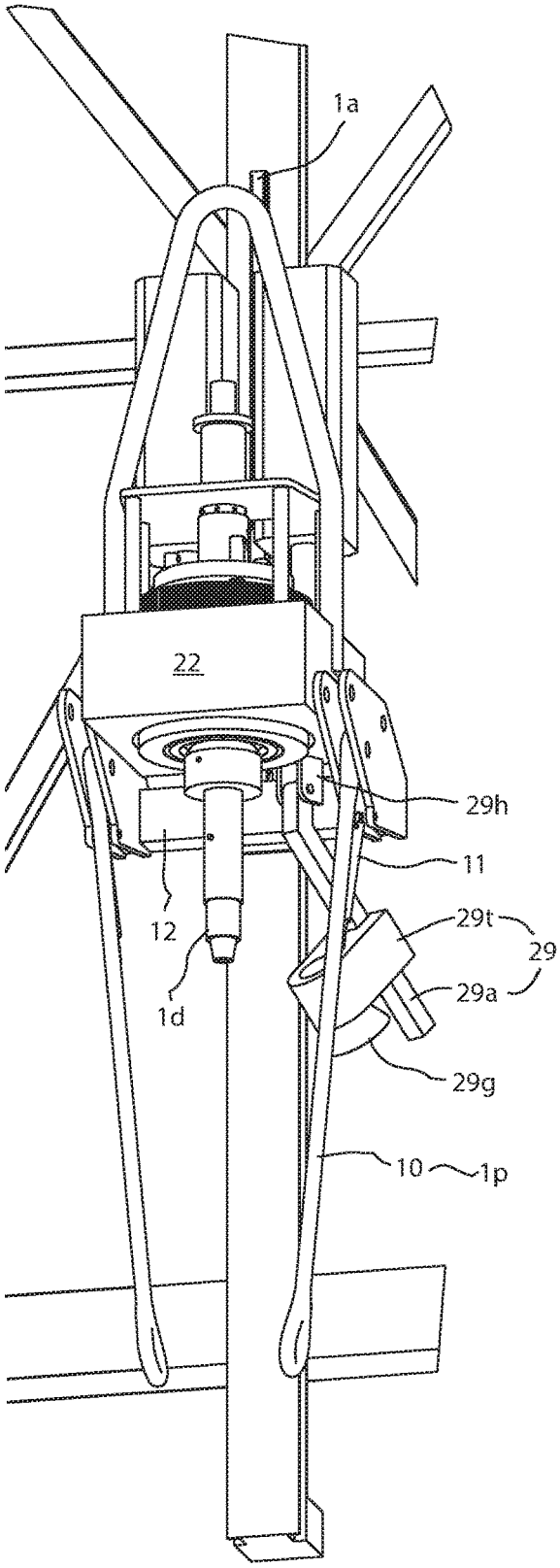

Referring to FIG. 4L, the pipe handler 1*p* may include a drill pipe elevator 9*d* (FIG. 5A) or casing elevator 9*c* (FIG. 6C) and adapters (not shown), a pair of bails 10, a link tilt 11, and a slide hinge 12. The slide hinge 12 may be transversely connected to the rail 1*r* such as by a slide joint, while being free to move longitudinally along the rail. Each bail 10 may have an eyelet formed at each longitudinal end thereof. An upper eyelet of each bail 10 may be received by a respective pair of knuckles of the slide hinge 12 and pivotally connected thereto, such as by fastening. In the drilling mode, the adapters may be removed from the lower eyelets and a lower eyelet of each bail 10 may be received by a respective ear of the drill pipe elevator 9*d* and pivotally connected thereto, such as by fastening. Alternatively, an adaptor connected to the bail 10 may be used to supply a connection position for the casing elevator 9*c*. Width adjustment may be provided by sideway tilting of the bails 10.

In the casing mode, each adapter may be inserted into the respective lower eyelet and connected to the respective bail 10. Each adapter may include a base, an upper collar, a lower collar, and a linkage. The upper collar may include a pair of bands disposed around a portion of the respective bail 10 adjacent to the lower eyelet. The bands may be connected together and one of the bands may be connected to the base, such as by fastening. The lower collar may extend around a bottom of the respective lower eyelet and be connected to the base, such as by fastening. The base may be disposed through the respective eyelet and have a shape conforming to the interior thereof. The linkage may include a pair of triangular arms pivotally connected to an upper portion of the base, such as by fastening. The linkage may further include a straight arm pivotally connected to the triangular arms and pivotally connected to the base, such as fastening. The straight arm may have a plurality of holes formed therethrough and the base may have a slot formed therein for receiving the straight arm at various positions to provide adjustability to suit various casing elevators 9*c*. A lower portion of the triangular arms may receive a respective ear of the casing elevator 9*c* and be pivotally connected thereto, such as by fastening.

Figure 3:
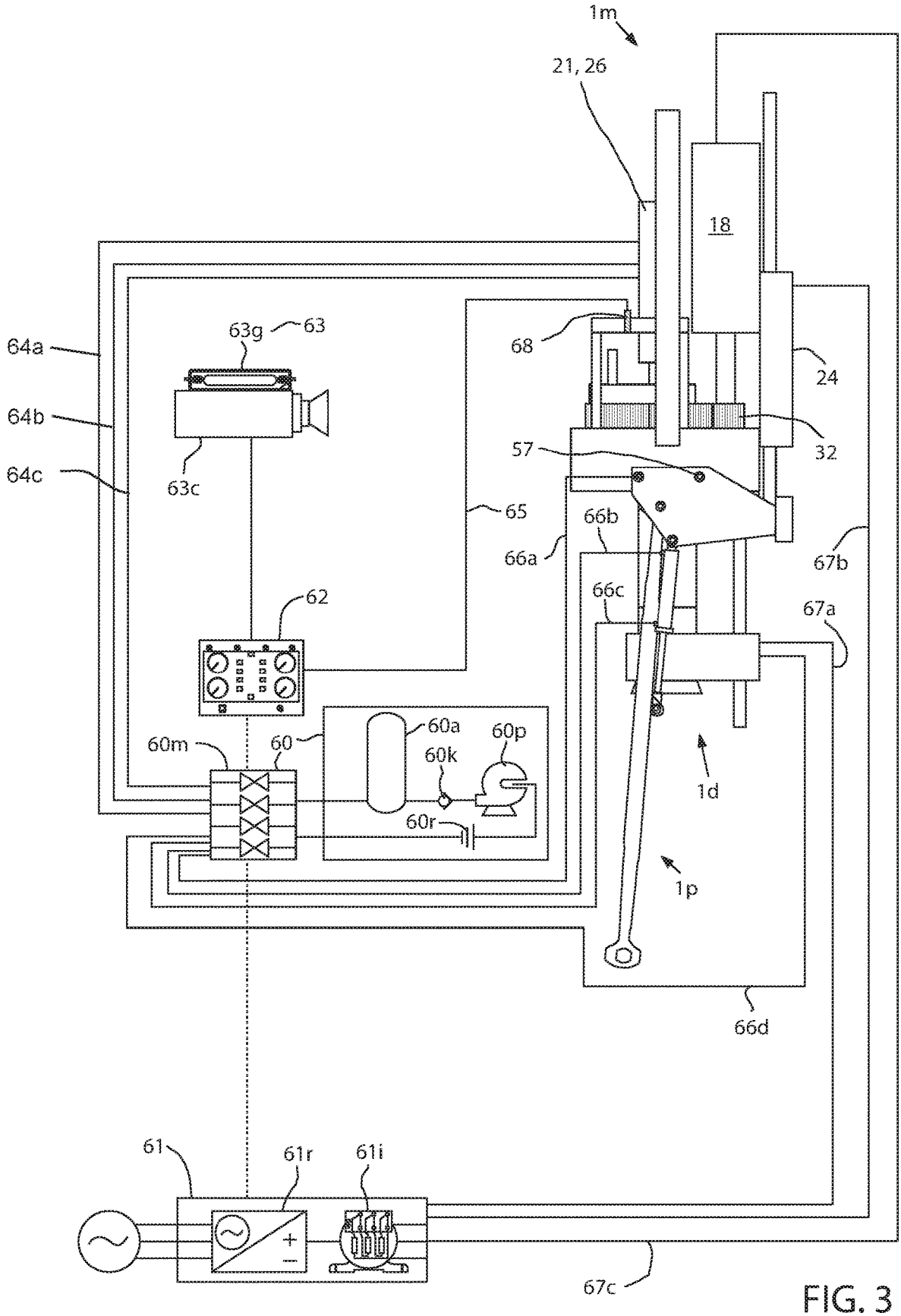
FIG. 3 is a control diagram of the modular top drive system in a drilling mode.

The link tilt 11 may include a pair of piston and cylinder assemblies for swinging either elevator 9*c,d* (FIGS. 6C, 5A) relative to the slide hinge 12. Each piston and cylinder assembly may have a coupling, such as a hinge knuckle, formed at each longitudinal end thereof. An upper hinge knuckle of each piston and cylinder assembly may be received by the respective lifting lug of the slide hinge 12 and pivotally connected thereto, such as by fastening. A lower hinge knuckle of each PCA may be received by a complementary hinge knuckle of the respective bail 10 and pivotally connected thereto, such as by fastening. A piston of each piston and cylinder assembly may be disposed in a bore of the respective cylinder. The piston may divide the cylinder bore into a raising chamber and a lowering chamber and the cylinder may have ports formed through a wall thereof and each port may be in fluid communication with a respective chamber. Each port may be in fluid communication with the HPU manifold 60*m* via a respective control line 66*b,c* (FIG. 3). Supply of hydraulic fluid to the raising port may lift either elevator 9*c,d* (FIGS. 6C and 5A) by increasing a tilt angle (measured from a longitudinal axis of the rail 1*r*). Supply of hydraulic fluid to the lowering port may drop either elevator 9*c,d* (FIGS. 6D and 5C) by decreasing the tilt angle.

The drill pipe elevator 9*d* may be manually opened and closed or the pipe handler 1*p* may include an actuator (not shown) for opening and closing the elevator. The actuator may be controlled locally or remotely. The drill pipe elevator 9*d* may include a bushing having a profile, such as a bottleneck, complementary to an upset formed in an outer surface of a joint of the drill pipe 8*p* adjacent to the threaded coupling thereof. The bushing may receive the drill pipe 8*p* for hoisting one or more joints thereof, such as the stand 8*s*. The bushing may allow rotation of the stand 8*s* relative to the pipe handler 1*p*. The pipe handler 1*p* may deliver the stand 8*s* to a drill string 8 (FIG. 5A) where the stand 8*s* may be assembled therewith to extend the drill string during a drilling operation. When connected to the motor unit 1*m*, the pipe handler 1*p* may be capable of supporting the weight of the drill string 8 (as opposed to a single joint elevator which is only capable of supporting the weight of the stand 8*s*) to expedite tripping of the drill string.

The casing elevator 9*c* may be similar to the drill pipe elevator 9*d* except for being sized to handle a joint 90*j* (FIG. 6B) of casing. The pipe handler 1*p* may be used to assemble the casing joint 90*j* with a casing string 90 (FIG. 6C) in a similar fashion as with the drill string 8, discussed above, with a few exceptions.

Alternatively, a remote controlled drilling elevator of the rig 7 may be used instead of the pipe handler 1*p* to assemble or disassemble the drill string 8 and/or a remote controlled single joint elevator of the rig may be used assemble or disassemble the casing string 90 instead of the pipe handler. Alternatively, the slide hinge 12 and linear actuator 1*a* may be omitted and the link tilt 11 and bails 10 may instead be pivotally connected to the motor unit 1*m*.

Alternatively, the drill pipe elevator 9*d* may have a gripper, such as slips and a cone, capable of engaging an outer surface of the drill pipe 8*p* at any location therealong. Alternatively, the casing elevator 9*c* may have a gripper, such as slips and a cone, capable of engaging an outer surface of the casing joint 90*j* at any location therealong.

The linear actuator 1*a* may include a gear rack, one or two pinions (not shown), and one or two pinion motors (not shown). The linear actuator 1*a* may include more than two pinions and pinion motors. The gear rack may be a bar having a geared upper portion and a plain lower portion. The gear rack may have a knuckle formed at a bottom thereof for pivotal connection with a lifting lug of the slide hinge 12, such as by fastening. Each pinion may be meshed with the geared upper portion and torsionally connected to a rotor of the respective pinion motor. A stator of each pinion motor may be connected to the motor unit 1*m* and be in electrical communication with a motor driver 61 via a cable 67*b* (both shown in FIG. 3). The pinion motors may share a cable via a splice (not shown). Each pinion motor may be reversible and rotation of the respective pinion in a first direction, such as counterclockwise, may raise the slide hinge 12 relative to the motor unit 1*m* and rotation of the respective pinion in a second opposite direction, such as clockwise, may lower the slide hinge relative to the motor unit. Each pinion motor may include a brake (not shown) for locking position of the slide hinge once the pinion motors are shut off. The brake may be disengaged by supply of electricity to the pinion motors and engaged by shut off of electricity to the pinion motors.

The linear actuator 1*a* may be capable of hoisting the stand 8*s* and the casing joint 90*j*. A stroke of the linear actuator 1*a* may be sufficient to stab a top coupling of the stand 8*s* into a quill 37 of the motor unit 1*m* and sufficient to stab an upper portion of the casing joint 90*j* into a spear 40 of the casing unit 1*c*.

Alternatively, the pinion motors and brake may be hydraulic or pneumatic instead of electric. Alternatively, the linear actuator 1*a* may include a braking system separate from the pinion motor and having a separate control line for operation thereof, such as a sliding brake or as a transverse gear rack stub extendable into engagement with the gear rack. Alternatively, the linear actuator 1*a* may include a gear box torsionally connecting each pinion motor to the respective pinion.

Figure 1B:
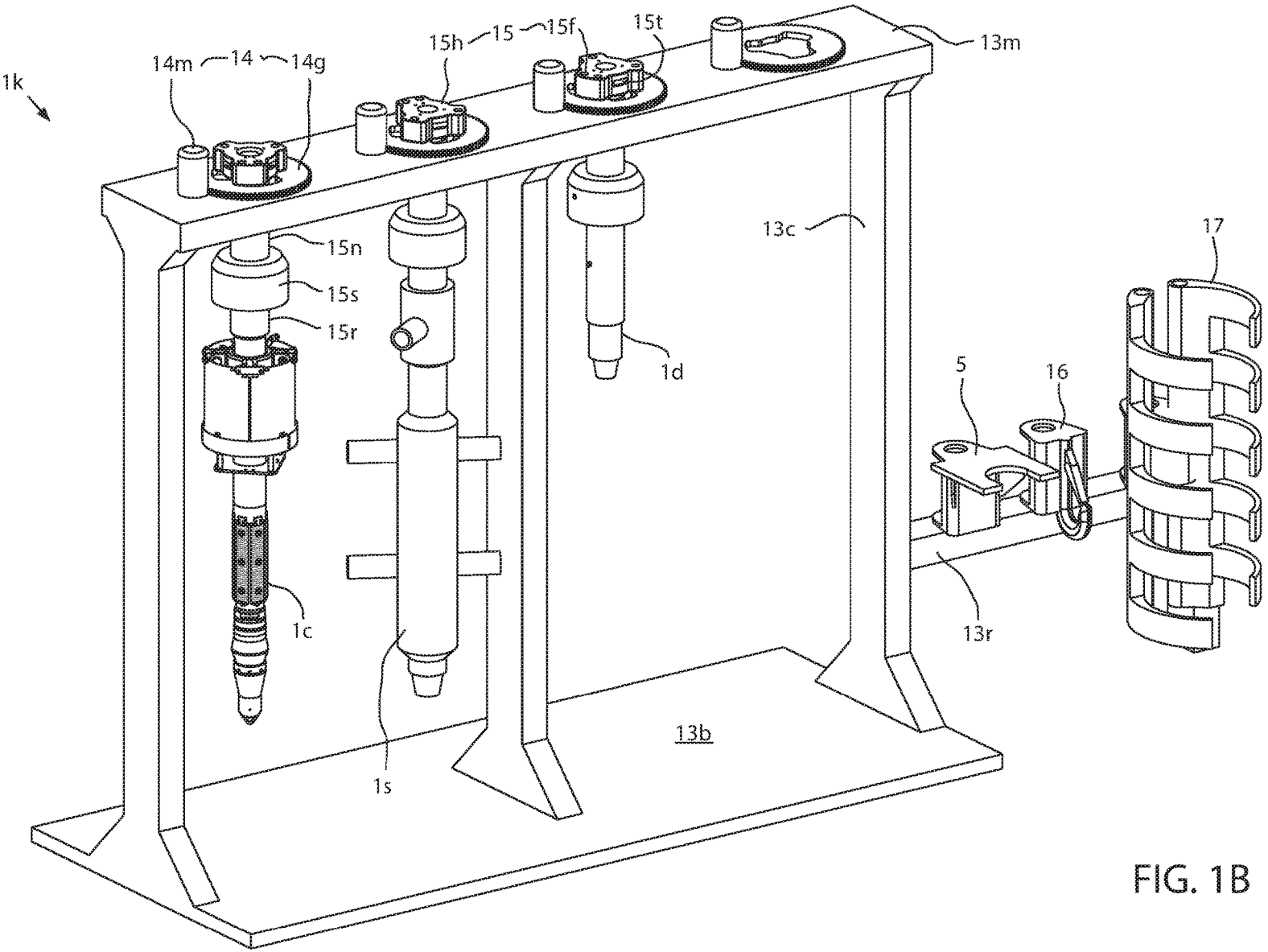
FIG. 1B illustrates a unit rack of the modular top drive.

FIG. 1B illustrates the unit rack 1*k*. The unit rack 1*k* may include a base 13*b*, a beam 13*m*, two or more (three shown) columns 13*c* connecting the base to the beam, such as by welding or fastening, and a parking spot 14 for each of the units 1*c,d,s* (four spots shown). Alternative, the unit rack 1*k* may include on or more columns 13*c*. A length of the columns 13*c* may correspond to a length of the longest one of the units 1*c,d,s*, such as being slightly greater than the longest length. The columns 13*c* may be spaced apart to form parking spots (four shown) between adjacent columns. The units 1*c,d,s* may be hung from the beam by engagement of the parking spots 14 with respective couplings 15 of the units. Each parking spot 14 may include an opening formed through the beam 13*m*, a ring gear 14*g*, and a motor 14*m*. Each ring gear 14*g* may be supported from and transversely connected to the beam 13*b* by a bearing (not shown) such that the ring gear 14*g* may rotate relative to the beam 13*b*.

Each bearing may be capable supporting the weight of any of the units 1*c,d,s* and placement of a particular unit in a particular parking spot 14 may be arbitrary. In one embodiment, each parking spot 14 of the unit rack 1*k* may include a latch profile that is the same as a latch profile 23*b* in the top drive unit 1*m*. In one embodiment, the unit rack 1*k* may include an integrated tool handler. The integrated tool handler may be used to deliver a tool to and/or receive a tool from the unit handler 1*u*.

Each motor 14*m* may include a stator connected to the beam 13*m* and may be in electrical communication with a motor driver 61 (FIG. 3) via a cable (not shown). A rotor of each motor 14*m* may be meshed with the respective ring gear 14*g* for rotation thereof between a disengaged position (FIG. 4A) and an engaged position. Each ring gear 14*g* may have an internal latch profile, such as a bayonet profile, and each coupling may 15 may include a head 15*h* having an external latch profile, such as a bayonet profile. The bayonet profiles may each have one or more (three shown) prongs and prong-ways spaced around the respective ring gears 14*g* and heads 15*h* at regular intervals. When the prongs of the respective bayonet profiles are aligned, the external prongs of the heads 15*h* may be engaged with the internal prongs of the respective ring gears 14*g*, thereby supporting the units 1*c,d,s* from the beam 13*m*. When the external prongs of the heads 15*h* are aligned with the internal prong-ways of the ring gears 14*g* (and vice versa), the heads may be free to pass through the respective ring gears.

Alternatively, the ring gear motors may be pneumatic or hydraulic instead of electric.

Each coupling 15 may further include a neck 15*n* extending from the head 15*h* and having a reduced diameter relative to a maximum outer diameter of the head for extending through the respective beam opening and respective ring gear 14*g*. Each coupling 15 may further include a lifting shoulder 15*s* connected to a lower end of the neck 15*n* and having an enlarged diameter relative to the reduced diameter of the neck and a torso 15*r* extending from the lifting shoulder 15*s* and having a reduced diameter relative to the enlarged diameter of the lifting shoulder. The torso 15*r* may have a length corresponding to a length of the holder 5 for receipt thereof and a bottom of the lifting shoulder 15*s* may seat on a top of the holder for transport from the unit rack 1*k* to the motor unit 1*m*.

The unit rack 1*k* may further include a side bar 13*r* for holding one or more accessories for connection to the forearm instead of the holder 5, such as a cargo hook 16 and a pipe clamp 17. The side bar 13*r* may also hold the holder 5 when the unit handler 1*u* is equipped with one of the accessories.

Advantageously, the unit rack 1*k* may be used to load or unload any of the units 1*c,d,s* from either side thereof. The units 1*c,d,s* may be initially loaded onto the rack 1*k*, such as by a forklift (not shown).

Alternatively, the accessories may be stowed in a separate rack. Alternatively, the unit handler 1*u*, side bar 13*r*, and/or separate accessory rack may include an automated quick connect system for connecting any of the holder 5, cargo hook 16, and pipe clamp 17 to the arm 4 and for releasing any of the members therefrom and the quick connect system may be remotely operated by a technician to switch the members.

Figure 2A:
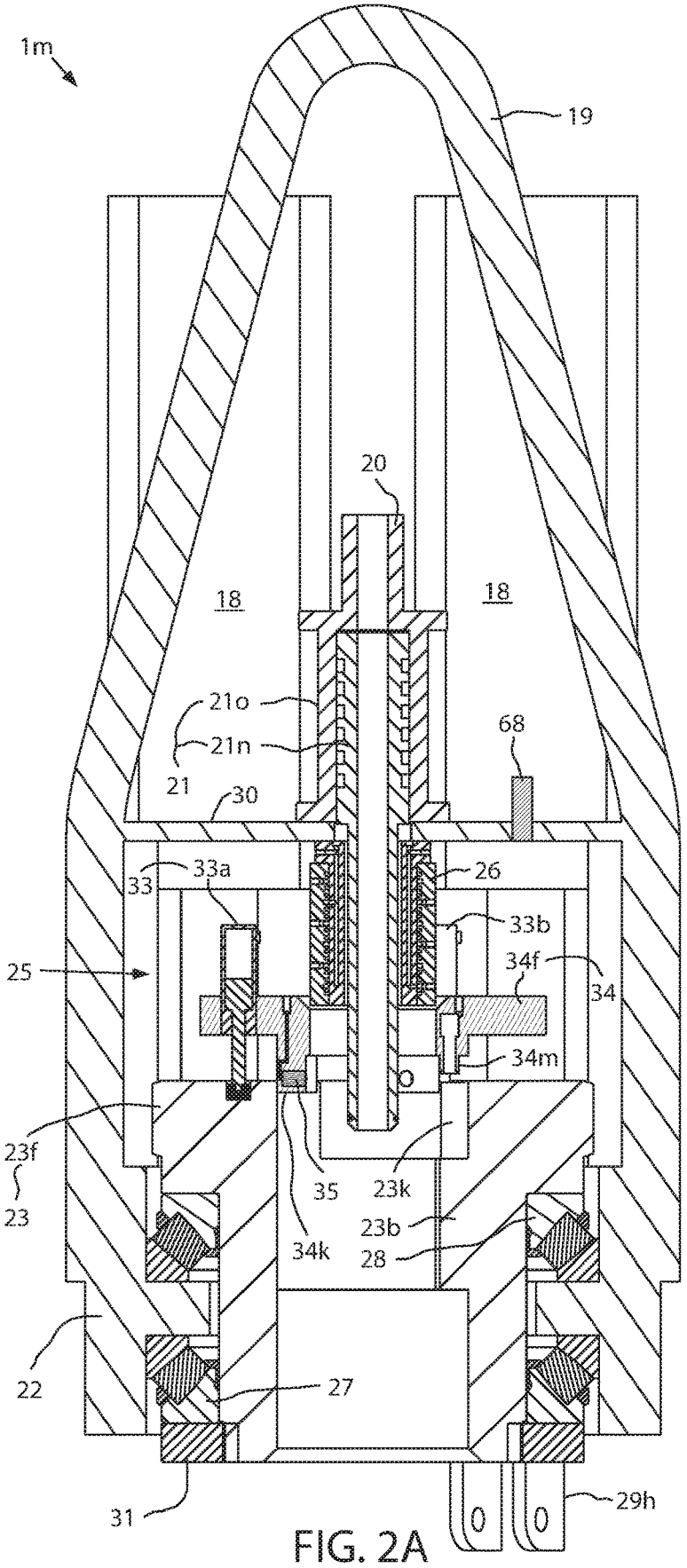
FIG. 2A illustrates a motor unit of the modular top drive system.

FIG. 2A illustrates the motor unit 1*m*. The motor unit 1*m* may include one or more (pair shown) drive motors 18, a becket 19, a hose nipple 20, a mud swivel 21, a drive body 22, a drive ring, such as gear 23, a trolley 24 (FIG. 3), a thread compensator 25, a control, such as hydraulic, swivel 26, a down thrust bearing 27, an up thrust bearing 28, a backup wrench 29 (FIG. 4L), a swivel frame 30, a bearing retainer 31, a motor gear 32 (FIG. 3), and a latch 57 (FIG. 3). The drive body 22 may be rectangular, may have thrust chambers formed therein, may have an inner rib dividing the thrust chambers, and may have a central opening formed therethrough and in communication with the chambers. The drive gear 23 may be cylindrical, may have a bore therethrough, may have an outer flange 23*f* formed in an upper end thereof, may have an outer thread formed at a lower end thereof, may have an inner locking profile 23*k* formed at an upper end thereof, and may have an inner latch profile, such as a bayonet profile 23*b*, formed adjacently below the locking profile. The inner bayonet profile 23*b* may be similar to the inner bayonet profile of the ring gears 14*g* except for having a substantially greater thickness for sustaining weight of either the casing string 90 or drill string 8. The bearing retainer 31 may have an inner thread engaged with the outer thread of the drive gear 23, thereby connecting the two members.

The drive motors 18 may be electric (shown) or hydraulic (not shown) and have a rotor and a stator. A stator of each drive motor 18 may be connected to the trolley 24, such as by fastening, and be in electrical communication with the motor driver 61 via a cable 67*c* (FIG. 3). The motors 18 may be operable to rotate the rotor relative to the stator which may also torsionally drive respective motor gears 32. The motor gears 32 may be connected to the respective rotors and meshed with the drive gear 23 for torsional driving thereof.

Alternatively, the motor unit 1*m* may instead be a direct drive unit having the drive motor 18 centrally located. Alternatively, the hydraulic swivel 26 may be pneumatic, electric, or the combinations thereof.

Each thrust bearing 27, 28 may include a shaft washer, a housing washer, a cage, and a plurality of rollers extending through respective openings formed in the cage. The shaft washer of the down thrust bearing 27 may be connected to the drive gear 23 adjacent to a bottom of the flange thereof. The housing washer of the down thrust bearing 27 may be connected to the drive body 22 adjacent to a top of the rib thereof. The cage and rollers of the down thrust bearing 27 may be trapped between the washers thereof, thereby supporting rotation of the drive gear 23 relative to the drive body 22. The down thrust bearing 27 may be capable of sustaining weight of either the drill string 8 or the casing string 90 during rotation thereof. The shaft washer of the up thrust bearing 28 may be connected to the drive gear 23 adjacent to the bearing retainer 31. The housing washer of the up thrust bearing 28 may be connected to the drive body 22 adjacent to a bottom of the rib thereof. The cage and rollers of the up thrust bearing 28 may be trapped between the washers thereof. The up thrust bearing 28 functions to preload the connection thus avoiding chattering along the vertical direction. The up thrust bearing 28 also transfers a downward load from the motor unit 1*m* to the work string.

The trolley 24 may be connected to a back of the drive body 22, such as by fastening. The trolley 24 may be transversely connected to the rail 1*r* and may ride along the rail, thereby torsionally restraining the drive body 22 while allowing vertical movement of the motor unit 1*m* with a travelling block 73*t* (FIG. 5A) of a rig hoist 73. The becket 19 may be connected to the drive body 22, such as by fastening, and the becket may receive a hook of the traveling block 73*t* to suspend the motor unit 1*m* from the derrick 7*d*.

The hose nipple 20 may be connected to the mud swivel 21 and receive an end of a mud hose (not shown). The mud hose may deliver drilling fluid 87 (FIG. 5A) from a standpipe 79 (FIG. 5A) to the hose nipple 20. The mud swivel 21 may have an outer non-rotating barrel 21*o* connected to the hose nipple 20 and an inner rotating barrel 21*n*. The mud swivel 21 may have a bearing (not shown) and a dynamic seal (not shown) for accommodating rotation of the rotating barrel relative to the non-rotating barrel. The outer non-rotating barrel 21*o* may be connected to a top of the swivel frame 30, such as by fastening. The swivel frame 30 may be connected to a top of the drive body 22, such as by fastening. The inner rotating barrel 21*n* may have an upper portion disposed in the outer non-rotating barrel 21*o* and a stinger portion extending therefrom, through the hydraulic swivel 26, and through the compensator 25. A lower end of the stinger portion may carry a stab seal for engagement with an inner seal receptacle 15*b* of each coupling 15 when the respective unit 1*c,d,s* is connected to the motor unit 1*m*, thereby sealing an interface formed between the units.

The hydraulic swivel 26 may include a non-rotating inner barrel and a rotating outer barrel. The inner barrel may be connected to the swivel frame 30 and the outer barrel may be supported from the inner barrel by one or more bearings. The outer barrel may have hydraulic ports (six shown) formed through a wall thereof, each port in fluid communication with a respective hydraulic passage formed through the inner barrel (only two passages shown). An interface between each port and passage may be straddled by dynamic seals for isolation thereof. The inner barrel passages may be in fluid communication with the HPU manifold 60*m* via the control lines 64*a-c* (FIG. 3) and the outer barrel ports may be in fluid communication with either the linear actuator 33 or lock ring 34 via jumpers (not shown). The outer barrel ports may be disposed along the outer barrel. The inner barrel may have a mandrel portion extending along the outer barrel and a head portion extending above the outer barrel. The head portion may connect to the swivel frame 30 and have the hydraulic ports extending therearound.

The compensator 25 may include a linear actuator 33, the lock ring 34, and one or more (such as three, but only one shown) lock pins 35. The lock ring 34 may have an outer flange 34*f* formed at an upper end thereof, a bore formed therethrough, one or more chambers housing the lock pins 35 formed in an inner surface thereof, a locking profile 34*k* formed in a lower end thereof, members, such as males 34*m*, of a control, such as hydraulic, junction 36 (FIG. 4J) formed in the lower end thereof, and cables or passages, such as hydraulic passages (two shown) formed through a wall thereof. The locking profile 34*k* may include a lug for each prong-way of the external bayonet profiles of the heads 15*h*.

Each lock pin 35 may be a piston dividing the respective chamber into an extension portion and a retraction portion and the lock ring 34 may have passages formed through the wall thereof for the chamber portions. Each passage may be in fluid communication with the HPU manifold 60*m* via a respective control line 64*a* (FIG. 3, only one shown). The lock pins 35 may share an extension control line and a retraction control line via a splitter (not shown). Supply of hydraulic fluid to the extension passages may move the lock pins 35 to an engaged position (FIG. 4J) where the pins extend into respective slots 15*t* formed in the prong-ways of the heads 15*h*, thereby longitudinally connecting the lock ring 34 to a respective unit 1*c,d,s*. Supply of hydraulic fluid to the retraction passages may move the lock pins 35 to a release position (shown) where the pins are contained in the respective chambers of the lock ring 34. Alternatively, one or more lock members of other form may be used in place of the lock pins 35. For example, a ratchet may be used in place of the lock pins 35 to secure the lock ring 23 and a coupling on a unit 1*c,d,s*.

The linear actuator 33 may include one or more, such as three, piston and cylinder assemblies 33*a,b* for vertically moving the lock ring 34 relative to the drive gear 23 between a lower hoisting position (FIG. 4J) and an upper ready position (shown). A bottom of the lock ring flange 34*f* may be seated against a top of the drive gear flange 23*f* in the hoisting position such that string weight carried by either the drilling module 1*d* or the casing module 1*c* may be transferred to the drive gear 23 via the flanges and not the linear actuator 33 which may be only capable of supporting stand weight or joint weight. String weight may be one hundred (or more) times that of stand weight or joint weight. A piston of each assembly 33*a,b* may be seated against the respective cylinder in the ready position.

Each cylinder of the linear actuator 33 may be disposed in a respective peripheral socket formed through the lock ring flange 34*f* and be connected to the lock ring 34, such as by threaded couplings. Each piston of the linear actuator 33 may extend into a respective indentation formed in a top of the drive gear flange 23*f* and be connected to the drive gear 23, such as by threaded couplings. Each socket of the lock ring flange 34*f* may be aligned with the respective lug of the locking profile 34*k* and each indentation of the drive gear flange 23*f* may be aligned with a receptacle of the locking profile 23*k* such that connection of the linear actuator 33 to the lock ring 34 and drive gear 23 ensures alignment of the locking profiles.

Each piston of the linear actuator 33 may be disposed in a bore of the respective cylinder. The piston may divide the cylinder bore into a raising chamber and a lowering chamber and the cylinder may have ports (only one shown) formed through a wall thereof and each port may be in fluid communication with a respective chamber. Each port may be in fluid communication with the manifold 60*m* via a respective control line 64*b* (only one shown in FIG. 3). Supply of hydraulic fluid to the raising port may lift the lock ring 34 toward the ready position. Supply of hydraulic fluid to the lowering port may drop the lock ring 34 toward the hoisting position. A stroke length of the linear compensator 25 between the ready and hoisting positions may correspond to, such as being equal to or slightly greater than, a makeup length of the drill pipe 8*p* and/or casing joint 90*j*. One advantage of the linear compensator 25 is that the linear compensator 25 is more sensitive than a top drive compensation because the linear compensator 25 only compensates for weight of the stand and tool weight and the mass of the top drive has no impact. Alternatively, the top drive compensation and the connection compensation may be combined. For example, the top drive compensation supplies the stroke while the connection compensation reduces the impacts. Additionally, the connection compensation may send a signal to the top drive compensation when the connection compensation is close to an end position. The top drive compensation may extend or retract after receiving the signal from the connection compensation.

Alternatively, the linear actuator 33 may be electric or pneumatic instead of hydraulic. Alternatively, the junction 36 may be electric or pneumatic instead of hydraulic. Alternatively the lock pin 35 may be activated by electric or pneumatic.

Each coupling 15 may further include mating members, such as females 15*f*, of the junction 36 formed in a top of the prongs of the head 15*h*. The male members 34*m* may each have a nipple for receiving a respective jumper from the hydraulic swivel 26, a stinger, and a passage connecting the nipple and the stinger. Each stinger may carry a respective seal. The female member 15*f* may have a seal receptacle for receiving the respective stinger. The junction members 34*m*, 15*f* may be asymmetrically arranged to ensure that the male member 34*m* is stabbed into the correct female member 15*f*.

Referring to FIG. 4L, the backup wrench 29 may include a hinge 29*h*, a tong 29*t*, a guide 29*g*, an arm 29*a*, a tong actuator (not shown), a tilt actuator (not shown), and a linear actuator (not shown). The tong 29*t* may be transversely connected to the arm 29*a* while being longitudinally movable relative thereto subject to engagement with a stop shoulder thereof. The hinge 29*h* may pivotally connect the arm 29*a* to a bottom of the drive body 22. The hinge 29*h* may include a pair of knuckles fastened or welded to the drive body 22 and a pin extending through the knuckles and a hole formed through a top of the arm 29*a*. The tilt actuator may include a piston and cylinder assembly having an upper end pivotally connected to the bottom of the drive body 22 and a lower end pivotally connected to a back of the arm 29*a*. The piston may divide the cylinder bore into an activation chamber and a stowing chamber and the cylinder may have ports (only one shown) formed through a wall thereof and each port may be in fluid communication with a respective chamber. Each port may be in fluid communication with the HPU manifold 60*m* via a respective control line (not shown). Supply of hydraulic fluid to the activation port may pivot the tong 29*t* about the hinge 29*h* toward the quill 37. Supply of hydraulic fluid to the stowing port may pivot the tong 29*t* about the hinge 29*h* away from the quill 37.

The tong 29*t* may include a housing having an opening formed therethrough and a pair of jaws (not shown) and the tong actuator may move one of the jaws radially toward or away from the other jaw. The guide 29*g* may be a cone connected to a lower end of the tong housing, such as by fastening, for receiving a threaded coupling, such as a box, of the drill pipe 8*p*. The quill 37 may extend into the tong opening for stabbing into the drill pipe box. Once stabbed, the tong actuator may be operated to engage the movable jaw with the drill pipe box, thereby torsionally connecting the drill pipe box to the drive body 22. The tong actuator may be hydraulic and operated by the HPU 60 via a control line 66*d* (FIG. 3).

The backup wrench linear actuator may include a gear rack (not shown) formed along a straight lower portion of the arm 29*a*, one or two pinions (not shown), and one or two pinion motors (not shown). The arm 29*a* may have a deviated upper portion engaged with the hinge 29*h*. Each pinion may be meshed with the gear rack of the arm 29*a* and torsionally connected to a rotor of the respective pinion motor. A stator of each pinion motor may be connected to the housing of the tong 29*t* and be in electrical communication with the motor driver 61 via a cable 67*a* (FIG. 3). The pinion motors may share a cable via a splice (not shown). Each pinion motor may be reversible and rotation of the respective pinion in a first direction, such as counterclockwise, may raise the tong 29*t* along the arm 29*a* and rotation of the respective pinion in a second opposite direction, such as clockwise, may lower the tong along the arm. Each pinion motor may include a brake (not shown) for locking position of the tong 29*t* once the pinion motors are shut off. The brake may be disengaged by supply of electricity to the pinion motors and engaged by shut off of electricity to the pinion motors.

Alternatively, the pinion motors and brake may be hydraulic or pneumatic instead of electric. Alternatively, the linear actuator may include a braking system separate from the pinion motor and having a separate control line for operation thereof, such as a sliding brake or as a transverse gear rack stub extendable into engagement with the gear rack. Alternatively, the linear actuator may include a gear box torsionally connecting each pinion motor to the respective pinion.

Referring to FIG. 3, the latch 57 may include a one or more (pair shown) units disposed at sides of the drive body 22. Each latch unit may include a lug connected, such as by fastening or welding, to the drive body 22 and extending from a bottom thereof, a fastener, such as a pin, and an actuator. Each lug may have a hole formed therethrough and aligned with a respective actuator. Each interior knuckle of the slide hinge 12 may have a hole formed therethrough for receiving the respective latch pin. Each actuator may include a cylinder and piston (not shown) connected to the latch pin and disposed in a bore of the cylinder. Each cylinder may be connected to the drive body 22, such as by fastening, adjacent to the respective lug. The piston may divide the cylinder bore into an extension chamber and a retraction chamber and the cylinder may have ports formed through a wall thereof and each port may be in fluid communication with a respective chamber. Each port may be in fluid communication with the HPU manifold 60*m* via a control line 66*a* (FIG. 3, only one shown). The latch units may share an extension control line and a retraction control line via a splitter (not shown). Supply of hydraulic fluid to the extension port may move the pin to an engaged position (shown) where the pin extends through the respective lug hole and the respective interior knuckle hole of the slide hinge 12, thereby connecting the pipe handler 1*p* to the drive body 22. Supply of hydraulic fluid to the retraction port may move the pin to a release position (not shown) where the pin is clear of the interior slide hinge knuckle.

Figure 2B:
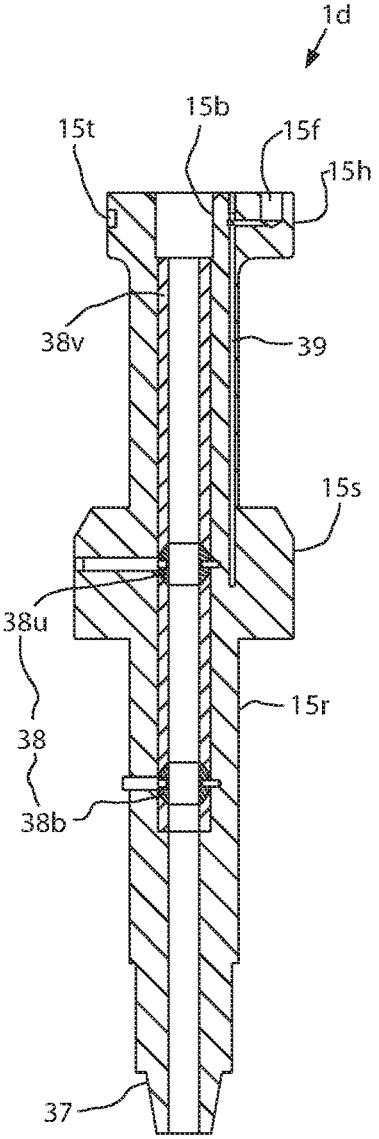
FIG. 2B illustrates a drilling unit of the modular top drive system.

FIG. 2B illustrates a drilling unit 1*d*. The drilling unit 1*d* may further include the quill 37, one or more internal blowout preventers (IBOP) 38, and one or more, such as four (only one shown), hydraulic passages 39. The quill 37 may be a shaft, may have an upper end connected to the torso 15*r*, may have a bore formed therethrough, may have a threaded coupling, such as a pin, formed at a lower end thereof.

The IBOP 38 may include an internal sleeve 38*v* and one or more shutoff valves 38*u,b*. Each shutoff valve 38*u,b* may be actuated. Each shutoff valve 38*u,b* may be connected to the sleeve 38*v* and the sleeve may be received in a recessed portion of the quill 37 and/or coupling 15. The IBOP valve actuators may be disposed in sockets formed through a wall of the quill 37 and/or coupling 15 and may each include an opening port and/or a closing port and each port may be in fluid communication with the HPU manifold 60*m* via a respective hydraulic passage 39, respective male 34*m* and female 15*f* members, respective jumpers, the hydraulic swivel 26, and respective control lines 64*c* (only one shown in FIG. 3).

Alternatively, each IBOP valve 38*u,b* may have an electrical or pneumatic actuator instead of the hydraulic actuator. The IBOP 38 may be located on the motor unit 1*m*, the drilling unit 1*d*, or both.

Figure 2C:
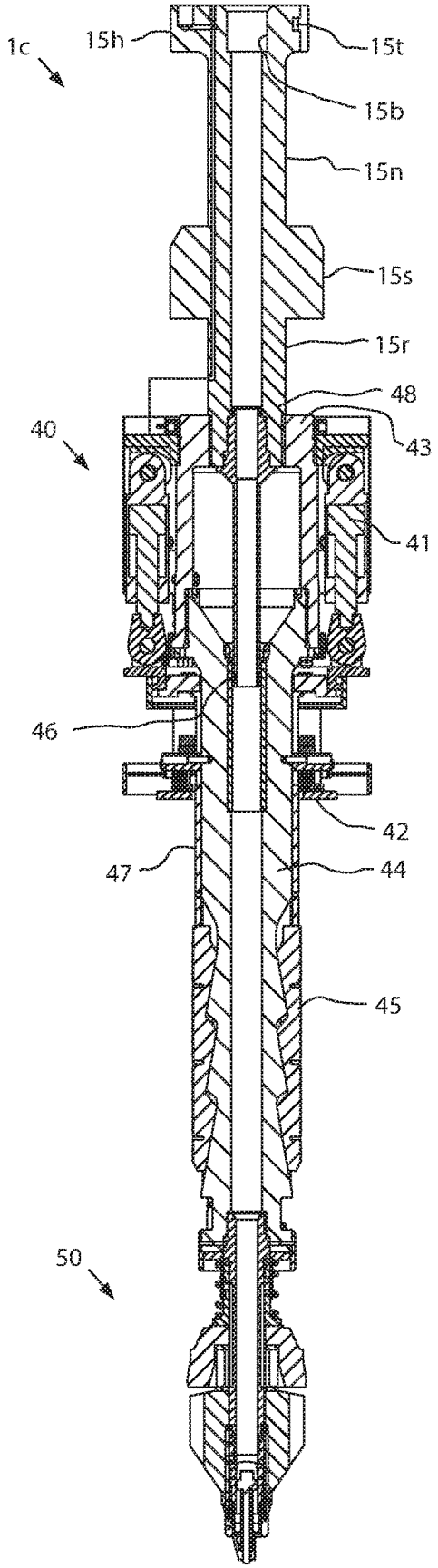
FIG. 2C illustrates a casing unit of the modular top drive system.

FIG. 2C illustrates the casing unit 1*c*. The casing unit 1*c* may further include a clamp, such as a spear 40, an adapter 48, one or more, such as two (only one shown), hydraulic passages 49, and a fill up tool 50. The adapter 48 may have a bore formed therethrough, may have an upper end connected to the torso 15*r*, and may have an outer thread and an inner receptacle formed at a lower end thereof.

The spear 40 may include a linear actuator 41, a bumper 42, a collar 43, a mandrel 44, a set of grippers, such as slips 45, a seal joint 46, and a sleeve 47. The collar 43 may have an inner thread formed at each longitudinal end thereof. The collar upper thread may be engaged with the outer thread of the adapter 48, thereby connecting the two members. The collar lower thread may be engaged with an outer thread formed at an upper end of the mandrel 44 and the mandrel may have an outer flange formed adjacent to the upper thread and engaged with a bottom of the collar 43, thereby connecting the two members.

The seal joint 46 may include the inner barrel, an outer barrel, and a nut. The inner barrel may have an outer thread engaged with a threaded portion of the shaft receptacle and an outer portion carrying a seal engaged with a seal bore portion of the shaft receptacle. The mandrel 44 may have a bore formed therethrough and an inner receptacle formed at an upper portion thereof and in communication with the bore. The mandrel receptacle may have an upper conical portion, a threaded mid portion, and a recessed lower portion. The outer barrel may be disposed in the recessed portion of the mandrel 44 and trapped therein by engagement of an outer thread of the nut with the threaded mid portion of the mandrel receptacle. The outer barrel may have a seal bore formed therethrough and a lower portion of the inner barrel may be disposed therein and carry a stab seal engaged therewith.

The linear actuator 41 may include a housing, an upper flange, a plurality of piston and cylinder assemblies, and a lower flange. The housing may be cylindrical, may enclose the cylinders of the assemblies, and may be connected to the upper flange, such as by fastening. The collar 43 may also have an outer thread formed at the upper end thereof. The upper flange may have an inner thread engaged with the outer collar thread, thereby connecting the two members. Each flange may have a pair of lugs for each piston and cylinder assembly connected, such as by fastening or welding, thereto and extending from opposed surfaces thereof.

Each cylinder of the linear actuator 41 may have a coupling, such as a hinge knuckle, formed at an upper end thereof. The upper hinge knuckle of each cylinder may be received by a respective pair of lugs of the upper flange and pivotally connected thereto, such as by fastening. Each piston of the linear actuator 41 may have a coupling, such as a hinge knuckle, formed at a lower end thereof. Each piston of the linear actuator 41 may be disposed in a bore of the respective cylinder. The piston may divide the cylinder bore into a raising chamber and a lowering chamber and the cylinder may have ports formed through a wall thereof and each port may be in fluid communication with a respective chamber.

Each port may be in fluid communication with the HPU manifold 60*m* via a respective hydraulic passage 49, respective male 34*m* and female 15*f* members, respective jumpers, the hydraulic swivel 26, and respective control lines. Supply of hydraulic fluid to the raising port may lift the lower flange to a retracted position (shown). Supply of hydraulic fluid to the lowering port may drop the lower flange toward an extended position (not shown). The piston and cylinder assemblies may share an extension control line and a retraction control line via a splitter (not shown).

The sleeve 47 may have an outer shoulder formed in an upper end thereof trapped between upper and lower retainers. A washer may have an inner shoulder formed in a lower end thereof engaged with a bottom of the lower retainer. The washer may be connected to the lower flange, such as by fastening, thereby longitudinally connecting the sleeve 47 to the linear actuator 41. The sleeve 47 may also have one or more (pair shown) slots formed through a wall thereof at an upper portion thereof. The bumper 42 may be connected to the mandrel, such as by one or more threaded fasteners, each fastener extending through a hole thereof, through a respective slot of the sleeve 47, and into a respective threaded socket formed in an outer surface of the mandrel 44, thereby also torsionally connecting the sleeve to the mandrel while allowing limited longitudinal movement of the sleeve relative to the mandrel to accommodate operation of the slips 45. A lower portion of the spear 40 may be stabbed into the casing joint 90*j* (FIG. 6E) until the bumper 42 engages a top of the casing joint. The bumper 42 may cushion impact with the top of the casing joint 90*j* to avoid damage thereto.

The sleeve 47 may extend along the outer surface of the mandrel from the lower flange of the linear actuator 41 to the slips 45. A lower end of the sleeve 47 may be connected to upper portions of each of the slips 45, such as by a flanged (i.e., T-flange and T-slot) connection. Each slip 46 may be radially movable between an extended position and a retracted position by longitudinal movement of the sleeve 47 relative to the slips. A slip receptacle may be formed in an outer surface of the mandrel 44 for receiving the slips 45. The slip receptacle may include a pocket for each slip 46, each pocket receiving a lower portion of the respective slip. The mandrel 44 may be connected to lower portions of the slips 45 by reception thereof in the pockets. Each slip pocket may have one or more (three shown) inclined surfaces formed in the outer surface of the mandrel 44 for extension of the respective slip. A lower portion of each slip 46 may have one or more (three shown) inclined inner surfaces corresponding to the inclined slip pocket surfaces.

Downward movement of the sleeve 47 toward the slips 45 may push the slips along the inclined surfaces, thereby wedging the slips toward the extended position. The lower portion of each slip 46 may also have a guide profile, such as tabs, extending from sides thereof. Each slip pocket may also have a mating guide profile, such as grooves, for retracting the slips 45 when the sleeve 47 moves upward away from the slips. Each slip 46 may have teeth formed along an outer surface thereof. The teeth may be made from a hard material, such as tool steel, ceramic, or cermet for engaging and penetrating an inner surface of the casing joint 90*j*, thereby anchoring the spear 40 to the casing joint.

The fill up tool 50 may include a flow tube, a stab seal, such as a cup seal, a release valve, and a mud saver valve. The cup seal may have an outer diameter slightly greater than an inner diameter of the casing joint to engage the inner surface thereof during stabbing of the spear 40 therein. The cup seal may be directional and oriented such that pressure in the casing bore energizes the seal into engagement with the casing joint inner surface. An upper end of the flow tube may be connected to a lower end of the mandrel 44, such as by threaded couplings. The mud saver valve may be connected to a lower end of the flow tube, such as by threaded couplings. The cup seal and release valve may be disposed along the flow tube and trapped between a bottom of the mandrel and a top of the mudsaver valve.

The spear 40 may be capable of supporting weight of the casing string 90. The string weight may be transferred to the becket 19 via the slips 45, the mandrel 44, the collar 43, the adapter 48, the coupling 15, the bayonet profile 23*b*, the down thrust bearing 27, the drive body 22. Fluid may be injected into the casing string 90 via the hose nipple 20, the mud swivel 21, the coupling 15, the adapter 48, the seal joint 46, the mandrel 44, the flow tube, and the mud saver valve. The spear 40 may thus have a load path separated from a flow path at the interface between the adapter 48 and the collar 43 and at the interface between the collar and the mandrel 44. This separation allows for more robust connections between the adapter 48 and the collar 43 and between the collar and the mandrel 44 than if the connections therebetween had to serve both load and isolation functions.

Alternatively, the clamp may be a torque head instead of the spear 40. The torque head may be similar to the spear except for receiving an upper portion of the casing joint 90 therein and having the grippers for engaging an outer surface of the casing joint instead of the inner surface of the casing joint. Alternatively, the compensator 25 may be configured for compensation of drill pipe 8*p* and the casing unit 1*c* may include an additional compensator configured for compensation of casing joints 90*j*.

Figure 2D:
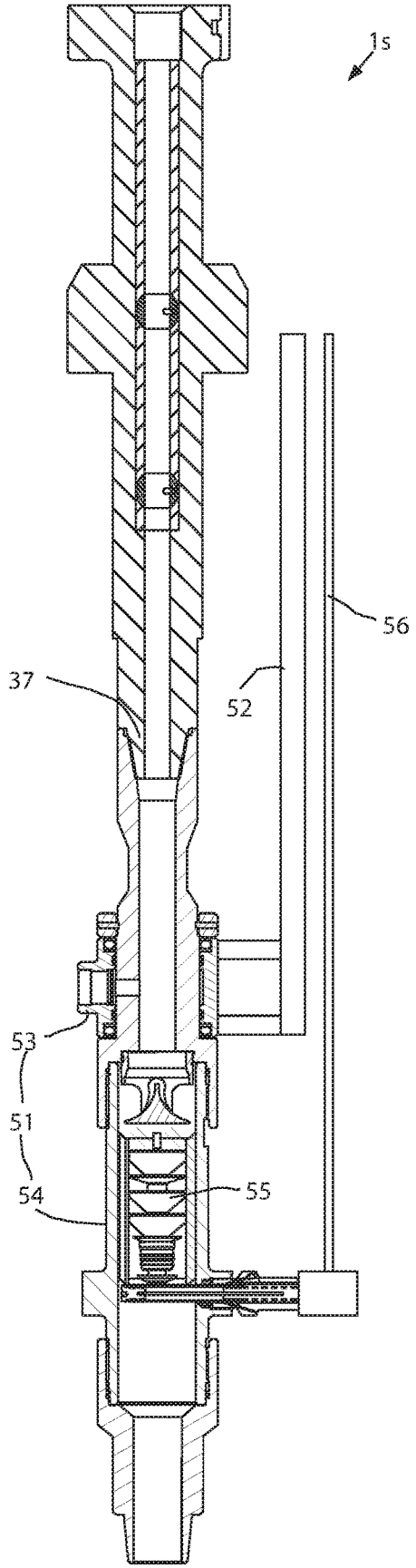
FIG. 2D illustrates a cementing unit of the modular top drive system.

FIG. 2D illustrates the cementing unit 1*s*. The cementing unit 1*s* may further include the quill 37, the IBOP 38, the hydraulic passages (not shown) and a cementing head 51. The cementing head 51 may include a cementing swivel 53, a launcher 54, and a release plug, such as a dart 55.

The cementing swivel 53 may include a housing torsionally connected to the drive body 22, such as by a bar 52. The cementing swivel 53 may further include a mandrel and bearings for supporting the housing from the mandrel while accommodating rotation of the mandrel. An upper end of the mandrel may be connected to a lower end of the quill 37, such as by threaded couplings. The cementing swivel 53 may further include an inlet formed through a wall of the housing and in fluid communication with a port formed through the mandrel and a seal assembly for isolating the inlet-port communication. The mandrel port may provide fluid communication between a bore of the cementing head 51 and the housing inlet.

Figure 7:
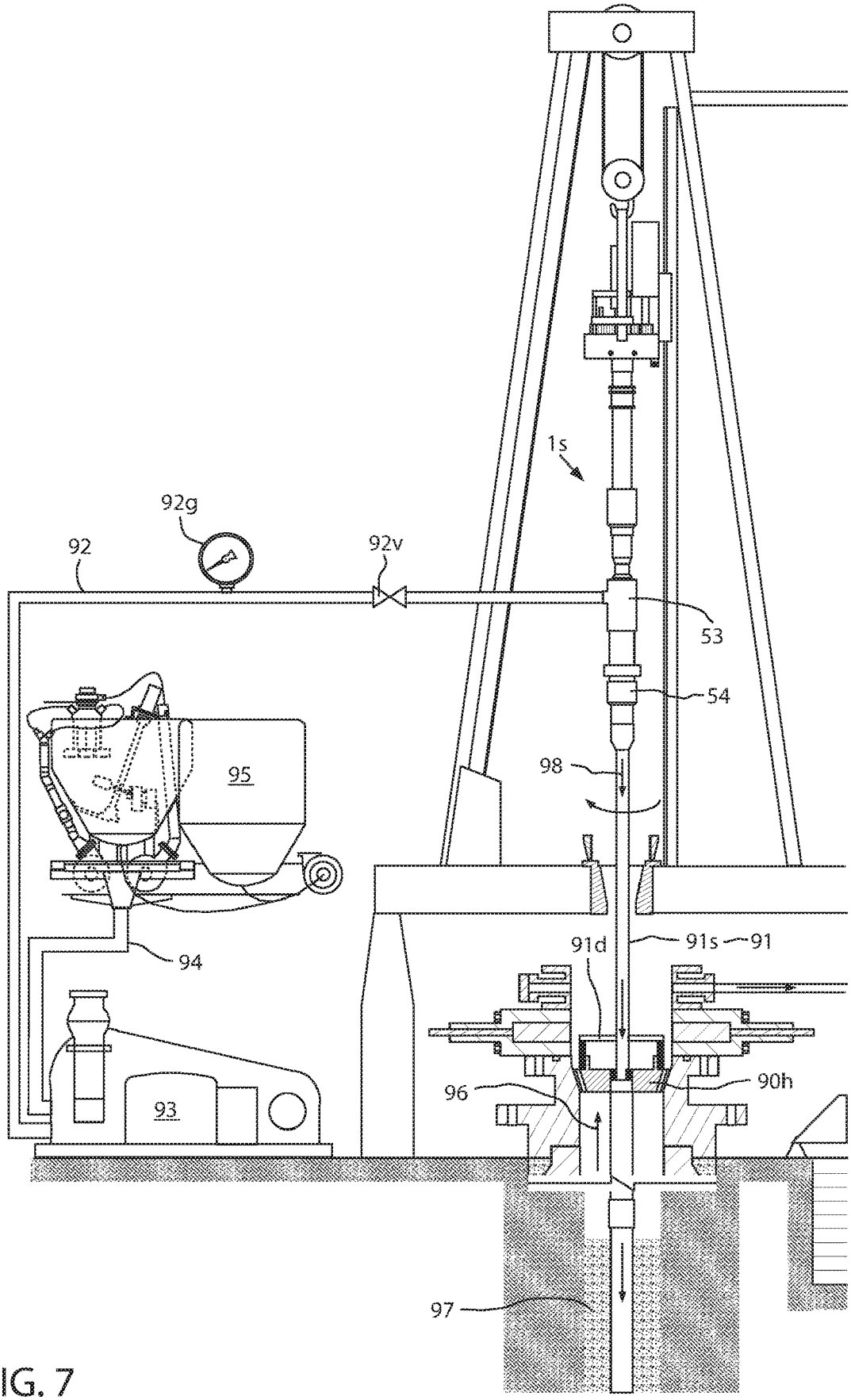
FIG. 7 illustrates cementing of the casing string using the modular top drive system in a cementing mode.

The launcher 54 may include a body, a deflector, a canister, a gate, the actuator, and an adapter. The body may be tubular and may have a bore therethrough. An upper end of the body may be connected to a lower end of the cementing swivel 53, such as by threaded couplings, and a lower end of the body may be connected to the adapter, such as by threaded couplings. The canister and deflector may each be disposed in the body bore. The deflector may be connected to the cementing swivel mandrel, such as by threaded couplings. The canister may be longitudinally movable relative to the body. The canister may be tubular and have ribs formed along and around an outer surface thereof. Bypass passages (only one shown) may be formed between the ribs. The canister may further have a landing shoulder formed in a lower end thereof for receipt by a landing shoulder of the adapter. The deflector may be operable to divert fluid received from a cement line 92 (FIG. 7) away from a bore of the canister and toward the bypass passages. The adapter may have a threaded coupling, such as a threaded pin, formed at a lower end thereof for connection to a work string 91 (FIG. 7).

The dart 55 may be disposed in the canister bore. The dart 55 may be made from one or more drillable materials and include a finned seal and mandrel. The mandrel may be made from a metal or alloy and may have a landing shoulder and carry a landing seal for engagement with the seat and seal bore of a wiper plug (not shown) of the work string 91.

The gate of the launcher 54 may include a housing, a plunger, and a shaft. The housing may be connected to a respective lug formed in an outer surface of the body, such as by threaded couplings. The plunger may be radially movable relative to the body between a capture position and a release position. The plunger may be moved between the positions by a linkage, such as a jackscrew, with the shaft. The shaft may be connected to and rotatable relative to the housing. The actuator may be a hydraulic motor operable to rotate the shaft relative to the housing. The actuator may include a reservoir (not shown) for receiving the spent hydraulic fluid or the cementing head 51 may include a second actuator swivel and hydraulic conduit (not shown) for returning the spent hydraulic fluid to the HPU 60.

In operation, when it is desired to launch the dart 55, the console 62 (FIG. 3) may be operated to supply hydraulic fluid to the launcher actuator via a control line 56 extending to the hydraulic swivel 26 and a control line extending from the hydraulic swivel to the manifold 60*m*. The launcher actuator may then move the plunger to the release position. The canister and dart 55 may then move downward relative to the launcher body until the landing shoulders engage. Engagement of the landing shoulders may close the canister bypass passages, thereby forcing chaser fluid 98 (FIG. 7) to flow into the canister bore. The chaser fluid 98 may then propel the dart 55 from the canister bore, down a bore of the adapter, and onward through the work string 91.

Alternatively, the actuator swivel 52 and launcher actuator may be pneumatic or electric. Alternatively, the launcher actuator may be linear, such as a piston and cylinder. Alternatively, the launcher 54 may include a main body having a main bore and a parallel side bore, with both bores being machined integral to the main body. The dart 55 may be loaded into the main bore, and a dart releaser valve may be provided below the dart to maintain it in the capture position. The dart releaser valve may be side-mounted externally and extend through the main body. A port in the dart releaser valve may provide fluid communication between the main bore and the side bore. In a bypass position, the dart 55 may be maintained in the main bore with the dart releaser valve closed. Fluid may flow through the side bore and into the main bore below the dart via the fluid communication port in the dart releaser valve. To release the dart 55, the dart releaser valve may be turned, such as by ninety degrees, thereby closing the side bore and opening the main bore through the dart releaser valve. The chaser fluid 98 may then enter the main bore behind the dart 55, thereby propelling the dart into the work string 91.

FIG. 3 is a control diagram of the modular top drive system 1 in the drilling mode. The HPU 60 may include a pump 60*p*, a check valve 60*k*, an accumulator 60*a*, a reservoir 60*r* of hydraulic fluid, and the manifold 60*m*. The motor driver 61 may be one or more (three shown) phase and include a rectifier 61*r* and an inverter 61*i*. The inverter 61*i* may be capable of speed control of the drive motors 18, such as being a pulse width modulator. Each of the HPU manifold 60*m* and motor driver 61 may be in data communication with the control console 62 for control of the various functions of the modular top drive system 1. The modular top drive system 1 may further include a video monitoring unit 63 having a video camera 63*c* and a light source 63*g* such that a technician (not shown) may visually monitor operation thereof from the rig floor 7*f* or control room (not shown) especially during shifting of the modes. The video monitoring unit 63 may be mounted on the motor unit 1*m*.

The pipe handler control lines 66*b,c* may flexible control lines such that the pipe handler 1*p* remains connected thereto in any position thereof.

The motor unit 1*m* may further include a proximity sensor 68 connected to the swivel frame 30 for monitoring a position of the lock ring flange 34*f*. The proximity sensor 68 may include a transmitting coil, a receiving coil, an inverter for powering the transmitting coil, and a detector circuit connected to the receiving coil. A magnetic field generated by the transmitting coil may induce eddy current in the turns gear lock ring flange 34*f* which may be made from an electrically conductive metal or alloy. The magnetic field generated by the eddy current may be measured by the detector circuit and supplied to the control console 62 via control line 65.

Alternatively, the proximity sensor 68 may be Hall effect, ultrasonic, or optical.

Alternatively, the motor unit 1*m* and/or casing unit 1*c* have a hydraulic manifold instead of the manifold 60*m* being part of the HPU 60 and the swivel 26 and/or a swivel of the casing unit may further include wireless power and/or data couplings for operation of the manifold. The swivels may be hydraulic, pneumatic, or combination of hydraulic and pneumatic. In one embodiment, pneumatic lines of the swivels may be used to transfer signals.

Alternatively, the swivel 26 may have additional hydraulic and/or pneumatic couplings for additional functionality of the casing 1*c*, drilling 1*d*, and/or cementing units 1*s*. For example, the casing unit 1*c* may have an IBOP.

FIGS. 4A-4M illustrate shifting of the modular top drive system 1 from a standby mode to the drilling mode. Referring specifically to FIGS. 1 and 4A, the unit handler 1*u* may be operated to engage the holder 5 with the torso 15*r* of the drilling unit 1*d*. Once engaged, the arm 4 may be raised slightly to shift weight of the drilling unit 1*d* from the unit rack 1*k* to the holder 5. The respective motor 14*m* may then be operated to rotate the respective ring gear 14*g* until the external prongs of the respective head 15*h* are aligned with the internal prong-ways of the ring gear (and vice versa), thereby freeing the head for passing through the ring gear. The arm 4 may then be lowered, thereby passing the drilling unit 1*d* through the respective ring gear 14*g*.

Referring specifically to FIG. 4B, the unit handler 1*u* may be operated to move the drilling unit 1*d* away from the unit rack 1*k* until the drilling unit is clear of the unit rack. Referring specifically to FIG. 4C, the arm 4 may be raised to lift the drilling unit 1*d* above the rig floor 7*f*. Referring specifically to FIG. 4D, the unit handler 1*u* may be operated to horizontally move the drilling unit 1*d* into alignment with the motor unit 1*m*.

Referring specifically to FIGS. 4E-4G, the arm 4 may then be raised to lift the drilling unit 1*d* until the respective head 15*h* is adjacent to the bottom of the drive gear 23. The drive motors 18 may then be operated to rotate the drive gear 23 until the external prongs of the respective head 15*h* are aligned with the internal prong-ways of the bayonet profile 23*b* and at a correct orientation so that when the drive gear is rotated to engage the bayonet profile with the respective head 15*h*, the asymmetric profiles of the hydraulic junction 36 will be aligned. The drive gear 23 may have visible alignment features (not shown) on the bottom thereof to facilitate use of the camera 63*c* for obtaining the alignment and the orientation. Once aligned and oriented, the arm 4 may be raised to lift the coupling 15 of the drilling unit 1*d* into the drive gear 23 until the respective head 15*h* is aligned with the locking profile 23*k* thereof. The lock ring 34 may be in a lower position, such as the hoisting position, such that the top of the respective head 15*h* contacts the lock ring and pushes the lock ring upward. The proximity sensor 68 may then be used to determine alignment of the respective head 15*h* with the locking profile 23*k* by measuring the vertical displacement of the lock ring 34. Once alignment has been achieved, the compensator actuator 33 may be operated to move the lock ring 34 to the ready position.

Referring specifically to FIGS. 4H and 4I, the drive motors 18 may then be operated to rotate the drive gear 23 until sides of the external prongs of the respective head 15*h* engage respective stop lugs of the locking profile 23*k*, thereby aligning the external prongs of the respective head with the internal prongs of the bayonet profile 23*b* and correctly orienting the profiles of the hydraulic junction 36.

Referring specifically to FIGS. 4J and 4K, the compensator actuator 33 may then be operated to move the lock ring 34 to the hoisting position, thereby moving the lugs of the locking profile 34*k* into the external prong-ways of the respective head 15*h* and aligning the lock pins 35 with the respective slots 15*t*. Movement of the lock ring 34 also stabs the male members 34*m* into the respective female members 15*f*, thereby forming the hydraulic junction 36. The proximity sensor 68 may again be monitored to ensure that the bayonet profiles 23*b* have properly engaged and are not jammed. Hydraulic fluid may then be supplied to the extension portions of the chambers housing the lock pins 35 via the control line 64*a*, thereby moving the lock pins radially inward and into the respective slots 15*t*. The locking profile 23*k* may have a sufficient length to maintain a torsional connection between the drilling unit 1*d* and the drive gear 23 in and between the ready and hoisting positions of the compensator 25. The drilling unit 1*d* is now longitudinally and torsionally connected to the drive gear 23, thereby forming a top drive.

Figure 4M:
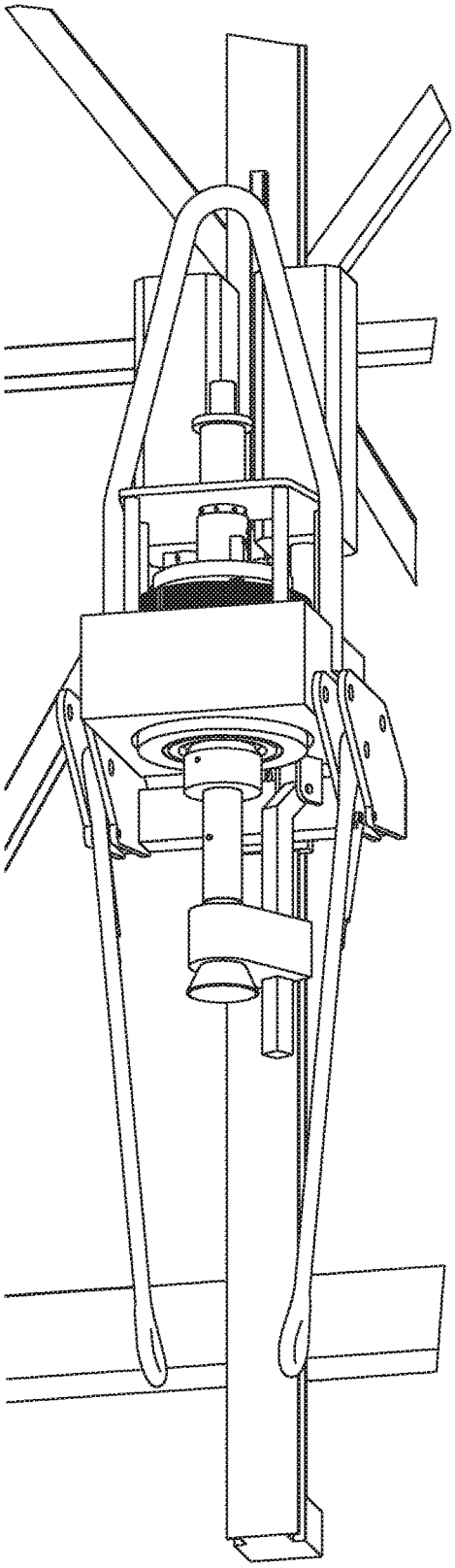

Referring specifically to FIGS. 4L and 4M, the tilt actuator of the backup wrench 29 may then be operated to pivot the arm 29*a* and tong 29*t* about the hinge 29*h* and into alignment with the drilling unit 1*d*. The linear actuator of the backup tong 29 may then be operated via the cable 67*a* to move the tong 29*t* upward along the arm 29*a* until the tong is positioned adjacent to the quill 37. The modular top drive system 1 is now in the drilling mode.

Alternatively, the tong 29*t* may be in alignment with the quill 37 during installation and removal of the drilling unit 1*d* and the tilt actuator used only for installation and removal of the casing unit 1*c*. Alternatively, the unit handler 1*u* may raise the drilling unit 1*d* to the rig floor 7*f* and the pipe handler 1*p* may deliver the drilling unit to the motor unit 1*m*.

Figure 5A:
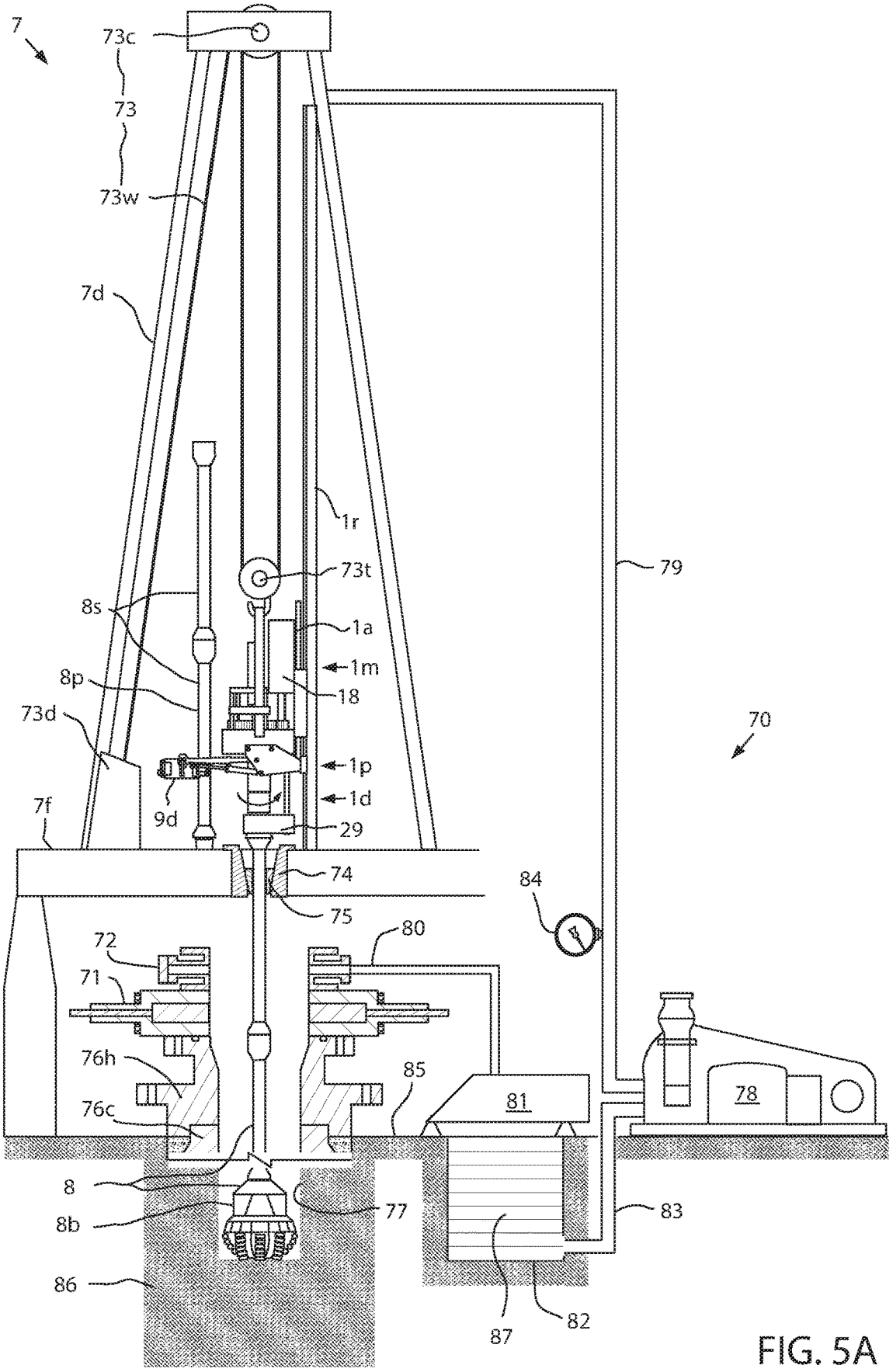
FIGS. 5A-5H illustrate extension of a drill string using the modular top drive system in the drilling mode.

FIGS. 5A-5H illustrate extension of the drill string 8 using the modular top drive system 1 in the drilling mode. Referring specifically to FIG. 5A, the drilling rig 7 may be part of a drilling system. The drilling system may further include a fluid handling system 70, a blowout preventer (BOP) 71, a flow cross 72 and the drill string 8. The drilling rig 7 may further include a hoist 73, a rotary table 74, and a spider 75. The rig floor 7*f* may have the opening through which the drill string 8 extends downwardly through the flow cross 72, BOP 71, and a wellhead 76*h*, and into a wellbore 77.

The hoist 73 may include the drawworks 73*d* wire rope 73*w*, a crown block 73*c*, and the traveling block 73*t*. The traveling block 73*t* may be supported by wire rope 73*w* connected at its upper end to the crown block 73*c*. The wire rope 73*w* may be woven through sheaves of the blocks 73*c,t* and extend to the drawworks 73*d* for reeling thereof, thereby raising or lowering the traveling block 73*t* relative to the derrick 7*d*.

The fluid handling system 70 may include a mud pump 78, the standpipe 79, a return line 80, a separator, such as shale shaker 81, a pit 82 or tank, a feed line 83, and a pressure gauge 84. A first end of the return line 80 may be connected to the flow cross 72 and a second end of the return line may be connected to an inlet of the shaker 81. A lower end of the standpipe 79 may be connected to an outlet of the mud pump 78 and an upper end of the standpipe may be connected to the mud hose. A lower end of the feed line 83 may be connected to an outlet of the pit 82 and an upper end of the feed line may be connected to an inlet of the mud pump 78.

The wellhead 76*h* may be mounted on a conductor pipe 76*c*. The BOP 71 may be connected to the wellhead 76*h* and the flow cross 72 may be connected to the BOP, such as by flanged connections. The wellbore 77 may be terrestrial (shown) or subsea (not shown). If terrestrial, the wellhead 76*h* may be located at a surface 85 of the earth and the drilling rig 7 may be disposed on a pad adjacent to the wellhead. If subsea, the wellhead 76*h* may be located on the seafloor or adjacent to the waterline and the drilling rig 7 may be located on an offshore drilling unit or a platform adjacent to the wellhead.

The drill string 8 may include a bottom hole assembly (BHA) 8*b* and a stem. The stem may include joints of the drill pipe 8*p* connected together, such as by threaded couplings. The BHA 8*b* may be connected to the stem, such as by threaded couplings, and include a drill bit and one or more drill collars (not shown) connected thereto, such as by threaded couplings. The drill bit may be rotated by the motor unit 1*m* via the stem and/or the BHA 8*b* may further include a drilling motor (not shown) for rotating the drill bit. The BHA 8*b* may further include an instrumentation sub (not shown), such as a measurement while drilling (MWD) and/or a logging while drilling (LWD) sub.

The drill string 8 may be used to extend the wellbore 77 through an upper formation 86 and/or lower formation (not shown). The upper formation may be non-productive and the lower formation may be a hydrocarbon-bearing reservoir. During the drilling operation, the mud pump 78 may pump the drilling fluid 87 from the pit 82, through the standpipe 79 and mud hose to the motor unit 1*m*. The drilling fluid may include a base liquid. The base liquid may be refined or synthetic oil, water, brine, or a water/oil emulsion. The drilling fluid 87 may further include solids dissolved or suspended in the base liquid, such as organophilic clay, lignite, and/or asphalt, thereby forming a mud.

The drilling fluid 87 may flow from the standpipe 79 and into the drill string 8 via the motor 1*m* and drilling 1*d* units. The drilling fluid 87 may be pumped down through the drill string 8 and exit the drill bit, where the fluid may circulate the cuttings away from the bit and return the cuttings up an annulus formed between an inner surface of the wellbore 77 and an outer surface of the drill string 8. The drilling fluid 87 plus cuttings, collectively returns 88 (FIG. 5I), may flow up the annulus to the wellhead 76*h* and exit via the return line 80 into the shale shaker 81. The shale shaker 81 may process the returns to remove the cuttings and discharge the processed fluid into the mud pit 82, thereby completing a cycle. As the drilling fluid 87 and returns 88 circulate, the drill string 8 may be rotated by the motor unit 1*m* and lowered by the traveling block 73*t*, thereby extending the wellbore 77.

Figure 5B:
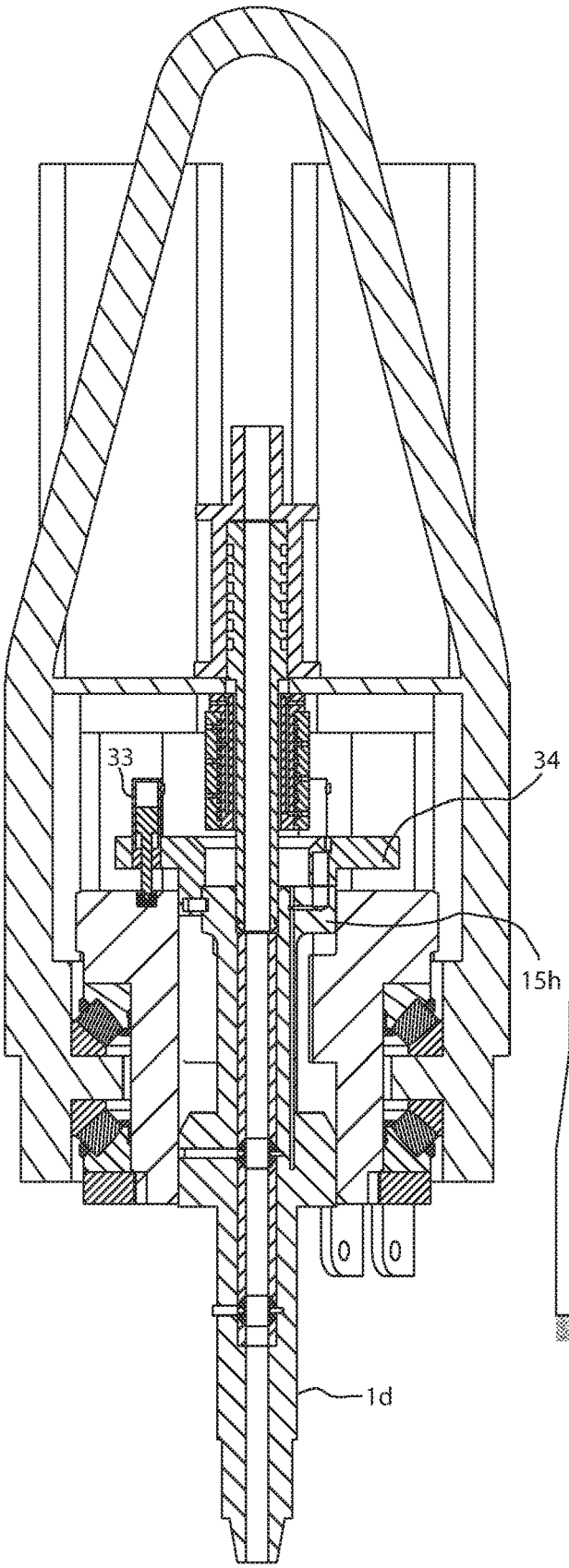

Referring also to FIG. 5B, during drilling of the wellbore 77, once a top of the drill string 8 reaches the rig floor 7*f*, the drill string must be extended to continue drilling. Drilling may be halted by stopping rotation of the motor unit 1*m*, stopping lowering of the traveling block 73*t*, stopping injection of the drilling fluid 87, and removing weight from the drill bit. The spider 75 may then be installed into the rotary table 74, thereby longitudinally supporting the drill string 8 from the rig floor 7*f*. The tong actuator of the backup wrench 29 may be operated via control line 66*d* to engage the backup wrench tong 29*t* with a top coupling of the drill string 8.

The compensator 25 may be in the hoisting position and the linear actuator 33 thereof activated while the drive motors 18 are operated to loosen and counter-spin the connection between the quill 37 and the top coupling of the drill string 8. The compensator 25 may stroke from the hoisting position to the ready position during unscrewing of the connection between the top coupling and the quill 37. Hydraulic pressure may be maintained in the linear actuator 33 corresponding to the weight of the drilling module 1*d* and lock ring 34 so that the threaded connection between the top coupling and the quill 37 is maintained in a neutral condition during unscrewing. A pressure regulator of the manifold 60*m* may increase fluid pressure to the linear actuator 33 as the connection is being unscrewed to maintain the neutral condition while the compensator 25 strokes upward to accommodate the longitudinal displacement of the threaded connection.

Figure 5C:
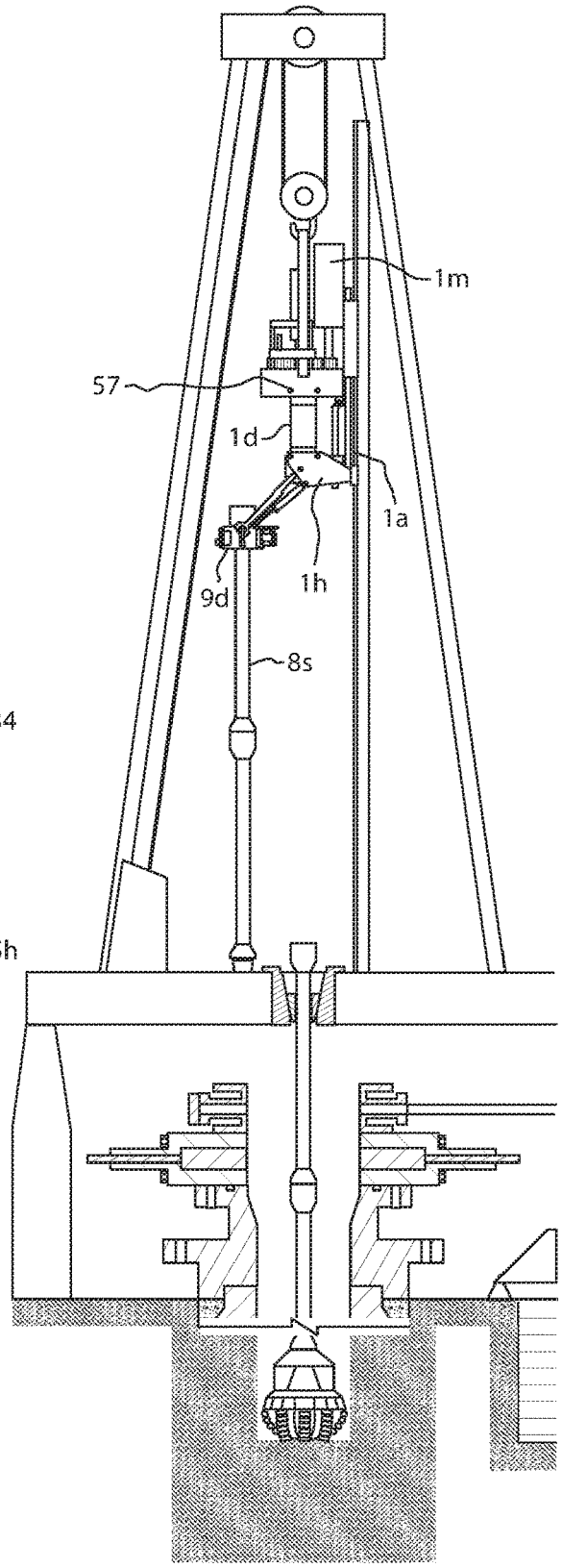

Referring specifically to FIG. 5C, once the connection between the quill 37 and the top coupling has been unscrewed the compensator 25 may be stroked back to the hoisting position and the motor 1*m* and drilling 1*d* units and the pipe handler 1*p* may then be raised by the hoist 73 until the elevator 9*d* is above a top of the stand 8*s*. The motor unit 1*m* may be positioned at a location with enough space to allow subsequent operations. For example, the motor unit 1*m* may be raised slightly upward before extending the compensator 25. The latch 57 of the motor unit 1*m* may then be operated via the control line 66*a* to release the slide hinge 12 from the drive body 22 and the linear actuator 1*a* operated via the cable 67*b* to lower the slide hinge until the elevator 9*d* is adjacent to the top of the stand 8*s*. The elevator 9*d* may be opened (or already open) and the link tilt 11 operated to swing the elevator into engagement with the top coupling of the stand 8*s*. The elevator 9*d* may then be closed to securely grip the stand 8*s*.

Alternatively, the stand 8*s* may be located on a ramp 7*r* (FIG. 4E) adjacent to the rig floor 7*f* and the pipe handler 1*p* operated to locate the elevator 9*d* adjacent to the top of the stand at or through a V-door (not shown) of the rig 7. Alternatively, the stand 8*s* may be supported by a pipe handler.

Figure 5D:
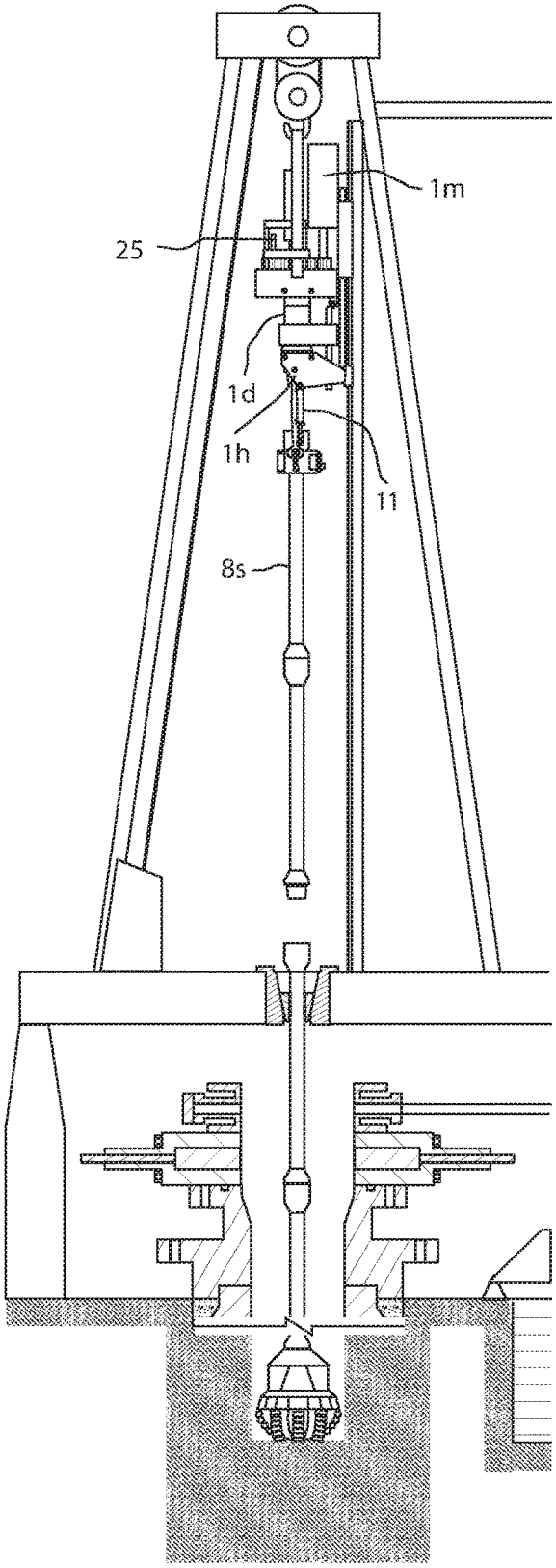

Referring specifically to FIG. 5D, the motor 1*m* and drilling 1*d* units, pipe handler 1*p*, and stand 8*s* may then be raised by the hoist 73 and the link tilt 11 operated to swing the stand over and into alignment with quill 37. The compensator 25 may then be stroked to the ready position and the proximity sensor 68 calibrated by a controller of the console 62 reading the proximity sensor at the hoisting position. The pressure regulator of the manifold 60*m* may be operated to maintain the compensator actuator 33 at a sensing pressure, such as slightly less than the pressure required to support weight of the lock ring 34 and drilling unit 1*d*, such that the compensator 25 drifts to the hoisting position. The linear actuator of the backup wrench 29 may be operated to raise the tong 29*t* such that the camera 63*c* may observe stabbing of the quill 37 into the top coupling of the stand 8*s*.

Figure 5E:
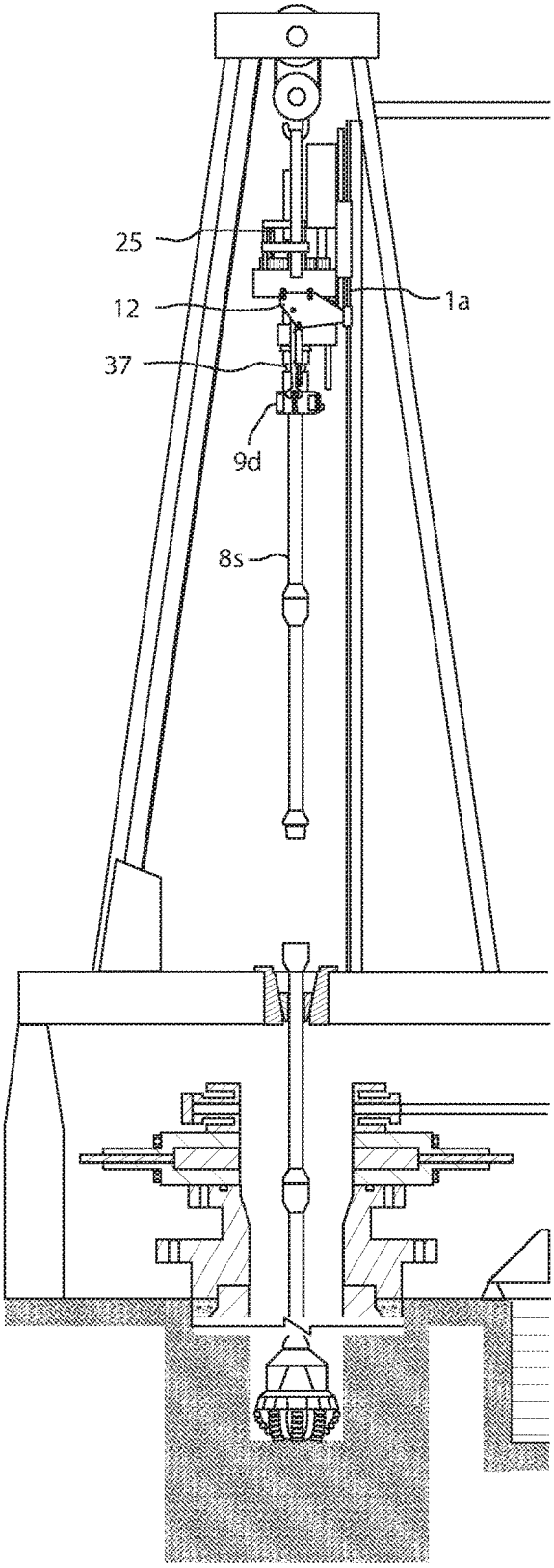

Referring specifically to FIG. 5E, the linear actuator 1*a* may be operated via the cable 67*b* to raise the slide hinge 12, elevator 9*d*, and stand 8*s* until the quill 37 is stabbed into the top coupling of the stand 8*s*. During stabbing, the proximity sensor 68 may be monitored by the control console 53 to detect stroking of the compensator 25 to the ready position and the linear actuator 1*a* may be locked at the ready position.

Figure 5F:
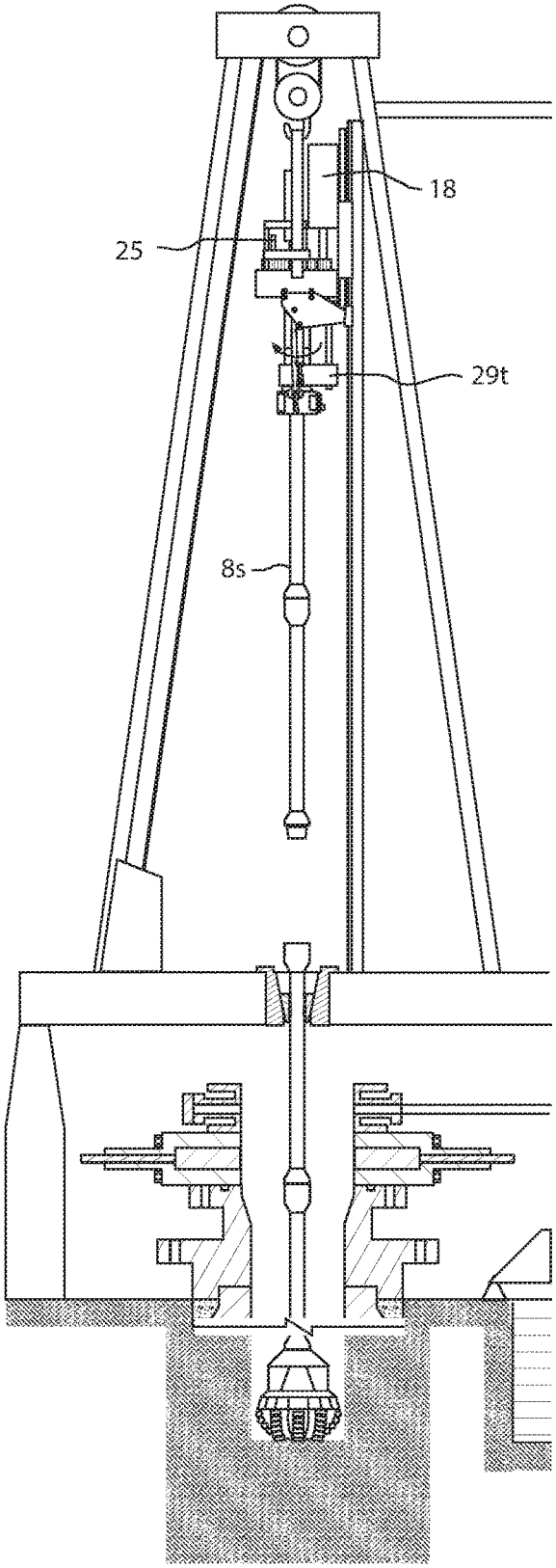

Referring specifically to FIG. 5F, the linear actuator of the backup wrench 29 may be operated to lower the tong 29*t* into alignment with the top coupling of the stand 8*s*. The tong actuator of the backup wrench 29 may then be operated to engage the tong 29*t* with the top coupling of the stand 8*s*. The drive motors 18 may then be operated to spin and tighten the threaded connection between the quill 37 and the stand 8*s*. The hydraulic pressure may be maintained in the linear actuator 33 corresponding to the weight of the lock ring 34 and drilling unit 1*d* so that the threaded connection is maintained in a neutral condition during makeup. The pressure regulator of the manifold 60*m* may relieve fluid pressure from the linear actuator 33 as the quill 37 is being madeup to the stand 8*s* to maintain the neutral condition while the compensator 25 strokes downward to accommodate the longitudinal displacement of the threaded connection.

Figure 5G:
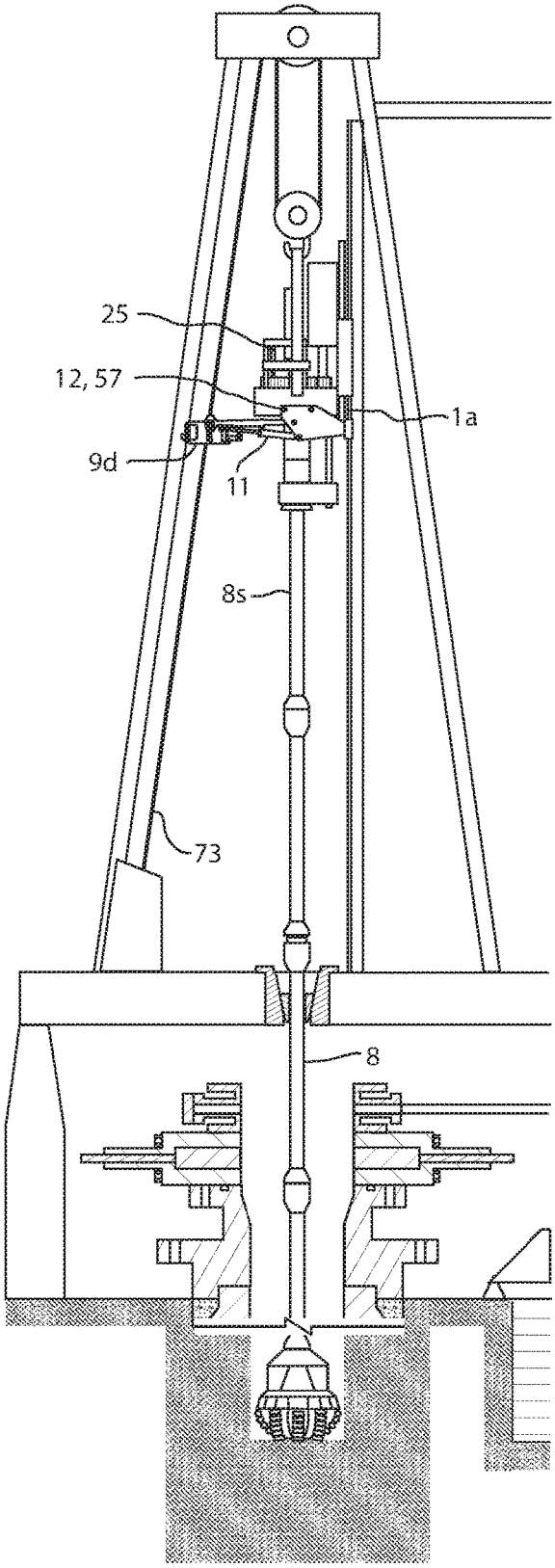

Referring specifically to FIG. 5G, the elevator 9*d* may be opened to release the stand 8*s* and the link tilt 11 operated to swing the elevator to a position clear of the stand. The tong actuator of the backup wrench 29 may then be operated to release the tong 29*t* from the top coupling of the stand 8*s*. The linear actuator 1*a* may be operated to raise the slide hinge 12 until the slide hinge is aligned with the latch 57 of the motor unit 1*m*. The latch 57 of the motor unit 1*m* may then be operated via the control line 66*a* to fasten the slide hinge 12 to the motor unit 1*m*. Alternatively, particularly when the elevator 9*d* is not used to lift the string, involvement of the latch 57 may be omitted. The compensator 25 may be stroked upward and the pressure regulator of the manifold 60*m* may be operated to maintain the compensator actuator 33 at a second sensing pressure, such as slightly less than the pressure required to support weight of the lock ring 34, drilling unit 1*d*, and stand 8*s*, such that the compensator 25 drifts to the hoisting position. Alternatively, the compensator 25 may be driven to the hoisting position first and the pressure regulator may be used to set a pressure at the hoisting position. The motor 1*m* and drilling 1*d* units, pipe handler 1*p*, and stand 8*s* may be lowered by operation of the hoist 73 and a bottom coupling of the stand stabbed into the top coupling of the drill string 8. During stabbing, the proximity sensor 68 may be monitored by the control console 53 to detect stroking of the compensator 25 to the ready position and the hoist 73 may be locked at the ready position.

Figure 5H:
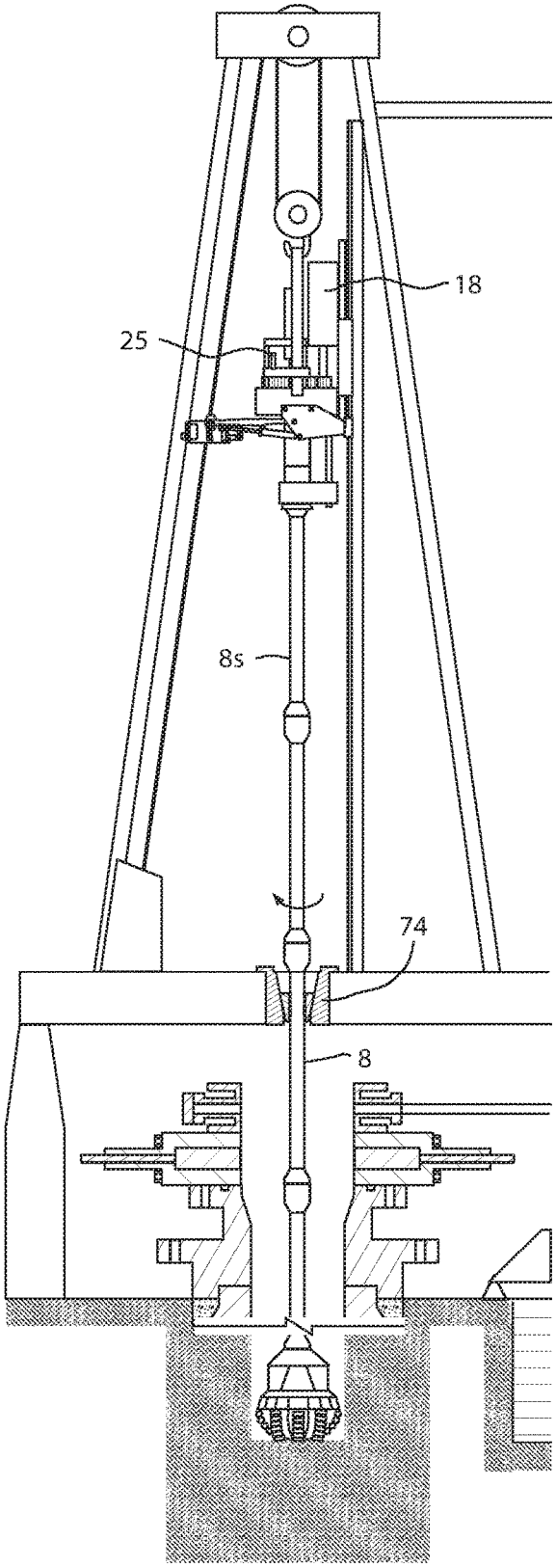

Referring specifically to FIG. 5H, the rotary table 74 may be locked or a backup tong (not shown) may be engaged with the top coupling of the drill string 8 and the drive motors 18 may be operated to spin and tighten the threaded connection between the stand 8*s* and the drill string 8. The hydraulic pressure may be maintained in the linear actuator 33 corresponding to the weight of the lock ring 34, drilling unit 1*d*, and stand 8*s* so that the threaded connection is maintained in a neutral condition during makeup. The pressure regulator of the manifold 60*m* may relieve fluid pressure from the linear actuator 33 as the stand 8*s* is being madeup to the drill string 8 to maintain the neutral condition while the compensator 25 strokes downward to accommodate the longitudinal displacement of the threaded connection.

Alternatively, a spinner and drive tong may be engaged with the stand 8*s* and operated to spin and tighten the threaded connection between the stand 8*s* and the drill string 8. Alternatively, the a spinner and drive tong may be used for unscrewing the quill 37 from the top coupling of the drill string 8 by swinging the backup wrench 29 out of the way.

Figure 5I:
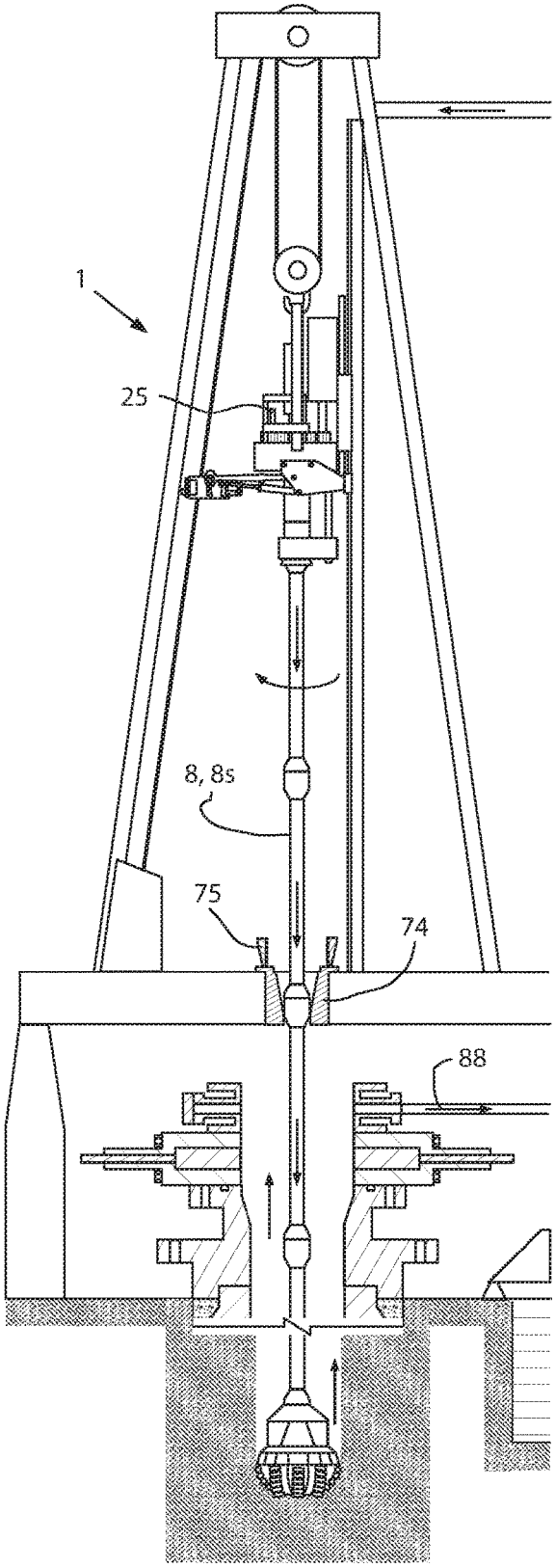
FIG. 5I illustrates drilling a wellbore using the extended drill string and the modular top drive system.

FIG. 5I illustrates drilling the wellbore 77 using the extended drill string 8, 8*s* and the modular top drive system 1. The manifold 60*m* may be operated to pressurize the linear actuator 33 to exert a downward preload onto the lock ring 34. During drilling or running, the preload may prevent or mitigate vibration and/or impact from the drilling or running operation from damaging the bayonet connection between the drilling unit 1*d* and the motor unit 1*m*. The spider 75 may then be removed from the rotary table 74 to release the extended drill string 8, 8*s* and drilling may continue therewith.

Alternatively, the stand 8*s* may be connected to the drill string 8 before the quill 37 is connected to the stand, such as by using tongs.

Figure 6A:
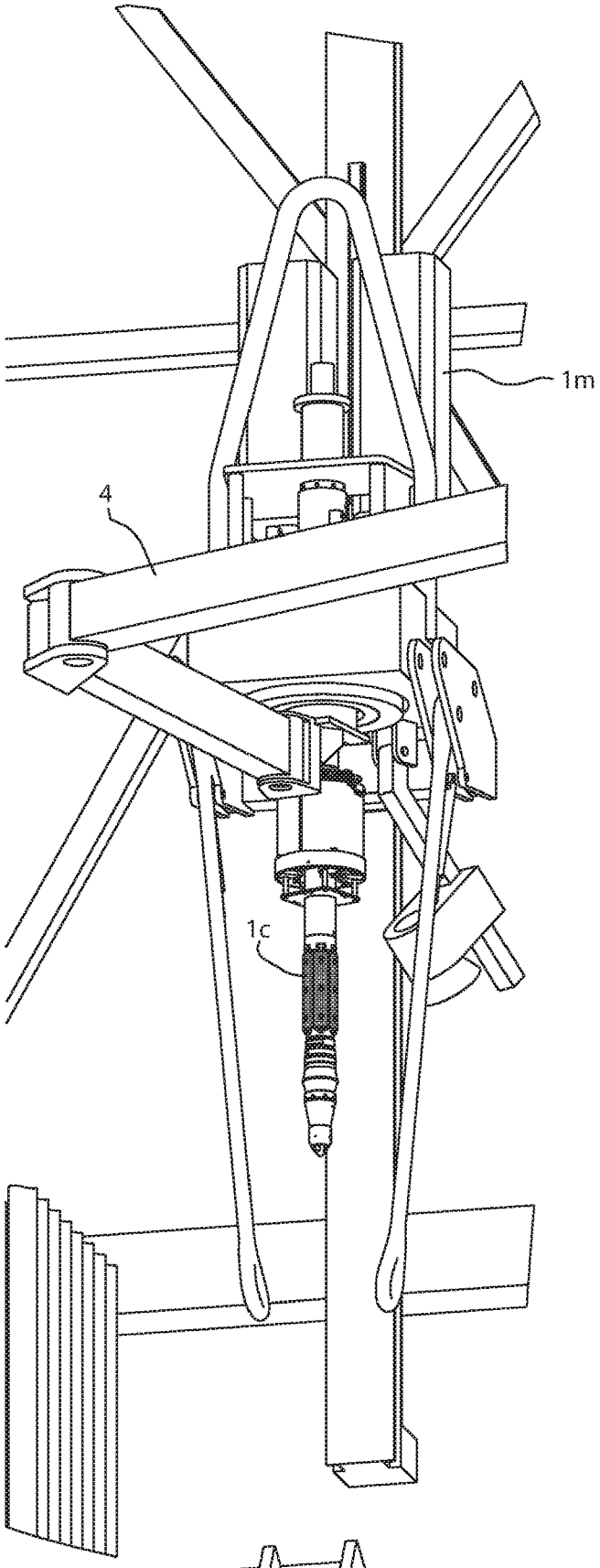
FIG. 6A illustrates shifting of the modular top drive system from the drilling mode to the casing mode.

FIG. 6A illustrates shifting of the modular top drive system 1 from the drilling mode to the casing mode. Once drilling the formation 86 has been completed, the drill string 8 may be tripped out from the wellbore 77 by reversing the steps of FIGS. 5A-5I. Once the drill string 8 has been retrieved to the rig 7, the drilling unit 1*d* may be released from the motor unit 1*m* and loaded onto the unit rack 1*k* by reversing the steps of FIGS. 1A and 4A-4M. The top drive system 1 may then be shifted into the casing mode by repeating the steps of FIGS. 1A and 4A-4K for the casing unit 1*c*. The locking profile 23*k* may have a sufficient length to maintain a torsional connection between the casing unit 1*c* and the drive gear 23 in and between the ready and hoisting positions of the compensator 25. The drill pipe elevator 9*d* may be disconnected and removed from the lower eyelets of the bails 10. Each adapter may then be inserted into the respective lower eyelet and connected to the respective bail 10 and the casing elevator 9*c* may be connected to the adapters.

Figure 6B:
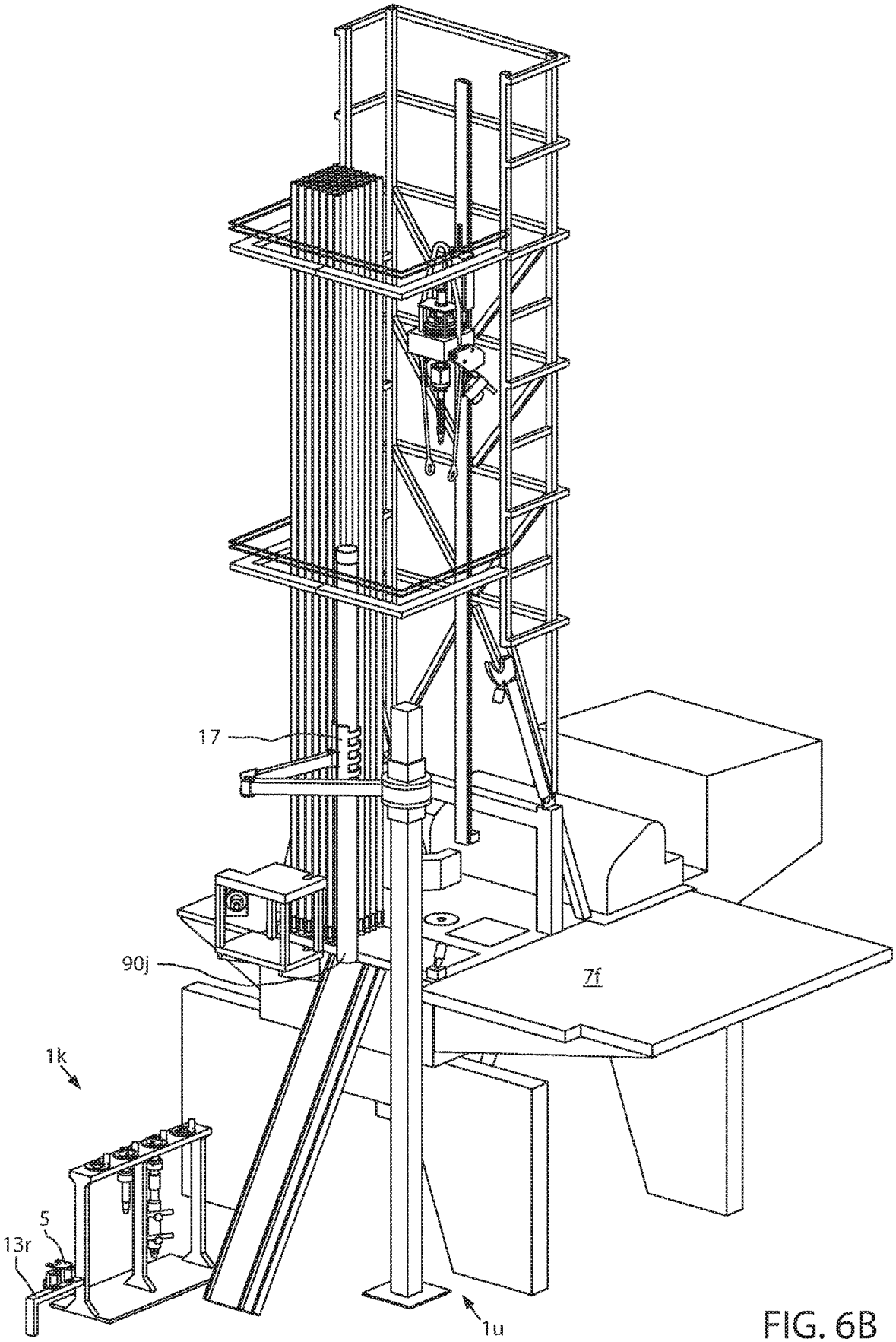
FIGS. 6B-6F illustrate extension of a casing string using the modular top drive system in the casing mode.

FIGS. 6B-6F illustrate extension of a casing string 90 using the modular top drive system 1 in the casing mode. Referring specifically to FIG. 6B, once the casing unit 1*c* has been connected to the motor unit 1*m*, the holder 5 may be disconnected from the arm 4 and stowed on the side bar 13*r*. The pipe clamp 17 may then be connected to the arm 4 and the unit handler 1*u* operated to engage the pipe clamp with the casing joint 90*j*. The pipe clamp 17 may be manually actuated between an engaged and disengaged position or include an actuator, such as a hydraulic actuator, for actuation between the positions. The casing joint 90*j* may initially be located on the subfloor structure and the unit handler 1*u* may be operated to raise the casing joint to the rig floor 7*f*. The pipe clamp 17 may release the casing joint onto the rig floor 7*f* or hold the casing joint 90*j* until the casing elevator 9*c* is engaged therewith and then release the casing joint.

Alternatively, the casing joint 90*j* may be located on the ramp 7*r* adjacent to the rig floor 7*f* and the pipe handler 1*p* operated to locate the elevator 9*c* adjacent to the top of the casing joint at or through the V-door. Alternatively, the unit handler 1*h* may deliver the casing joint 90*j* to the rig floor 7*f* and into alignment with the casing unit 1*c* and the unit handler 1*h* may hold the casing joint while the spear 40 and fill up tool 50 are stabbed into the casing joint, thereby obviating the need to use the pipe handler 1*p* for extension of the casing string 90.

Figure 6C:
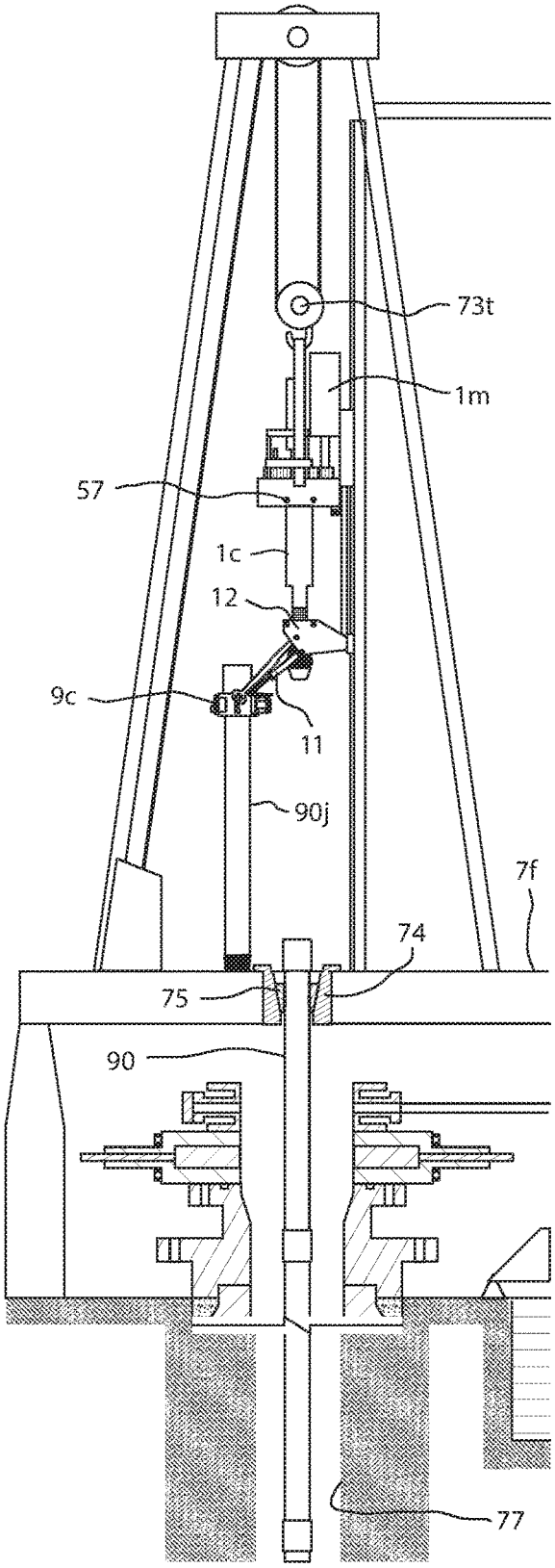

Referring specifically to FIG. 6C, during deployment of the casing string 90 into the wellbore 77, once a top of the casing string reaches the rig floor 7*f*, the casing string must be extended to continue deployment. Deployment may be halted by stopping rotation of the motor unit 1*m*, stopping injection of the drilling fluid 87, and stopping lowering of the traveling block 73*t*. The spider 75 may then be installed into the rotary table 74, thereby longitudinally supporting the casing string 90 from the rig floor 7*f*. The spear slips 45 may be released from a top joint of the casing string 90 by operating the linear actuator 41. Once the spear 40 has been released, the motor 1*m* and casing 1*c* units and pipe handler 1*p* may then be raised by the hoist 73 until the elevator 9*c* is above a top of the casing joint 90*j*. The latch 57 of the motor unit 1*m* may then be operated via the control line 66*a* to release the slide hinge 12 from the drive body 22 and the linear actuator 1*a* operated via the cable 67*b* to lower the slide hinge until the elevator 9*c* is adjacent to the top of the casing joint 90*j*. The elevator 9*c* may be opened (or already open) and the link tilt 11 operated to swing the elevator into engagement with a top coupling of the casing joint 90*j*. The elevator 9*c* may then be closed to securely grip the casing joint 90*j*.

Figure 6D:
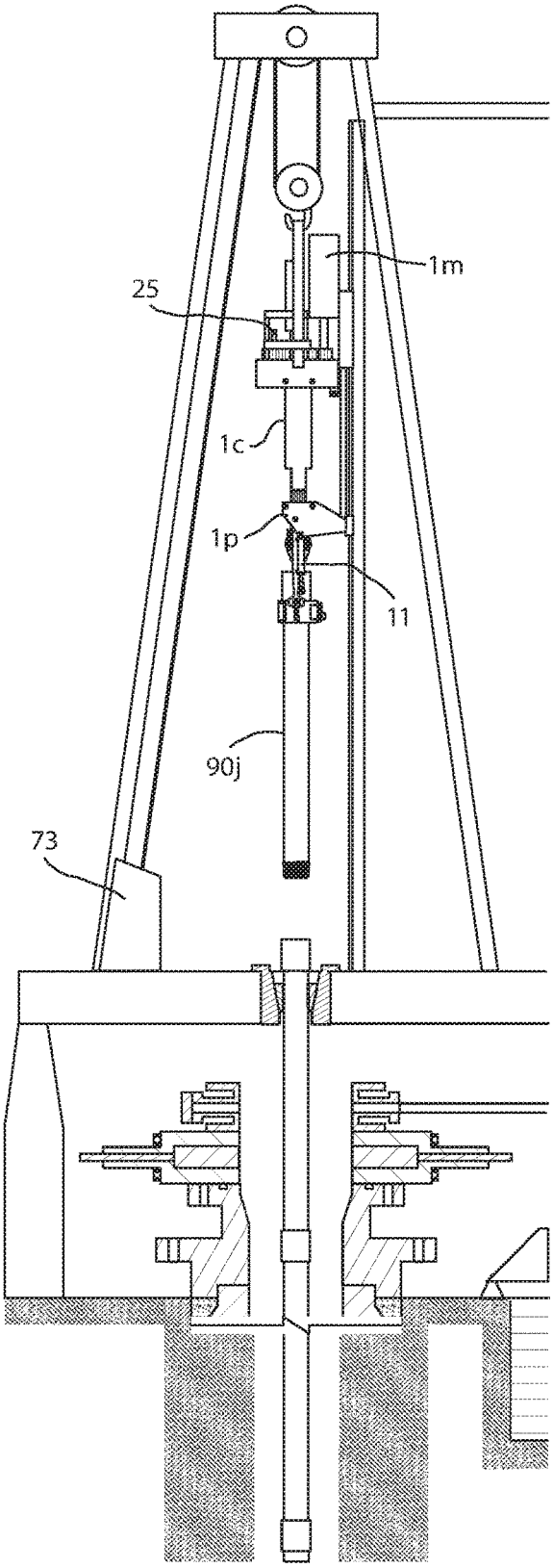

Referring specifically to FIG. 6D, the motor 1*m* and casing 1*c* units, pipe handler 1*p*, and casing joint 90*j* may then be raised by the hoist 73 and the link tilt 11 operated to swing the casing joint over and into alignment with the spear 40. The compensator 25 may be stroked upward and the pressure regulator of the manifold 60*m* may be operated to maintain the compensator actuator 33 at a sensing pressure, such as slightly less than the pressure required to support weight of the lock ring 34 and casing unit 1*c*, such that the compensator 25 drifts to the hoisting position. Alternatively, the compensator 25 may be driven to the hoisting position first and the pressure regulator may be used to set a pressure at the hoisting position.

Figure 6E:
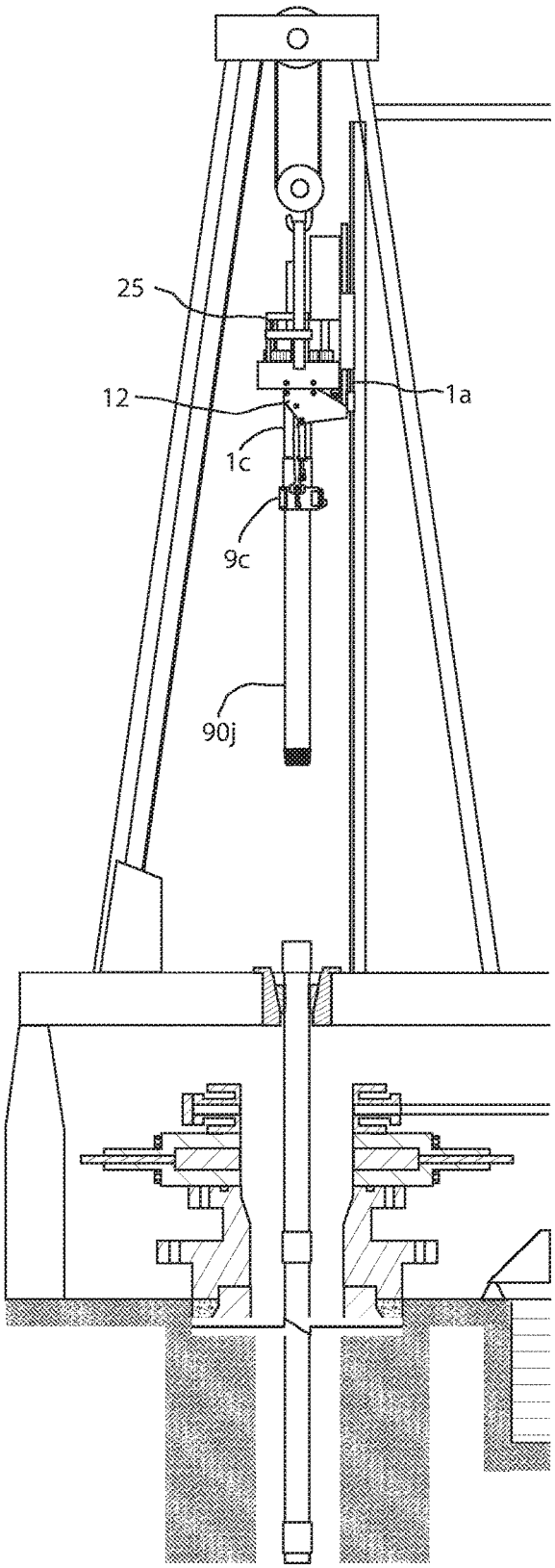

Referring specifically to FIG. 6E, the linear actuator 1*a* may be operated via the cable 67*b* to raise the slide hinge 12, elevator 9*c*, and casing joint 90*j* until the spear 40 and fill up valve 50 are stabbed into the casing joint. During stabbing, the bumper 42 may engage a top of the casing joint 90*j* and the proximity sensor 68 may be monitored by the control console 53 to detect stroking of the compensator 25 to the ready position. The camera 63*c* may also observe stabbing of the spear 40 into the casing joint 90*j*. Once stabbed, the spear slips 45 may be engaged with the casing joint 90*j* by operating the linear actuator 41.

Figure 6F:
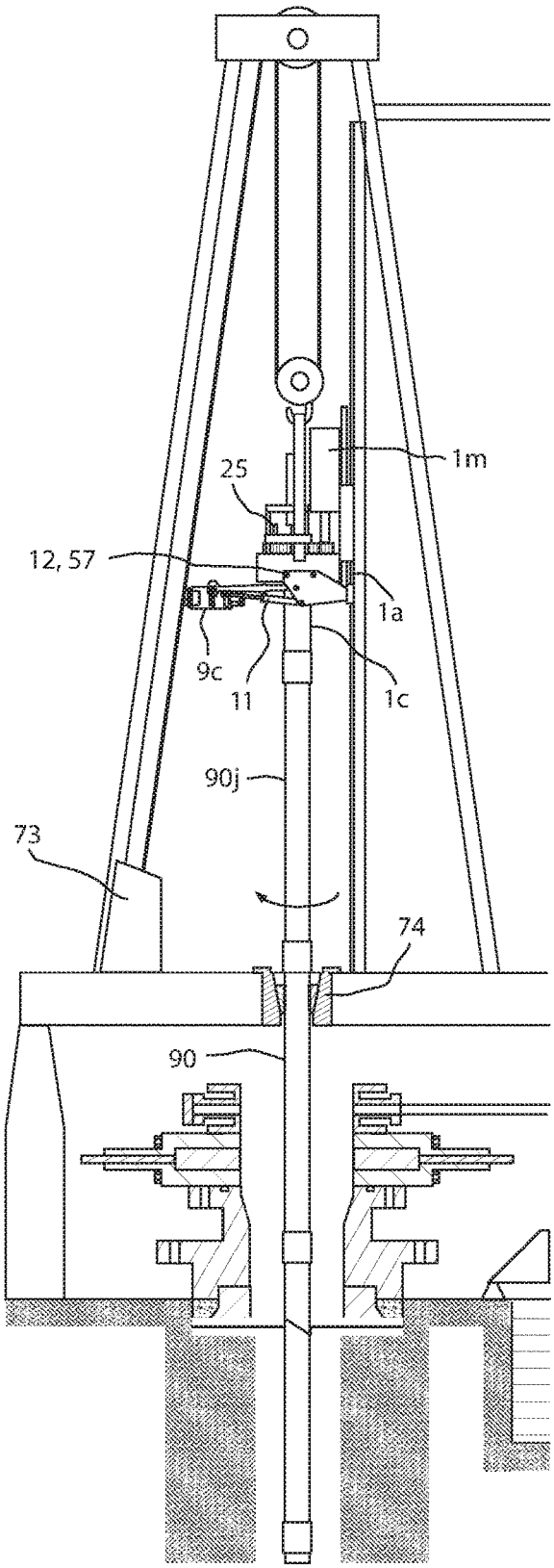

Referring specifically to FIG. 6F, the elevator 9*c* may be opened to release the casing joint 90*j* and the link tilt 11 operated to swing the elevator to a position clear of the casing joint. The linear actuator 1*a* may be operated to raise the slide hinge 12 until the slide hinge is aligned with the latch 57 of the motor unit 1*m*. The latch 57 of the motor unit 1*m* may then be operated via the control line 66*a* to fasten the slide hinge 12 to the motor unit 1*m*. The compensator 25 may be stroked upward and the pressure regulator of the manifold 60*m* may be operated to maintain the compensator actuator 33 at a second sensing pressure, such as slightly less than the pressure required to support weight of the lock ring 34, casing unit 1*c*, and casing joint 90*j*, such that the compensator 25 drifts to the hoisting position. Alternatively, the compensator 25 may be driven to the hoisting position first and the pressure regulator may be used to set a pressure at the hoisting position. The motor 1*m* and casing 1*c* units, pipe handler 1*p*, and casing joint 90*j* may be lowered by operation of the hoist 73 and a bottom coupling of the casing joint stabbed into the top coupling of the casing string 90. During stabbing, the proximity sensor 68 may be monitored by the control console 53 to detect stroking of the compensator 25 to the ready position and the hoist 73 may be locked at the ready position.

The rotary table 74 may be locked or a backup tong (not shown) may be engaged with the top coupling of the casing string 90 and the drive motors 18 may be operated to spin and tighten the threaded connection between the casing joint 90*j* and the casing string 90. The hydraulic pressure may be maintained in the linear actuator 33 corresponding to the weight of the lock ring 34, casing unit 1*c*, and casing joint 90*j* so that the threaded connection is maintained in a neutral condition during makeup. The pressure regulator of the manifold 60*m* may relieve fluid pressure from the linear actuator 33 as the casing joint 90*j* is being madeup to the casing string 90 to maintain the neutral condition while the compensator 25 strokes downward to accommodate the longitudinal displacement of the threaded connection.

Figure 6G:
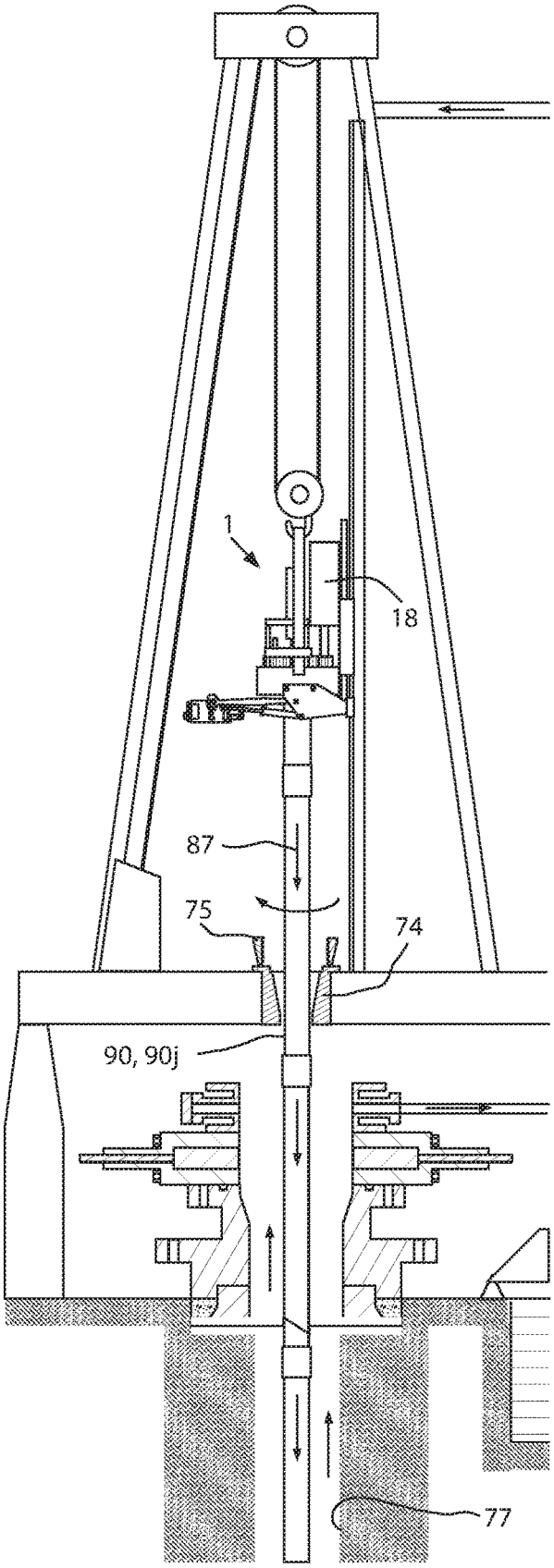
FIG. 6G illustrates running of the extended casing string into the wellbore using the modular top drive system.

FIG. 6G illustrates running of the extended casing string 90, 90*j* into the wellbore 77 using the modular top drive system 1. The manifold 60*m* may be operated to pressurize the linear actuator 33 to exert the downward preload onto the lock ring 34. The spider 75 may then be removed from the rotary table 74 to release the extended casing string 90, 90*j* and running thereof may continue. Injection of the drilling fluid 87 into the extended casing string 90, 90*j* and rotation thereof by the drive motors 18 allows the casing string to be reamed into the wellbore 77.

Alternatively, the pipe handler 1*p* may remain connected to the motor unit 1*m* and the casing joint 90*j* instead stabbed into the casing string 90 before stabbing of the spear 40 into the casing joint. Alternatively, the casing joint 90*j* may be delivered to the central axis of the well by the pipe handler 1*p* directly, held above the casing string 90, and stabbed in the spear 40 before making up the casing joint 90*j* to the casing string 90. Alternatively, the steps of FIGS. 1A, 4A-4M and 5A-5I may be omitted and the casing string 90 may be drilled into the formation 86, thereby simultaneously extending the wellbore 77 and deploying the casing string into the wellbore.

FIG. 7 illustrates cementing of the casing string 90 using the modular top drive system 1 in a cementing mode. As a shoe (not shown) of the casing string 90 nears a desired deployment depth of the casing string, such as adjacent a bottom of the formation 86, the casing unit 1*c* and pipe handler 1*p* may be used to assemble a casing hanger 90*h* with the casing string. Once the casing hanger 90*h* reaches the rig floor 7*f*, the spider 75 may be set.

The casing unit 1*c* may be released from the motor unit 1*m* and loaded onto the unit rack 1*k* by reversing the steps of FIGS. 1A and 4A-4M for the casing unit 1*c*. The top drive system 1 may then be shifted into the cementing mode by repeating the steps of FIGS. 1A and 4A-4K for the cementing unit 1*s*. The pipe handler 1*p* (not shown) may then be used to connect a work string 91 to the casing hanger 90*h* and to extend the work string until the casing hanger 90*h* seats in the wellhead 76*h*.

The work string 91 may include a casing deployment assembly (CDA) 91*d* and a work stem 91*s*, such as such as one or more joints of drill pipe 8*p* connected together, such as by threaded couplings. An upper end of the CDA 91*d* may be connected a lower end of the work stem 91*s*, such as by threaded couplings. The CDA 91*d* may be connected to the casing hanger 90*h*, such as by engagement of a bayonet lug (not shown) with a mating bayonet profile (not shown) formed the casing hanger. The CDA 91*d* may include a running tool, a plug release system (not shown), and a packoff. The plug release system may include an equalization valve and a wiper plug. The wiper plug may be releasably connected to the equalization valve, such as by a shearable fastener.

Once the casing hanger 90*h* has seated in the wellhead 76*h*, an upper end of the cement line 92 may be connected to an inlet of a cement swivel 53. A lower end of the cement line 92 may be connected to an outlet of a cement pump 93. A cement shutoff valve 92*v* and a cement pressure gauge 92*g* may be assembled as part of the cement line 92. An upper end of a cement feed line 94 may be connected to an outlet of a cement mixer 95 and a lower end of the cement feed line may be connected to an inlet of the cement pump 93.

Once the cement line 92 has been connected to the cementing swivel 53, the IBOP 38 may be closed and the drive motors 18 may be operated to rotate the work string 91 and casing string 90 during the cementing operation. The cement pump 93 may then be operated to inject conditioner 96 from the mixer 95 and down the casing string 90 via the feed line 94, the cement line 92, the cementing head 51, and a bore of the work string 91. Once the conditioner 96 has circulated through the wellbore 77, cement slurry 97 may be pumped from the mixer 95 into the cementing swivel 53 by the cement pump 93. The cement slurry 97 may flow into the launcher 54 and be diverted past the dart 55 (not shown) via the diverter and bypass passages. Once the desired quantity of cement slurry 97 has been pumped, the dart 55 may be released from the launcher 54 by operating the launcher actuator. The chaser fluid 98 may be pumped into the cementing swivel 53 by the cement pump 93. The chaser fluid 98 may flow into the launcher 54 and be forced behind the dart 55 by closing of the bypass passages, thereby launching the dart.

Pumping of the chaser fluid 98 by the cement pump 93 may continue until residual cement in the cement line 92 has been purged. Pumping of the chaser fluid 98 may then be transferred to the mud pump 78 (not shown) by closing the valve 92*v* and opening the IBOP 38. The dart 55 and cement slurry 97 may be driven through the work string bore by the chaser fluid 98. The dart 55 may land onto the wiper plug and continued pumping of the chaser fluid 98 may increase pressure in the work string bore against the seated dart 55 until a release pressure is achieved, thereby fracturing the shearable fastener. Continued pumping of the chaser fluid 98 may drive the dart 55, wiper plug, and cement slurry 97 through the casing bore. The cement slurry 97 may flow through a float collar (not shown) and the shoe of the casing string 90, and upward into the annulus.

Pumping of the chaser fluid 98 may continue to drive the cement slurry 97 into the annulus until the wiper plug bumps the float collar. Pumping of the chaser fluid 98 may then be halted and rotation of the casing string 90 may also be halted. The float collar may close in response to halting of the pumping. The work string 91 may then be lowered set a packer of the casing hanger 90*h*. The bayonet connection may be released and the work string 91 may be retrieved to the rig 7.

Additionally, the cementing head 51 may include a second launcher located below the launcher 54 and having a bottom dart and the plug release system may include a bottom wiper plug located below the wiper plug and having a burst tube. The bottom dart may be launched just before pumping of the cement slurry 97 and release the bottom wiper plug. Once the bottom wiper plug bumps the float collar, the burst tube may rupture, thereby allowing the cement slurry 97 to bypass the seated bottom plug. In a further addition to this alternative, a third dart and third wiper plug, each similar to the bottom dart and bottom plug may be employed to pump a slug of spacer fluid just before pumping of the cement slurry 97

Alternatively, the dart 55 and plug release system may be omitted, the work stem 91*s* may be made of casing instead of drill pipe, and the wiper plug may be disposed in the launcher 54. In a further variant of this alternative, the actuator swivel 53 may be omitted and the launcher may have a manual actuator, such as a release pin, instead of a hydraulic one.

Alternatively, for a liner operation (not shown) or a subsea casing operation, the drilling unit 1*d* may be used again after the casing or liner string is assembled for assembling a work string (not shown) used to deploy the assembled casing or liner string into the wellbore. The top drive system 1 may be shifted back to the drilling mode for assembly of the work string. The work string may include a casing or liner deployment assembly and a work stem of drill pipe 8*p* such that the drilling unit 1*d* may be employed to assemble the work stem by repeating the steps of FIGS. 5A-5H. The drilling step of FIG. 5I may be repeated for reaming the casing or liner string into the wellbore.

Figure 8:
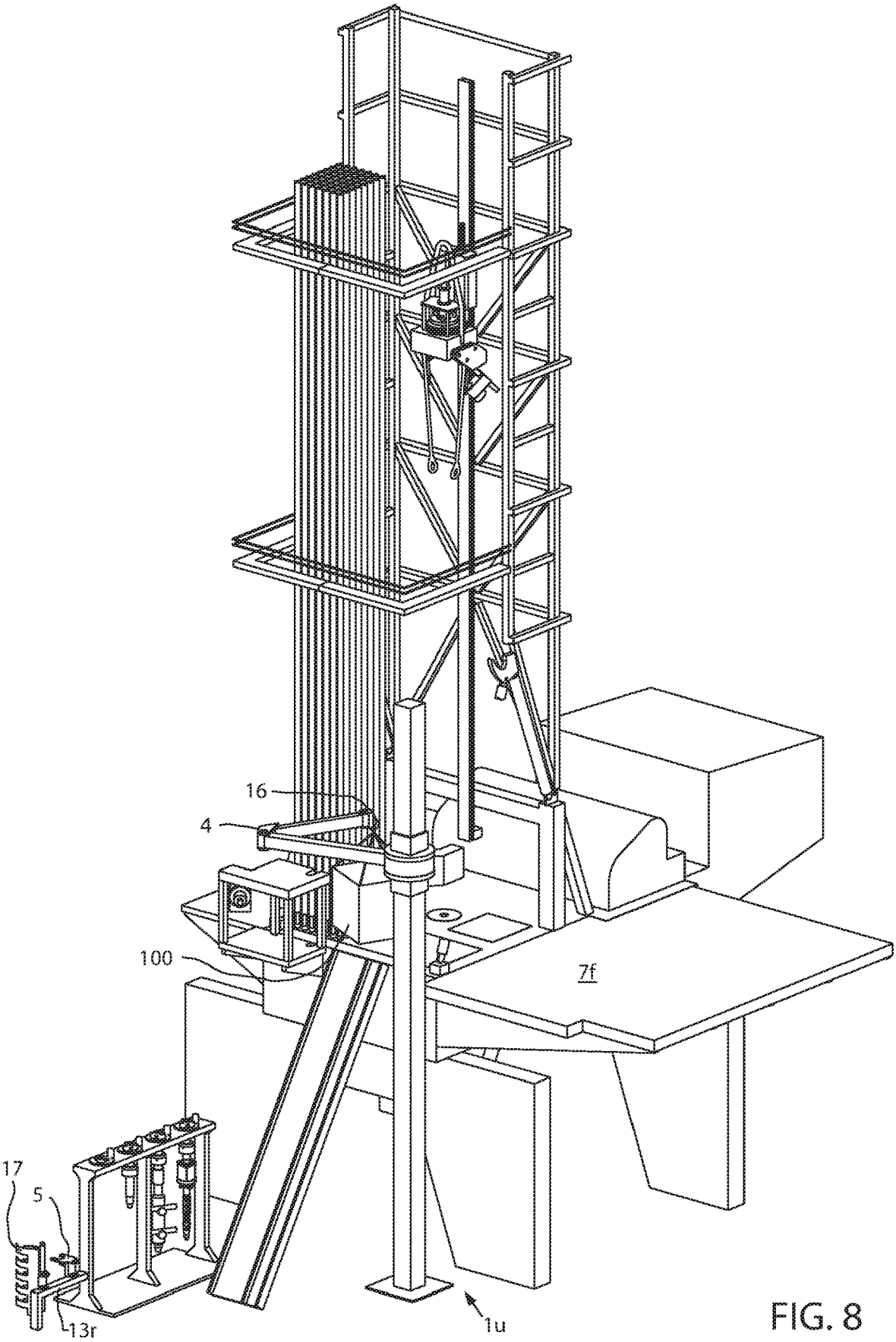
FIG. 8 illustrates the modular top drive system in a cargo mode.

FIG. 8 illustrates the modular top drive system 1 in a cargo mode. In the event that cargo 100 needs to be transported from the subfloor structure to the rig floor 7*f*, the holder 5 or pipe clamp 17 may be disconnected from the arm 4 and stowed on the side bar 13*r*. The cargo hook 16 may then be connected to the arm 4 and the unit handler 1*u* operated to engage the cargo hook with a sling wrapped about the cargo 100. The unit handler 1*u* may then be operated to raise the cargo to the rig floor 7*f*. The unit handler 1*u* may then be operated to release the cargo 100 onto the rig floor 7*f*. The cargo 100 may be spare parts for the motor unit 1*m*.

Figures 9A, 9B:
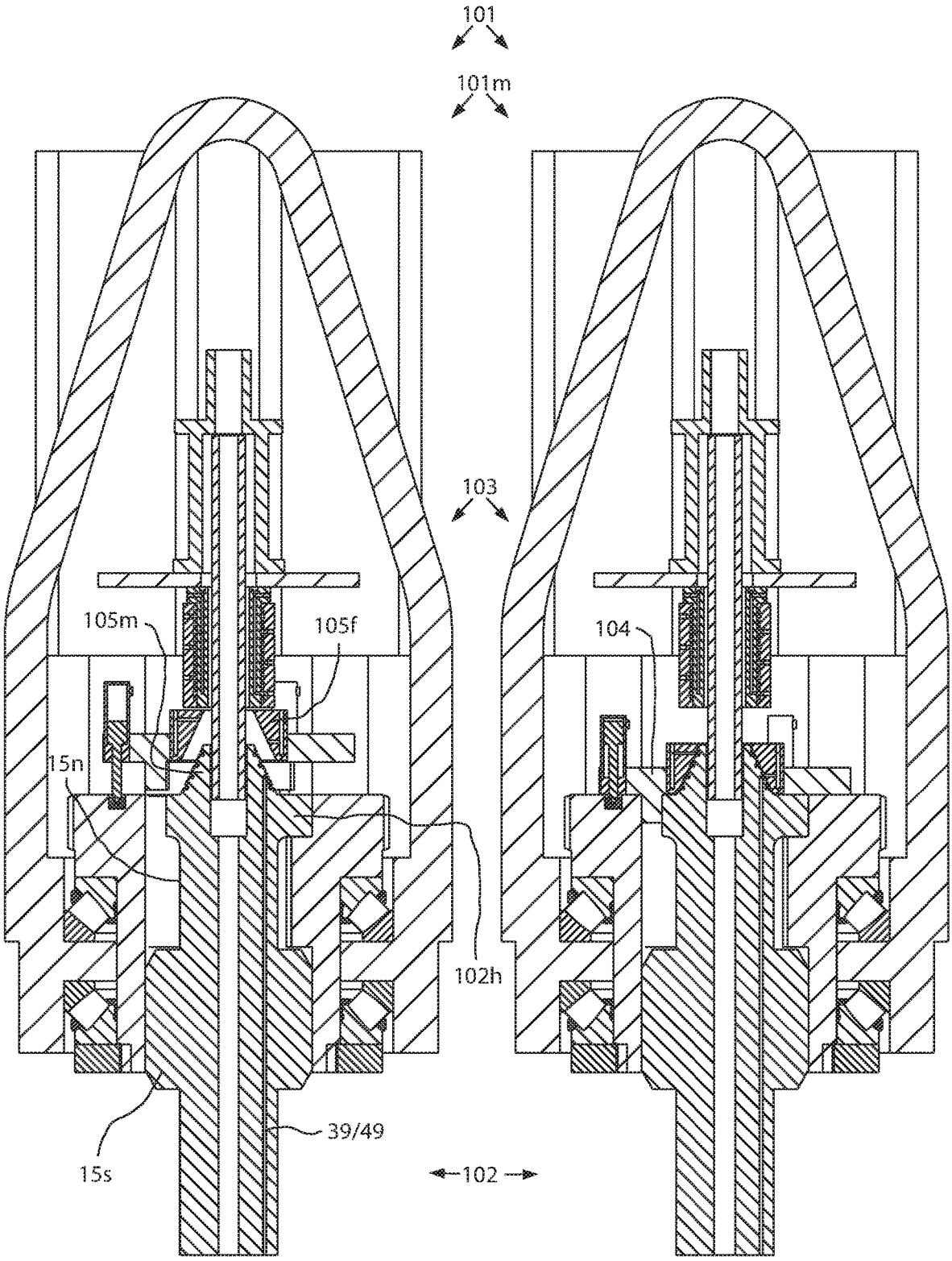
FIGS. 9A and 9B illustrates an alternative modular top drive system, according to another embodiment of the present disclosure.

FIGS. 9A and 9B illustrates an alternative modular top drive system 101, according to another embodiment of the present disclosure. The alternative modular top drive system 101 may be similar to the modular top drive system except for having an alternative motor unit 101*m* and alternative couplings 102 for each of the casing, drilling, and cementing units. The alternative motor unit 101*m* may include the drive motors 18, the becket 19, the hose nipple 20, the mud swivel 21, the drive body 22, the drive gear 23, the trolley 24, an alternative thread compensator 103, the hydraulic swivel 26, the down thrust bearing 27, the up thrust bearing 28, the backup wrench 29, the swivel frame 30, the bearing retainer 31, the motor gear 32, and the latch 57.

Each alternative coupling 102 may include a head 102*h* having an external latch profile, such as a bayonet profile, an alternative control, such as hydraulic, junction member, such as a male conical top 105*m*, the slot 15*t* (not shown) and the hydraulic passages 39/49. Each alternative coupling 102 may further include the neck 15*n*, the lifting shoulder 15*s*, and the torso 15*r*.

The alternative compensator 103 may include the linear actuator 33, an alternative lock ring 104, an alternative hydraulic junction member, such as a female member 105*f*, and the lock pins 35 (not shown). The alternative lock ring 104 may have the outer flange 34*f* formed at an upper end thereof, a bore formed therethrough, one or more chambers (not shown) housing the lock pins 35 formed in an inner surface thereof, the locking profile 34*k* formed in a lower end thereof, and passages formed through the wall thereof for the chambers. The female junction member 105*f* may be connected to the alternative lock ring 104, such as by fastening.

The alternative female junction member 105*f* may have a conical inner surface for mating with the conical top 105*m* of the respective alternative coupling 102, thereby forming an alternative hydraulic junction 105*m,f*. The alternative female member 105*f* may have nipples for receiving respective jumpers from the hydraulic swivel 26 and passages connecting the nipples and the conical inner surface. The conical top 105*m* may have seals disposed therealong for straddling the passages 39/49 and, upon mating, the passages 39/49 may be aligned with the respective passages of the female member 105*f*. The alternative hydraulic junction 105*m,f* may be formed as the alternative lock ring 104 is moved to the hoisting position by the compensator actuator 33. The alternative hydraulic junction 105*m,f* obviates the need for orientation as compared to the hydraulic junction 36.

Figure 10A:
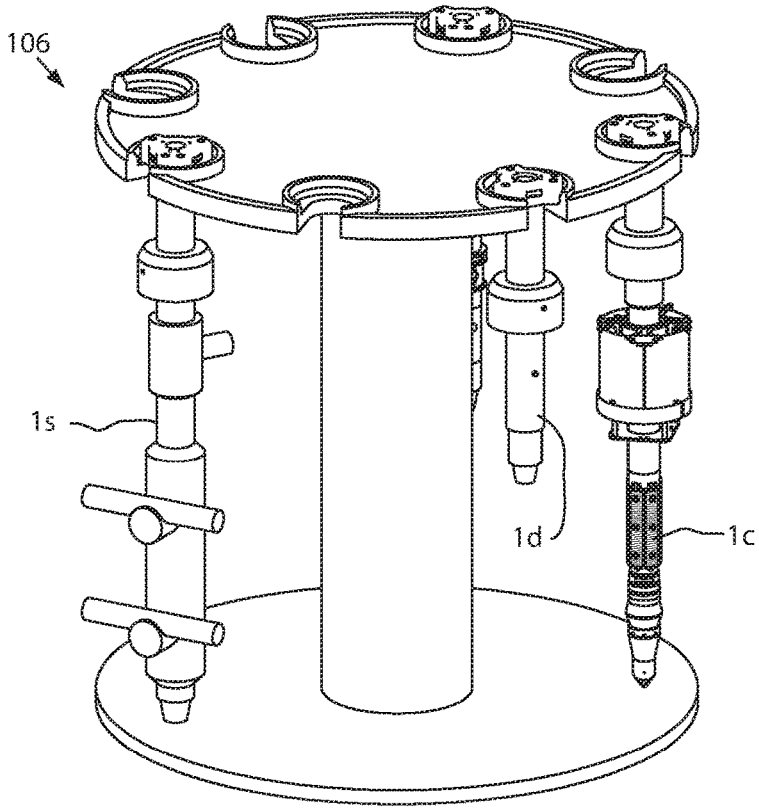
FIGS. 10A and 10B illustrate an alternative unit rack for the modular top drive system, according to another embodiment of the present disclosure.
Figure 10B:
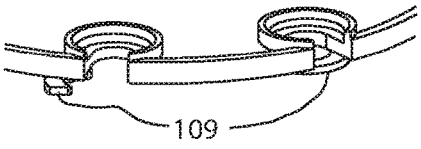

FIGS. 10A and 10B illustrate an alternative unit rack 106 for the modular top drive system 1, according to another embodiment of the present disclosure. The alternative unit rack 106 may be a carousel and may include a lower turntable, an upper disk, a shaft connecting the turntable and the disk, and a motor (not shown) for rotating the turntable. A length of the shaft may correspond to a length of the longest one of the units 1*c,d,s*, such as being slightly greater than the longest length. The disk may have parking spots (eight shown) formed therein for receiving the units 1*c,d,s*. Each unit 1*c,d,s* may be hung from the disk by engagement of a parking spot with the respective coupling 15. The carousel rack 106 may allow one of the units 1*c,d,s* to be in a maintenance/initial loading position on a back side of the carousel rack while another one of the units is in a deployment position on a front side of the carousel rack facing the unit handler 1*u*.

Alternatively, the lower turntable may be a fixed base and the upper disk may be a turntable instead.

Additionally, the alternative unit rack 106 may include a gate 109 for each parking spot. Each gate 109 may be connected to the upper disk, such as by a hinge, and may pivot relative thereto between an open position and a closed position. The alternative unit rack 106 may further include actuators (not shown) for swinging the gates 109 between the positions and each actuator may be electrically, hydraulically, mechanically (for example by weight control), or pneumatically operated. In the open position, each gate 109 may allow deposit or removal of one of the units 1*c,d,s* into the respective parking spot and in the closed position, each gate may trap the deposited unit within the parking spot to secure against escape of the deposited unit therefrom, such as due to heave of an offshore drilling unit. In one embodiment, each parking spot may include a latch profile, identical or similar to the latch profile in the latch ring 23, to secure a tool within. In one embodiment, the unit rack 106 may include an integrated tool handler. The integrated tool handler may be used to deliver a tool to and/or receive a tool from the unit handler 1*u*.

Figure 10C:
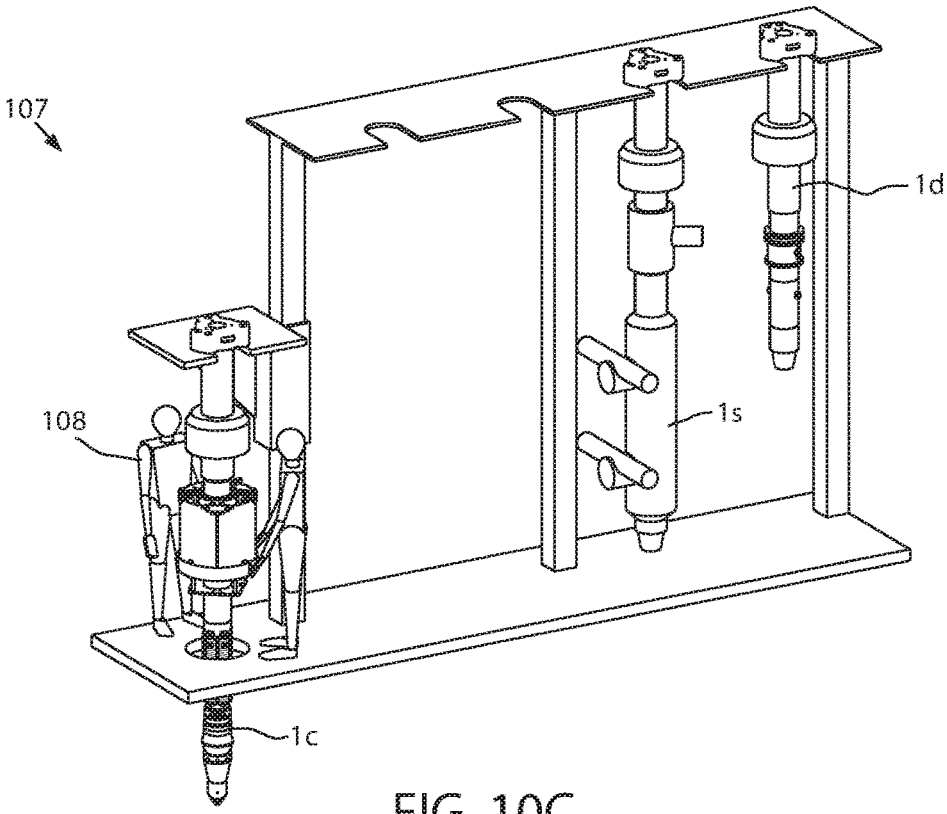
FIG. 10C illustrates a second alternative unit rack for the modular top drive system, according to another embodiment of the present disclosure.

FIG. 10C illustrates a second alternative unit rack 107 for the modular top drive, according to another embodiment of the present disclosure. The second alternative unit rack 107 may include a base, a beam, two or more (three shown) columns connecting the base to the beam, such as by welding or fastening, and a unit lift. A length of the columns may correspond to a length of the longest one of the units 1*c,d,s*, such as being slightly greater than the longest length. The columns may be spaced apart and parking spots (four shown) may be formed in the beam between adjacent columns. The units 1*c,d,s* may be hung from the beam by engagement of the parking spots with respective couplings 15 of the units. In one embodiment, each parking spot may include a latch profile, identical or similar to the latch profile in the latch ring 23, to secure a tool within. In one embodiment, the unit rack 107 may include an integrated tool handler. The integrated tool handler may be used to deliver a tool to and/or receive a tool from the unit handler 1*u*. The unit lift may include a slider transversely connected to one of the columns, a linear actuator (not shown) for raising and lowering the slider along the column, and an opening formed through the base for receiving a lower portion of one of the units 1*c,d,s* (casing unit 1*c* shown extending through opening). The slider may have a parking spot so one of the units 1*c,d,s* may be hung therefrom and raised and lowered as necessary to facilitate access by a technician 108 (pair shown) standing on the base or subfloor structure. The technician 108 may access the unit 1*c,d,s* for initial assembly thereof or maintenance thereof.

Additionally, the second alternative unit rack 107 may also have the side bar 13*r*. Alternatively, the unit lift may be located in a separate rack.

Figure 11A:
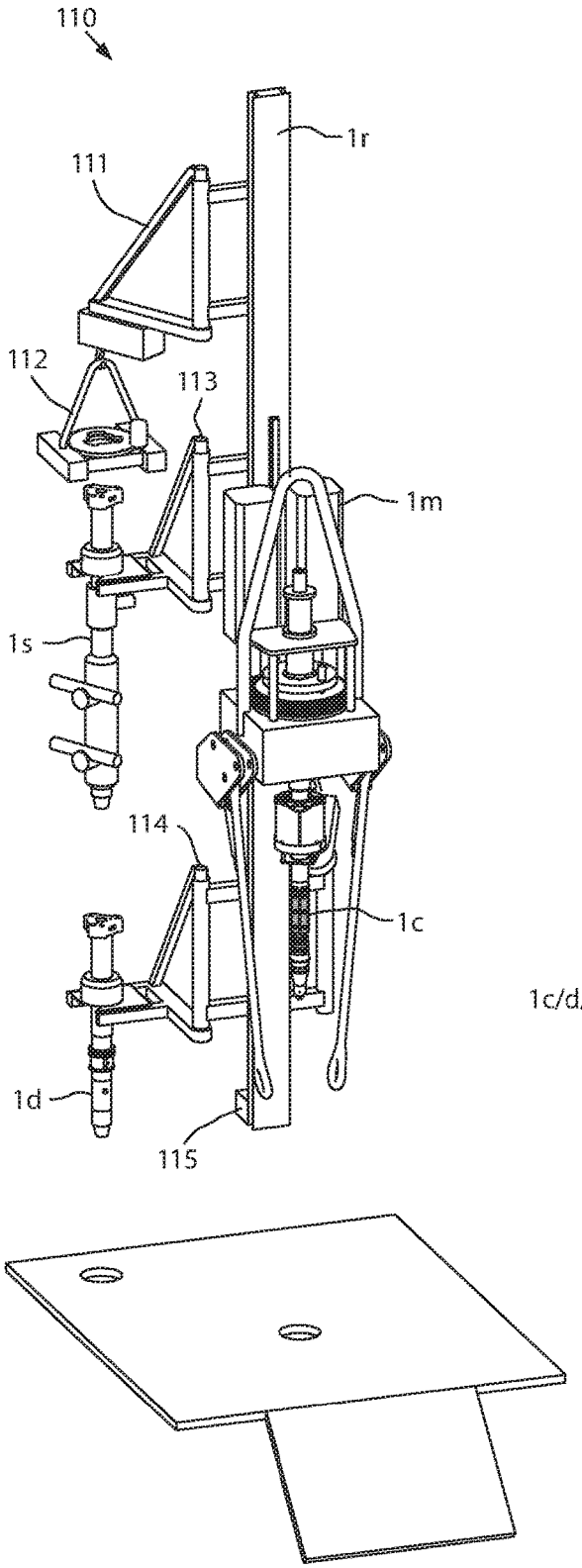
FIGS. 11A-11C illustrate an alternative unit handler for the modular top drive system, according to another embodiment of the present disclosure.
Figure 11B:
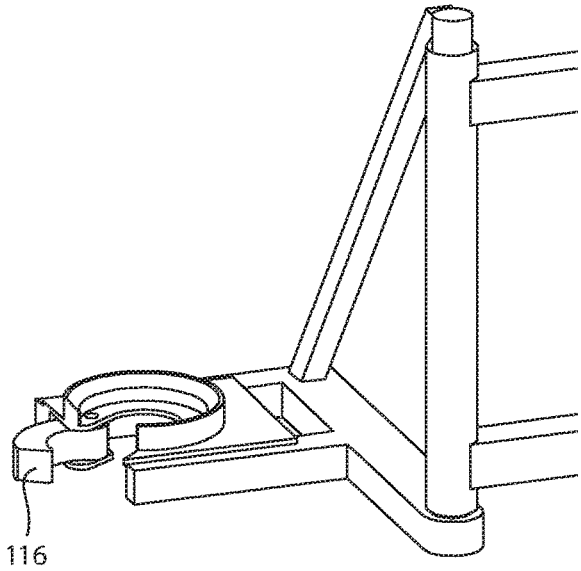
Figure 11C:
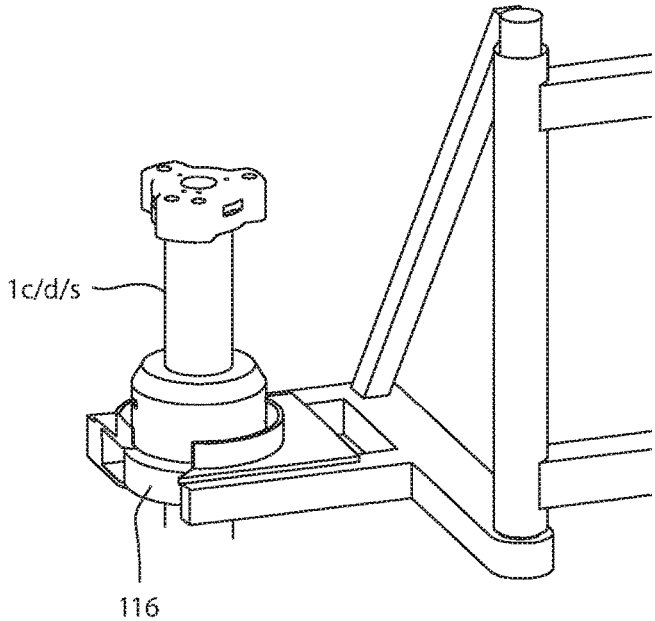

FIGS. 11A-11C illustrates an alternative unit handler 110 for the modular top drive system 1, according to another embodiment of the present disclosure. The alternative unit handler 110 may include the rail 1*r*, a crane 111, a sling 112, an upper bracket 113, a lower bracket 114, and a linear actuator 115.

The crane 111 may include a boom, a hinge, a winch, and a hook. The winch may include a housing, a drum (not shown) having a load line (not shown) wrapped therearound, and a motor (not shown) for rotating the drum to wind and unwind the load line. The load line may be wire rope. The winch motor may be electric, hydraulic, or pneumatic. The winch housing may be connected to the boom, such as by fastening. The hook may be fastened to an eye splice formed in an end of the load line. The boom may be connected to the hinge, such as by fastening. The hinge may be connected to a back of the rail 1*r*, such as by fastening. The hinge may longitudinally support the boom from the rail 1*r* while allowing pivoting of the boom relative to the rail between a standby position (shown) and a transfer position (not shown) one-quarter turn or so toward the motor unit 1*m*. The sling 112 may include a becket, a frame, and a parking spot similar to the parking spot 14.

Alternatively, the hinge may be connected to the derrick 7*d* for supporting the boom from the derrick instead of the rail 1*r*. Additionally, the crane 111 may further include an electric or hydraulic slew motor (not shown) for pivoting the boom about the hinge. Additionally, the crane 111 may further include a guide rail (not shown) connected, such as by fastening, to the boom and the sling frame may have a groove (not shown) engaged with the guide rail, thereby preventing swinging of the sling 112 relative to the crane.

The upper bracket 113 may include a holder and a hinge. In a standby position, one of the units (cementing unit 1*s* shown) may be seated on the holder clear from the motor unit 1*m*. The holder may be connected to the hinge, such as by fastening. The hinge may be connected to the back of the rail 1*r*, such as by fastening. The hinge may longitudinally support the holder from the rail while allowing pivoting of the holder relative to the rail between the standby position (shown), a loading position (not shown) in alignment with the motor unit 1*m*, and a transfer position midway between the standby position and the loading position (corresponding to the crane transfer position). The upper bracket 113 may further include an electric or hydraulic slew motor (not shown) for pivoting the holder about the hinge.

The lower bracket 114 may include a holder and a slide hinge. In the standby position, one of the units (drilling unit 1*d* shown) may be seated on the holder clear from the motor unit 1*m*. The holder may be connected to the slide hinge, such as by fastening. The slide hinge may be transversely connected to the back of the rail 1*r* such as by a slide joint, while being free to move longitudinally along the rail between the standby position (shown) and a maintenance position similar to that shown in FIG. 10B. The slide hinge may also be pivotally connected to the linear actuator 115, such as by fastening. The slide hinge may longitudinally support the holder from the linear actuator 115 while allowing pivoting of the holder relative to the rail between the standby position (shown), a loading position (not shown) in alignment with the motor unit 1*m*, and a transfer position midway between the standby position and the loading position (corresponding to the crane transfer position). The lower bracket 114 may further include an electric or hydraulic slew motor (not shown) for pivoting the holder about the slide hinge.

Alternatively, the rail 1*r* may be twin rails instead of the monorail 2 and each bracket 113, 114 may be located in a space between the twin rails. Each bracket 113, 114 in this alternative may have a linear actuator instead of the respective hinge. Each alternative linear actuator may be connected to the twin rails or to the derrick 7*d* for supporting the respective holder therefrom and be operable to transversely move the respective holder between an online position aligned with the motor unit 1*m* and an offline position clear of the motor unit. The crane 111 in this alternative may also have a linear actuator for transverse movement. Alternatively, the linear actuator may move sideways.

The linear actuator 115 may include a base connected to the back of the rail 1*r*, such as by fastening, a cylinder (not shown) pivotally connected to the base, and a piston (not shown) pivotally connected to the slide hinge and disposed in a bore of the cylinder. The piston may divide the cylinder bore into a raising chamber and a lowering chamber and the cylinder may have ports formed through a wall thereof and each port may be in fluid communication with a respective chamber. Each port may be in fluid communication with the HPU manifold 60*m* via a control line (not shown). Supply of hydraulic fluid to the raising port may move the drilling unit 1*d* to the standby position. Supply of hydraulic fluid to the lowering port may move the drilling unit 1*d* to the maintenance position. The rig floor 7*f* may have an opening formed therethrough for receiving the lower portion of the drilling unit 1*d* in the maintenance position for accessibility thereof by the rig technician 108.

Additionally, the linear actuator 115 may be movable to a second maintenance position (not shown) for the casing unit 1*c* and a third maintenance position (not shown) for the cementing unit 1*s*. Additionally, the linear actuator 115 may be movable to more than one maintenance position for any or all of the casing 1*c*, drilling 1*d*, and cementing 1*s* units and may be able to stop at each maintenance position. For example, when the lower bracket 114 is holding the casing unit 1*c*, the linear actuator 115 may be movable to an upper maintenance position for servicing or replacing a fill up tool 50 of the casing unit, a mid maintenance position for servicing or replacing slips 45 of the casing unit, and/or a lower maintenance position for accessing a linear actuator 41 of the casing unit.

Alternatively, the linear actuator 115 may include an electro-mechanical linear actuator, such as a motor and lead screw or pinion and gear rod, instead of the piston and cylinder assembly. Alternatively, the linear actuator 115 may include a hydraulic and/or a pneumatic linear actuator.

The crane 111 may be operable to transfer any of the units 1*c,d,s* on either one the brackets 113, 114 to the other bracket by moving the crane and the bracket holding the unit to the transfer position, engaging the sling 112 with the coupling 15, and raising or lowering the unit to a position in alignment with the other bracket 113, 114. The other bracket may then be moved to the transfer position, and the sling operated to release the unit 1*c,d,s* onto the other bracket.

Alternatively, the alternative unit handler 110 may be used in conjunction with the unit handler 1*u* as follows. Instead of the unit handler 1*u* delivering or retrieving one of the units 1*c,d,s* directly to/from the motor unit 1*m*, the unit handler may instead deliver or retrieve the unit to/from one of the brackets 113, 114 and the bracket may be operated to deliver or retrieve the unit to/from the motor unit. In a further variant of this alternative, one of the brackets 113, 114 may be used with the unit handler 1*u* as follows. The unit handler 1*u* may deliver one of the units 1*c,d,s* to the bracket 113, 114 while the motor unit 1*m* is using another one of the units. The unit handler 1*h* may then retrieve the used unit from the motor unit 1*m* and deliver the used unit to the rack 1*k*. As soon as the unit handler 1*h* has retrieved the used unit, the bracket 113, 114 may be operated to deliver the currently held unit to the motor unit 1*m*.

Additionally, the alternative unit handler 110 may include a gate 116 for each bracket 113, 114. Each gate 116 may be connected to the respective bracket 113, 114, such as by a hinge, and may pivot relative thereto between an open position and a closed position. The alternative unit handler 110 may further include actuators (not shown) for swinging the gates 116 between the positions and each actuator may be electrically, hydraulically, or pneumatically operated. In the open position, each gate 116 may allow deposit or removal of one of the units 1*c,d,s* into the holder and in the closed position, each gate may trap the deposited unit within the holder to secure against escape of the deposited unit therefrom, such as due to heave of an offshore drilling unit.

Alternatively, each gate 116 may be mechanically operated, the hinge thereof may have a torsion spring biasing the gate toward the open position, and the alternative unit handler 110 may include latches operable to fasten the gates in the closed position. Each latch may be released by: a pin on the motor unit 1*m* that releases the latch if the respective bracket 113, 114 is proximate thereto, a linkage that is operated by rotation of the respective bracket toward the motor unit (opens when bracket is aligned with motor unit), and/or a pin on the sling 112 that releases the latch if the respective bracket 113, 114 is proximate thereto.

Figure 12:
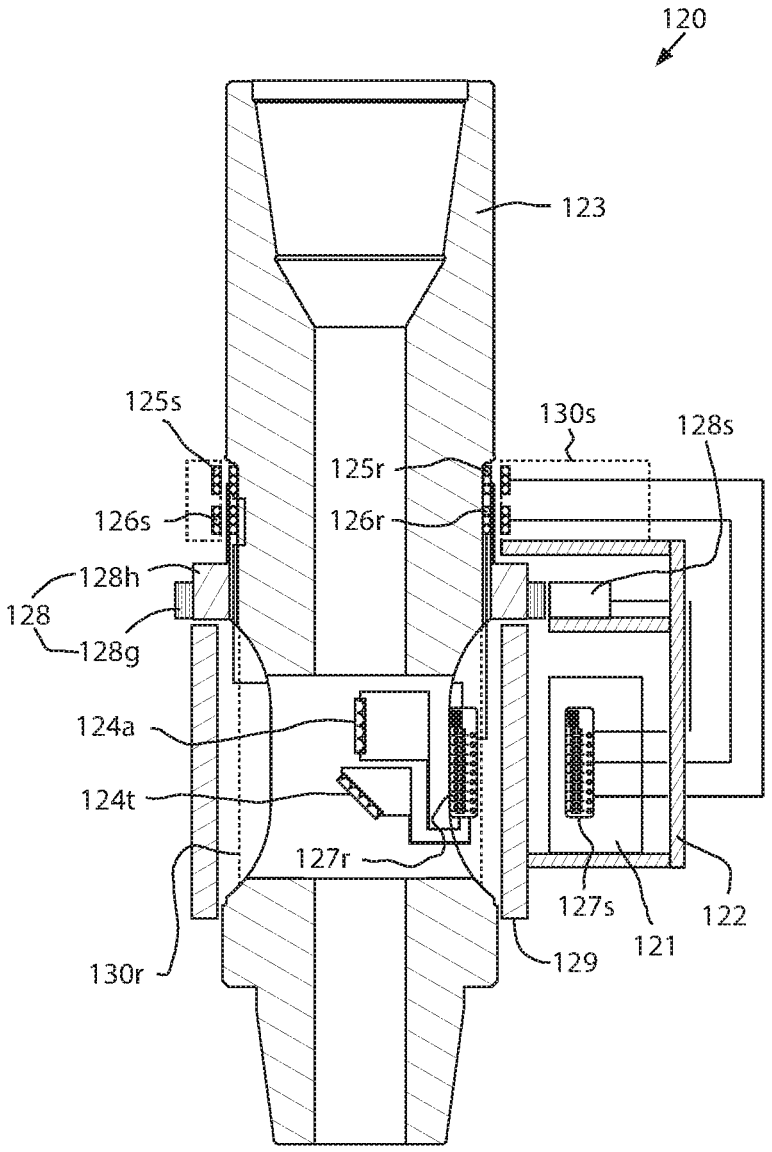
FIG. 12 illustrates a torque sub accessory for the modular top drive system, according to another embodiment of the present disclosure.

FIG. 12 illustrates a torque sub accessory 120 for the modular top drive system 1, according to another embodiment of the present disclosure. The torque sub 120 may include an outer non-rotating interface 121, an interface frame 122, an inner torque shaft 123, one or more load cells 124*a,t*, one or more wireless couplings 125*r,s*, 126*r,s*, a shaft electronics package 127*r*, an interface electronics package 127*s*, a turns counter 128, and a shield 129.

The torque shaft 123 may be tubular, may have a bore formed therethrough, and may have couplings, such as a threaded box or pin, formed at each end thereof. The torque shaft 123 may have a reduced diameter outer portion forming a recess in an outer surface thereof. The load cell 124*t* may include a circuit of one or more torsional strain gages and the load cell 124*a* may include a circuit of one or more longitudinal strain gages, each strain gage attached to an outer surface of the reduced diameter portion, such as by adhesive. The strain gages may each be made from metallic foil, semiconductor, or optical fiber.

Additionally, the load cell 124*a* may include a set of strain gages disposed around the torque shaft 123 such that one or more bending moments exerted on the torque shaft may be determined from the strain gage measurements.

The wireless couplings 125*r,s*, 126*r,s* may include wireless power couplings 125*r,s* and wireless data couplings 126*r,s*. Each set of couplings 125*r,s*, 126*r,s* may include a shaft member 125*s*, 126*s* connected to the torque shaft 123 and an interface member housed in an encapsulation 130*s* connected to the frame 122. The wireless power couplings 125*r,s* may each be inductive coils and the wireless data couplings 126*r,s* may each be antennas. The shaft electronics may be connected by leads and the electronics package 127*r*, load cells 124*a,t*, and antenna 126*r* may be encapsulated 130*r* into the recess. The shield 129 may be located adjacent to the recess and may be connected to the frame 122 (shown) or connected to the shaft 123 (not shown). The frame 122 may be may be connected to the top drive frame by a bracket (not shown).

Alternatively, the torque shaft 123 may carry a power source, such as a battery, capacitor, and/or inductor, and the wireless power couplings 125*r,s* may be omitted or used only to charge the power source.

The shaft electronics package 127*r* may include a microcontroller, a power converter, an ammeter and a transmitter. The power converter may receive an AC power signal from the power coupling and convert the signal to a DC power signal for operation of the shaft electronics. The DC power signal may be supplied to the load cells 124*a,t* and the ammeter may measure the current. The microcontroller may receive the measurements from the ammeter and digitally encode the measurements. The transmitter may receive the digitally encoded measurements, modulate them onto a carrier signal, and supply the modulated signal to the antenna 126*r*.

The interface antenna 126*s* may receive the modulated signal and the interface electronics package 127*s* may include a receiver for demodulating the signal. The interface package 127*s* may further include a microcontroller for digitally decoding the measurements and converting the measurements to torque and longitudinal load. The interface package 127*s* may send the converted measurements to the control console 62 via a data cable (not shown). The interface package 127*s* may further include a power converter for supplying the interface data coupling with the AC power signal. The interface package 127*s* may also be powered by the data cable or include a battery.

The turns counter 128 may include a base 128*h* torsionally connected to the shaft, a turns gear 128*g* connected to the base, and a proximity sensor 128*s* connected to the frame 122 and located adjacent to the turns gear. The turns gear 128*g* may be made from an electrically conductive metal or alloy and the proximity sensor 128*s* may be inductive. The proximity sensor 128*s* may include a transmitting coil, a receiving coil, an inverter for powering the transmitting coil, and a detector circuit connected to the receiving coil. A magnetic field generated by the transmitting coil may induce an eddy current in the turns gear 128*g*. The magnetic field generated by the eddy current may be measured by the detector circuit and supplied to the interface controller. The interface controller may then convert the measurement to angular movement and/or speed and supply the converted measurement to the control console 53.

Alternatively, the proximity sensor 128*s* may be Hall effect, ultrasonic, or optical. Alternatively, the turns counter 128 may include a gear box instead of a single turns gear 128*g* to improve resolution.

A torque sub 120 may be added to any or all of: the drilling unit 1*d*, casing unit 1*c*, and cementing unit 1*s*. If added to the drilling unit 1*d* or the cementing unit 1*c*, the torque shaft 123 may be connected to the quill 37 or and the interface frame 122 may be hung from a bottom of the drive body 22. If added to the casing unit 1*c*, the torque shaft 123 may be connected between the coupling 15 and the collar 43 and the interface frame 122 may be hung from the bottom of the drive body 22.

Alternatively, the torque sub 120 may be added to the motor unit 1*m* instead of the drilling 1*d*, casing 1*c*, and/or cementing 1*s* units.

During the drilling operation, the torque sub 120 may be used to monitor torque, longitudinal load, and angular velocity for instability, such as sticking of the drill string 8 or collapse of the formation 86. The torque sub 120 may also be used to monitor make up of the threaded connections between the stands 8*s* whether for drilling or for a work string. During the casing operation, the torque sub 120 may be used to monitor torque, turns, and the derivative of torque with respect to turns to ensure that the threaded connections between the casing joints 90*j* are properly made up. During the cementing operation, the torque sub 120 may be used to monitor curing of the cement slurry 97 by measuring the torsional resistance thereof.

Latch profiles between a motor unit and a tool unit of the present disclosure may be any suitable profiles. Instead of bayonet profiles, movable latch profiles, enabled by bolts, locking blocks, or other suitable structures, may be used to joined a top drive unit and a tool unit. In one embodiment, the latch profile in the motor unit and/or in the tool unit may be a movable latch profile. The latch profile may move between an open position to allow inserting and removal of a tool and a closed position to transfer torsional and/or torsional loads.

Figure 13A:
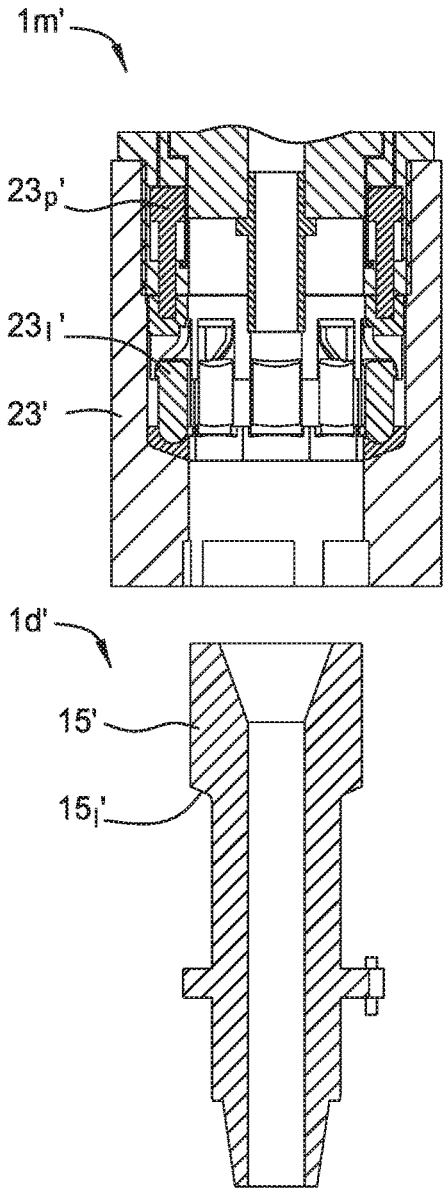
FIGS. 13A and 13B schematically illustrate a top drive unit having a movable latch profile according to one embodiment of the present disclosure.
Figure 13B:
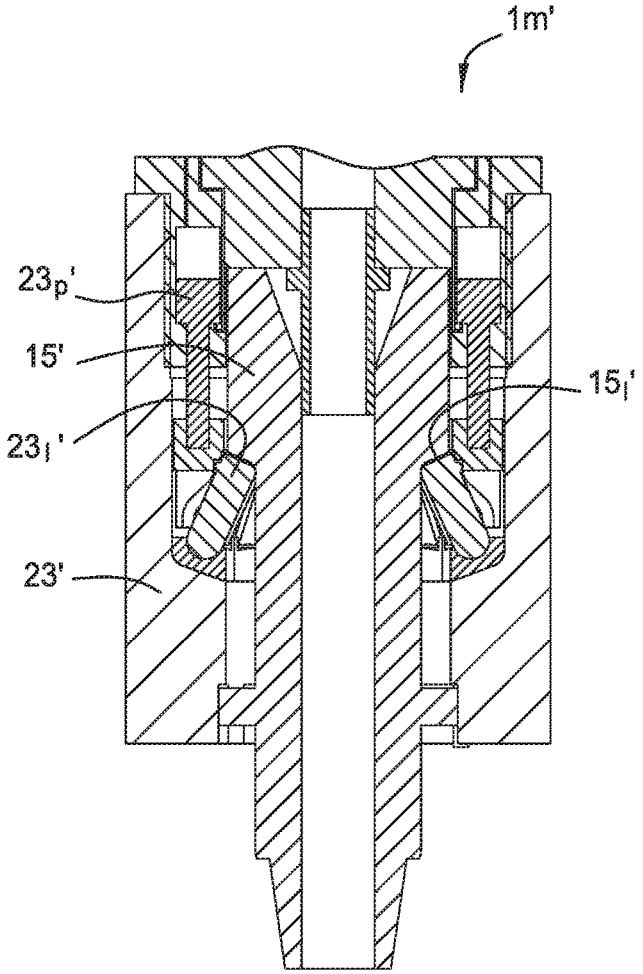

FIGS. 13A and 13B schematically illustrate a top drive unit 1*m*' having a movable latch profile to connect with a tool unit 1*d*'. In FIG. 13A, the top drive unit 1*m*' is in an open position. In FIG. 13B, the top drive unit 1*m*' is in a closed position. The top drive unit 1*m*' may include a drive ring 23'. In one embodiment, the drive ring 23' may be connected to a rotor of a drive motor. The drive ring 23' may include a plurality of locking blocks 23*l*' disposed along an inner surface of the drive ring 23'. In the open position, the plurality of locking blocks 23*l*' may be in an upper right position to allow a coupling 15' of the tool unit 1*d*' to enter drive ring 23'. In the closed position, the plurality of locking blocks 23*l*' may be tilted radially inward forming a latch profile to lock with a latch profile 15*l*' of on the coupling 15'. In one embodiment, the locking block 23*l*' may be moved between the open position and the closed position by one or more actuators 23*p*'. In one embodiment, the actuator 23*p*' may be a linear actuator. In one embodiment, control junctions, such as hydraulic junctions, electric junctions, pneumatic junctions, data junctions, and/or signal junctions may be formed in the drive ring 23' and the coupling 15' to connect pressured fluids, electrical power or signals, and/or data between the top drive unit 1*m*' and the tool unit 1*d*'. In one embodiment, the top drive unit 1*m*' does not include a thread compensator, such as the compensator 25 in the motor unit 1*m*. Alternatively, a compensator, similar to the compensator 25 may be connected to the drive ring 23'.

It should be noted that the various embodiments to the top drive units, the rack units, the handler units, and the tool units may be exchanged, mixed, and/or combined to achieve desired results.

Even though embodiments described above relate to connecting a tool to a top drive unit, latch profiles according to the present disclosure may be used to connect any tubulars, such as connecting a tool to a suitable devices or an adaptor, connecting an adaptor to a top drive unit, connecting a tool to a handler, connecting a tool to a storage unit, and the like.

One embodiment of the present disclosure may include a top drive comprising a drive body, and a drive ring rotationally coupled the drive body, wherein the drive ring has an internal latch profile for selectively receiving a tool.

One embodiment of the present disclosure may include a top drive comprising a drive motor, and a drive ring torsionally coupled to a rotor of the drive motor, wherein the drive ring has an internal latch profile for selectively receiving a tool.

One embodiment of the present disclosure provides a modular top drive system for construction of a wellbore. The system includes a motor unit comprising a drive body, a drive motor having a stator connected to the drive body, a trolley for connecting the drive body to a rail of a drilling rig, and a drive ring torsionally connected to a rotor of the drive motor and having a latch profile for selectively connecting one of: a drilling unit, a casing unit, and a cementing unit to the motor unit.

In one or more embodiment, the system further includes a unit handler locatable on or adjacent to a structure of the drilling rig and operable to retrieve any one of the drilling, casing, and cementing units from a rack and deliver the retrieved unit to the motor unit.

In one or more embodiment, the unit handler comprises a base for mounting the unit handler to a subfloor structure of the drilling rig, a post extending from the base to a height above a floor of the drilling rig, a slide hinge transversely connected to the post, and an arm connected to the slide hinge.

In one or more embodiment, the arm comprises a forearm segment, an aft-arm segment, and an actuated joint connecting the arm segments, and the unit handler further comprises a holder connected to the forearm segment and operable to engage a torso of each of the drilling, casing, and cementing units.

In one or more embodiment, the system further comprises the drilling, casing, and cementing units, each unit having a coupling and each coupling having a head with a latch profile for mating with the latch profile of the drive ring.

In one or more embodiment, the latch profiles are bayonet profiles.

In one or more embodiment, the couplings of the drilling, casing, and cementing units each further have a neck extending from the head, a lifting shoulder connected to a lower end of the neck, and a torso extending from the lifting shoulder.

In one or more embodiment, wherein the motor unit further comprises a thread compensator. The thread compensator includes a lock ring torsionally connected to the drive ring, a linear actuator for moving the lock ring relative to the drive ring between a ready position and a hoisting position, and a lock pin for selectively connecting any one of the drilling, casing, and cementing units to the lock ring.

In one or more embodiment, a flange of the lock ring is engaged with the drive ring in the hoisting position, each of the drive ring and lock ring has a locking profile for locking the mated latch profiles together, and the linear actuator is also for moving the selectively connected unit to the ready position.

In one or more embodiment, the lock ring and each coupling head each have a stab connector of a control junction.

In one or more embodiment, the thread compensator further comprises a stab connector of a control junction connected to the lock ring and having a plurality of passages formed therethrough, each coupling head has a stab connector of the control junction having a plurality of passages formed therethrough, and each stab connector is at least partially conical.

In one or more embodiment, the motor unit further comprises a proximity sensor connected to the drive body for monitoring a position of the lock ring.

In one or more embodiment, the motor unit further comprises a becket connected to the drive body for receiving a hook of a traveling block, a swivel frame connected to the drive body, a mud swivel comprising an outer barrel connected to the swivel frame and an inner barrel having an upper portion disposed in the outer barrel and a stinger portion for stabbing into a seal into a seal receptacle of any of the couplings, a nipple connected to the outer barrel for receiving a mud hose, a down thrust bearing for supporting the drive ring for rotation relative to the drive body.

In one or more embodiment, the motor unit further comprises a control swivel, the control swivel comprises an outer barrel and an inner barrel having a head portion connected to the swivel frame and a mandrel portion extending along the outer barrel, and the stinger portion of the mud swivel extends through the control swivel.

In one or more embodiment, the motor unit further comprises a backup wrench, and the backup wrench comprises: an arm, a hinge connecting the arm to the drive body, and a tong connected to the arm and movable along the arm.

In one or more embodiment, the system further includes the rack having a parking spot for each of the drilling, casing, and cementing units.

In one or more embodiment, the system further comprises a unit handler locatable on or adjacent to a structure of the drilling rig and operable to retrieve any one of the drilling, casing, and cementing units from a rack and deliver the retrieved unit to the motor unit, and the rack further comprises a side bar for holding accessories of the unit handler.

In one or more embodiment, the rack comprises a turntable, a disk, and a shaft, and the disk has the parking spots formed therein.

In one or more embodiment, the rack further comprises a gate for each parking spot, each gate hinged to the disk for pivoting between an open position and a closed position for trapping one of the drilling, casing, and cementing units in the respective parking spot.

In one or more embodiment, the system further includes a unit handler locatable on or adjacent to a structure of the drilling rig and operable to retrieve any one of the drilling, casing, and cementing units from a rack and deliver the retrieved unit to the motor unit, and an accessory rack for holding accessories of the unit handler.

In one or more embodiment, the rack comprises a base, a beam, two or more columns connecting the base to the beam, and a unit lift, the parking spots are formed in the beam, and the unit lift comprises a slider connected to one of the columns and having an additional parking spot and an opening formed through the base for receiving a lower portion of any of the drilling, casing, and cementing units.

In one or more embodiment, each of the drilling and cementing units comprises an internal blowout preventer (IBOP) disposed in a bore of the respective unit, a quill connected to the respective coupling, and a passage extending from the head to an actuator of the IBOP.

In one or more embodiment, the cementing unit further comprises a cementing swivel. The cementing swivel comprises a housing having an inlet formed through a wall thereof for connection of a cement line, a mandrel connected to the respective quill and having a port formed through a wall thereof in fluid communication with the inlet, a bearing for supporting rotation of the mandrel relative to the housing, and a seal assembly for isolating the inlet-port communication.

In one or more embodiment, the cementing unit further comprises a launcher. The launcher comprises a body connected to the mandrel of the cementing swivel, a dart disposed in the launcher body, and a gate having a portion extending into the launcher body for capturing the dart therein and movable to a release position allowing the dart to travel past the gage.

In one or more embodiment, the casing unit comprises a clamp. The clamp comprises a set of grippers for engaging a surface of a joint of casing, thereby anchoring the casing joint to the casing unit, and an actuator for selectively engaging and disengaging the clamp with a casing joint, and a stab seal for engaging an inner surface of the casing joint.

In one or more embodiment, the clamp further comprises a mandrel having the grippers disposed thereon, a collar longitudinally and torsionally connecting the mandrel to the respective coupling, and a seal tube fluidly connecting the mandrel and the respective coupling.

In one or more embodiment, the casing unit further comprises a fill up tool comprising a stab seal, a mud saver valve, and a release valve.

In one or more embodiment, the system further comprises a video camera mounted to the motor unit for monitoring alignment of the latch profiles.

In one or more embodiment, the system further comprises a pipe handler. The pipe handler includes a pair of bails, a slide hinge for connecting the bails to the rail, a link tilt pivotally connected to the slide hinge and each bail for swinging the bails relative to the slide hinge, and a linear actuator for moving the slide hinge relative to the motor unit, wherein the motor unit further comprises a latch for selectively connecting the slide hinge to the drive body.

In one or more embodiment, a linear motor is coupled to the pipe handler.

In one or more embodiment, the linear actuator comprises a gear rack pivotally connected to the slide hinge, and a pinion motor comprising a stator connected to the drive body and a rotor meshed with the rack.

In one or more embodiment, the system further comprises the rail for connection to at least one of: a floor and a derrick of the drilling rig.

In one or more embodiment, the system further comprises a torque sub for assembly with one of the units. The torque sub comprises a non-rotating interface, a torque shaft, a strain gage disposed on the torque shaft and oriented to measure torque exerted on the torque shaft, a transmitter disposed on the torque shaft and in communication with the strain gage, the transmitter operable to wirelessly transmit the torque measurement to the interface, a turns gear torsionally connected to the torque shaft, and a proximity sensor connected to the interface and located adjacent to the turns gear.

In one or more embodiment, the system further includes a set of strain gages. Each strain gage is disposed on the torque shaft and oriented to measure longitudinal load exerted on the torque shaft, and the set is spaced around the torque shaft for measurement of a bending moment exerted on the torque shaft.

In one or more embodiment, the system further includes at least one rail for connection to at least one of: a floor and a derrick of a drilling rig, a bracket for holding any one of the drilling, casing, and cementing units and movable relative to the rail between a standby position and a connection position, wherein the unit held by the bracket is aligned with the motor unit in the connection position and clear of the motor unit in the standby position.

In one or more embodiment, the system further includes a unit handler locatable on or adjacent to a subfloor structure of the drilling rig and operable to retrieve any one of the drilling, casing, and cementing units from a rack and deliver the retrieved unit to the bracket, and retrieve any one of the drilling, casing, and cementing units from the motor unit and deliver the retrieved unit to the rack.

In one or more embodiment, the system further includes a gate hinged to the bracket for pivoting between an open position and a closed position for trapping one of the drilling, casing, and cementing units in a holder of the bracket.

Another embodiment of the present disclosure provides a method for operating a modular top drive system. The method includes retrieving a drilling unit from a unit rack located below a floor of a drilling rig, raising the retrieved drilling unit to or above the rig floor, delivering the retrieved drilling unit to a motor unit connected to a rail of the drilling rig, aligning a latch profile of the motor unit with a latch profile of the drilling unit, inserting the drilling unit into the motor unit, and engaging the latch profiles, thereby connecting the drilling unit to the motor unit.

In one or more embodiment, the method further includes operating a compensator of the motor unit to lower a lock ring thereof into engagement with the engaged latch profiles, thereby torsionally locking the profiles, and engaging one or more lock pins carried by the lock ring with the drilling unit, thereby connecting the drilling unit to the lock ring.

In one or more embodiment, lowering of the lock ring also assembles a control junction between the motor and drilling units.

In one or more embodiment, the method further includes operating a backup wrench of the motor unit to move a tong along an arm of the backup wrench until the tong is positioned adjacent to a quill of the drilling unit.

In one or more embodiment, the method further includes releasing a pipe handler from the motor unit, lowering the released pipe handler to position an elevator adjacent to a top coupling of a stand of drill pipe, closing the elevator to grip the stand, raising the gripped stand and operating a link tilt of the pipe handler to swing the stand into alignment with the quill, raising the pipe handler and the gripped stand to engage the top coupling with the quill, engaging the backup tong with the top coupling, and operating the motor unit to screw the quill into the top coupling while operating the compensator to maintain a neutral condition.

In one or more embodiment, the method further includes the pipe handler and gripped stand are further raised after engagement of the top coupling with the quill to stroke the compensator from a hoisting position to a ready position.

In one or more embodiment, the method further includes releasing the elevator and backup tong from the stand, lowering the motor and drilling units to stab the connected stand into a drill or work string, and operating the motor unit to screw the stand into the drill or work string while operating the compensator to maintain a neutral condition, thereby extending the drill or work string.

In one or more embodiment, the method further includes replacing the drilling unit with a casing unit from the unit rack, releasing a pipe handler from the motor unit, lowering the released pipe handler to position an elevator adjacent to a top coupling of a casing or liner joint, closing the elevator to grip the casing or liner joint, raising the gripped casing or liner joint and operating a link tilt of the pipe handler to swing the stand into alignment with a clamp of the casing unit, raising the pipe handler and the gripped casing or liner joint to stab a seal of the casing unit into the casing or liner joint, and operating the clamp to anchor the sealed casing or liner joint to the casing unit.

In one or more embodiment, the pipe handler and anchored casing or liner joint are further raised after stabbing of the seal to stroke the compensator from a hoisting position to a ready position.

In one or more embodiment, the method further includes releasing the elevator and backup tong from the anchored casing or liner joint, lowering the motor and drilling units to stab the anchored casing or liner joint into a casing or liner string, and operating the motor unit to screw the joint into the casing or liner string while operating a compensator of the motor unit to maintain a neutral condition, thereby extending the casing or liner string.

In one or more embodiment, the method further includes replacing the drilling unit with a cementing unit from the unit rack, using a work string to set a hanger of a casing or liner string, connecting a cement line to a swivel of the cementing unit, operating the motor unit to rotate the work string and casing or liner string, and while rotating the strings, pumping cement slurry through the cement line and cementing unit, operating an actuator of the cementing unit to launch a dart from a launcher of the cementing unit, and pumping chaser fluid behind the dart, thereby driving the cement slurry through the work string, releasing a wiper plug therefrom, and driving the cement slurry through the casing or liner string and into an annulus formed between the casing or liner string and a wellbore.

In one or more embodiment, the drilling unit is retrieved, raised, and delivered by operating a unit handler having a holder connected to an arm thereof.

In one or more embodiment, the method further includes removing the holder from the arm of the unit handler, and connecting a pipe clamp to the arm, operating the unit handler to engage the pipe clamp with a joint of casing or liner located below the rig floor, and operating the unit handler to raise the casing or liner joint to the rig floor.

In one or more embodiment, the method further includes replacing the drilling unit with a casing unit from the unit rack, wherein the unit handler is further operated to deliver the casing or liner joint into alignment with the casing unit and to hold the casing or liner joint while the casing unit is stabbed into the casing or liner joint.

In one or more embodiment, the method further includes removing the holder from the arm of the unit handler, and connecting a cargo hook to the arm, operating the unit handler to engage the cargo hook with cargo located below the rig floor, and operating the unit handler to raise the cargo to the rig floor.

In one or more embodiment, the holder is removed and the pipe clamp or cargo hook is connected by remote operation of a quick connect system.

While the foregoing is directed to embodiments of the present disclosure, other and further embodiments of the disclosure may be devised without departing from the basic scope thereof, and the scope of the invention is determined by the claims that follow.

The invention claimed is:

1. A top drive, comprising:
- a drive body including a chamber;
- a drive motor, wherein a stator of the drive motor is connected to the drive body;
- a drive ring torsionally coupled to a rotor of the drive motor and at least partially disposed in the chamber, wherein the drive ring has:
  - a central bore, and
  - an internal latch profile for selectively receiving a latch profile of a tool, the internal latch profile formed on a lower portion of the central bore; and
- a thread compensator having:
  - a lock ring disposed above the drive ring and torsionally connected to the drive ring; and
  - a linear actuator for moving the lock ring relative to the drive ring between a ready position and a hoisting position.

2. The top drive of claim 1, wherein a locking profile is formed on an upper portion of the central bore.

3. The top drive of claim 2, wherein the internal latch profile comprises a bayonet profile.

4. The top drive of claim 2, wherein the thread compensator further comprises a lock member for selectively connecting the lock ring to the tool received in the drive ring, and the linear actuator moves the tool and the lock ring together when the lock member connects the locking ring to the tool.

5. The top drive of claim 2, wherein the lock ring includes a locking profile, wherein the locking profile of the drive ring and the locking profile of the lock ring lock the tool at a mated position with the internal latch profile of the drive ring.

6. The top drive of claim 2, further comprising a control junction.

7. The top drive of claim 6, wherein the control junction comprises a stab connector having a plurality of cable or a plurality of passages formed through the locking ring.

8. The top drive of claim 2, further comprising a proximity sensor connected to the drive body for monitoring a position of the lock ring.

9. The top drive of claim 1, further comprising a video camera for monitoring alignment of the tool with the internal latching profile.

10. The top drive of claim 1, further comprising one or more thrust bearings disposed inside the chamber and between the drive body and the driving ring.

11. The top drive of claim 10, wherein the one or more thrust bearings are configured to transfer axial load between the drive body and the driving ring.

12. The top drive of claim 1, wherein the internal latch profile is a movable profile.

13. A modular top drive system, comprising:
- a motor unit, comprising:
  - a drive body including a chamber;
  - a drive motor, wherein a stator of the drive motor is connected to the drive body; and
  - a drive ring torsionally coupled to a rotor of the drive motor and at least partially disposed in the chamber, wherein the drive ring has:
    - a central bore, and
    - an internal latch profile for selectively receiving a latch profile of a tool, the internal latch profile formed on a lower portion of the central bore; and
  - a thread compensator having:
    - a lock ring disposed above the drive ring and torsionally connected to the drive ring; and
    - a linear actuator for moving the lock ring relative to the drive ring between a ready position and a hoisting position;
- a rack having a parking spot for receiving the tool; and
- a unit handler for retrieving the tool from the rack and delivering the tool to the drive unit.

14. The system of claim 13, wherein the unit handler comprises:
- a base;
- a post extending from the base;
- a slide hinge transversely connected to the post; and
- an arm connected to the slide hinge, wherein the arm comprises a holder to engage the tool.

15. The system of claim 13, further comprising one or more tools, wherein each of the one or more tools comprises:

a coupling head with an outer latch profile for matching the internal latch profile of the drive ring.

16. The system of claim 15, wherein the latch profiles are bayonet profiles.

17. The system of claim 15, wherein the coupling head has a control to junction.

18. A method of operating a modular top drive system, comprising:

aligning a latch profile of a tool with an internal latch profile formed on a lower portion of a central bore of a drive ring, the drive ring having a gear engaged with a gear of a motor unit;

inserting the tool into the drive ring;

engaging the latch profiles to connect the tool to the drive ring by rotating the latch profile of the tool relative to the internal latch profile;

lowering a lock ring between the engaged latch profiles of the tool and the drive ring to torsionally lock the latch profiles;

engaging one or more lock members carried by the lock ring with the tool; and rotating the drive ring and the tool using the motor unit.

19. The method of claim 18, wherein lowering the lock ring connects a control junction between the lock ring and the tool.

20. The method of claim 18, further comprising:

moving the engaged lock ring and tool between a hoisting position and a ready position; and performing one of a drilling operation, casing operation, and cementing operation with the tool.

21. The method of claim 18, further comprising using a linear actuator connected to the motor unit to lift a work string attached to the tool.

22. The top drive of claim 18, wherein the drive ring is at least partially disposed in a chamber of a drive body, and the method includes transferring load between the drive ring and the drive body.

* * * * *